US008317659B2

(12) United States Patent
Woodson

(10) Patent No.: US 8,317,659 B2
(45) Date of Patent: Nov. 27, 2012

(54) AQUATIC TRAINING SYSTEM AND METHOD

(75) Inventor: Peter S. Woodson, St. George, VT (US)

(73) Assignee: SwimNetix Corporation, Burlington, VT (US)

( * ) Notice: Subject to any disclaimer, the term of this patent is extended or adjusted under 35 U.S.C. 154(b) by 86 days.

(21) Appl. No.: 12/791,823

(22) Filed: Jun. 1, 2010

(65) Prior Publication Data

US 2010/0304934 A1 Dec. 2, 2010

Related U.S. Application Data

(60) Provisional application No. 61/183,171, filed on Jun. 2, 2009.

(51) Int. Cl.
*A63B 21/00* (2006.01)

(52) U.S. Cl. ..... 482/11; 482/8

(58) Field of Classification Search ..... 482/111, 482/54; 377/19

See application file for complete search history.

(56) References Cited

U.S. PATENT DOCUMENTS

| | | | | |
|---|---|---|---|---|
| 4,563,617 | A * | 1/1986 | Davidson | 315/312 |
| 4,932,045 | A | 6/1990 | Kasoff et al. | |
| 5,136,621 | A * | 8/1992 | Mitchell et al. | 377/24.2 |
| 5,349,569 | A * | 9/1994 | Tanaka | 368/10 |
| 5,386,219 | A * | 1/1995 | Greanias et al. | 345/174 |
| 5,391,080 | A | 2/1995 | Bernacki et al. | |
| 5,515,865 | A | 5/1996 | Scanlon | |
| 5,585,871 | A | 12/1996 | Linden | |
| 5,697,792 | A | 12/1997 | Ladin | |
| 5,813,945 | A | 9/1998 | Bernacki | |
| 5,938,565 | A | 8/1999 | Bernacki | |
| 6,072,751 | A | 6/2000 | Kirson et al. | |
| 6,392,962 | B1 | 5/2002 | Wyatt | |
| 6,580,943 | B2 | 6/2003 | Nissila | |
| 6,870,466 | B2 * | 3/2005 | Rust et al. | 340/323 R |
| 7,029,170 | B2 | 4/2006 | Bailey | |
| 7,184,370 | B2 * | 2/2007 | Rogacki et al. | 368/107 |
| 7,257,517 | B2 | 8/2007 | Shitan | |
| 7,358,456 | B1 * | 4/2008 | Julian et al. | 200/512 |
| 7,641,590 | B2 * | 1/2010 | Chan | 482/3 |
| 2002/0026229 | A1 | 2/2002 | Weil et al. | |

(Continued)

FOREIGN PATENT DOCUMENTS

| | | |
|---|---|---|
| AU | 645673 | 10/1992 |

(Continued)

*Primary Examiner* — Jerome W Donnelly

(74) *Attorney, Agent, or Firm* — William A. Loginov; Keri E. Sicard; Loginov & Associates, PLLC

(57) ABSTRACT

A system and method for training swimmers in a controlled aquatic environment, such as a pool, the system comprising a base station in communication with various system components. The base station receives pertinent data from the swimmer through direct wiring detecting a contact with the pool (i.e. the completion of a lap) or through wireless communication. The base station can include an accelerometer-based touch pad for detecting contact of a swimmer with the pool wall. The base station can alternatively include an optical transceiver for transmitting and receiving swimmer data. The swimmers can be equipped with a finger tapper and a toe tapper for determining lap times and sending the relevant information to the base station. The training system can also include an underwater display for providing relevant information to a swimmer within a pool and an underwater video camera for recording video footage of swimmers.

13 Claims, 41 Drawing Sheets

U.S. PATENT DOCUMENTS

| | | | | |
|---|---|---|---|---|
| 2005/0012591 | A1 | 1/2005 | Tomljenovic et al. | |
| 2005/0243651 | A1* | 11/2005 | Balley | 368/10 |
| 2006/0008275 | A1* | 1/2006 | Lacovara et al. | 398/140 |
| 2007/0132117 | A1 | 6/2007 | Pujol et al. | |
| 2008/0205892 | A1 | 8/2008 | Baiden | |
| 2010/0201500 | A1* | 8/2010 | Stirling et al. | 340/407.1 |

FOREIGN PATENT DOCUMENTS

| | | | |
|---|---|---|---|
| WO | WO 9932889 | A2 | 7/1999 |
| WO | WO 0067858 | A1 | 11/2000 |
| WO | WO 0116891 | A1 | 3/2001 |
| WO | WO 2008136928 | A2 | 11/2008 |

* cited by examiner

AQUATIC TRAINING SYSTEM AND METHOD

RELATED APPLICATIONS

This application claims the benefit of U.S. Provisional Application Ser. No. 61/183,171, filed Jun. 6, 2009, entitled AQUATIC TRAINING SYSTEM AND METHOD, the entire disclosure of which is herein incorporated by reference.

FIELD OF THE INVENTION

The present invention relates to training systems and methods for swimmers in a controlled aquatic environment.

BACKGROUND OF THE INVENTION

Athletes, such as swimmers, train for various events and water sports to improve their performance. Swimmers train for general fitness or for events such as swim competitions, triathlons, and water polo matches. Swimmers train either individually or as a team. For an individual swimmer it is difficult to monitor lap times, lap count, heart rate and other information pertinent to determining and monitoring their swimming performance without hiring a coach to be on the side of the pool and record data. Hiring a coach for an individual swimmer is costly, time-consuming (for both the swimmer and the coach) and often in violation of pool rules. For swim teams with coaches, it is difficult for a single coach to capture lap times, lap count and heart rate for every swimmer during a swim practice.

Some individual swimmers and swim teams use a "pace clock" that allows swimmers, coaches, or other individuals to visually estimate lap times of an individual. A swimmer has the ability to "time" his or her laps (manually) using the pace clock. However, the swimmer must physically observe the clock when he or she begins swimming, strain to look at the clock when he or she has completed a lap, and then calculate the elapsed time since his or her first glance at the pace clock, in order to ascertain their lap time for each lap that is completed. This has clear disadvantages, and it distracts from the swimmer's ability to perform his or her swim training.

A prior attempt to overcome this disadvantage provides a touch pad on the side of the pool combined with a display, as shown in FIG. 1. A pool 100 is shown with a swimmer 110 swimming therein. The touch pad 120 detects each time there is contact between a swimmer and the pad using resistive or capacitive techniques, and the system computes the elapsed time since the prior contact. The touch pad 120 is operatively connected to a wall-mounted or deckside display 130 adapted to display the lap times to be viewed by swimmer 110 via line-of-sight 115. However, the touch pads are large, rigid, heavy, and expensive, and must be provided and installed by the swim facility and connected to the facility timing system control module and display. Additionally, the swimmer 110 may have to alter their stroke in order to view the display 130 via line-of-sight 115. Due to the high cost of the touch pads and the need to run cables, which are prone to wear and present a trip hazard, along the swim deck, the touch pads are often only installed during swim competitions, making them unavailable for training. Individual swimmers have no ability to use these touch pads without access to the facility timing system control module. Due to the large size, weight, cost and rigidity of the touch pads, it is impractical for an individual swimmer to bring their own system to the pool for training. Furthermore, for teams and individuals in a crowded pool, there is no mechanism for accounting for multiple swimmers per swim lane, nor for any storage of individual swim data, since the touch pad has no means of distinguishing the contact of one swimmer from another swimmer. An exemplary touch pad is described in U.S. Pat. No. 7,358,456 entitled SWIMMING POOL TOUCHPAD. As with other prior art touch pads, this touch pad is large, rigid, and heavy (and presumably expensive based on the technology employed), and therefore impractical for an individual swimmer. Also, as with other prior art touch pads, it cannot be used in a multi-swimmer environment, since it cannot distinguish the contact of one swimmer from another swimmer. There is no solution found in the prior art that provides individual swimmers with a small, lightweight, portable and inexpensive overall swim training system and method that provides sufficient information, readily available, and able to be stored for future use.

It is thus desirable to provide a system and method for aquatic use that provides swimmers with a swim training system that is personalized to a discrete swimmer, yet readily usable by many swimmers when desired.

SUMMARY OF THE INVENTION

This invention overcomes the disadvantages of the prior art by providing a system and method for swim training in an aquatic environment. The system is applicable to an individual swimmer as well as a plurality of swimmers, such as in a swim team. Additionally, the system is small, lightweight, portable and inexpensive to allow individual swimmers to purchase and bring to the pool for their own training purposes. Determining lap times, lap counts, heart rates and other swim data according to the system does not interfere with the natural swim stroke, such as how the use of a wristwatch to record lap times causes a swimmer to break their natural swim stroke to press the watch buttons. The data gathered from the swimmers can be stored and displayed to the swimmer in a convenient manner, without disrupting the swimmer's swimming. Moreover, the system provides swimmers with feedback, including, for example, their lap times, heart rate, and other desirable information and data, both during swimming and to be stored and reviewed at a later time by the swimmer, as desired.

The system includes a LapStation that is a base station in communication with other system components. The base station receives pertinent data from a swimmer through either direct wiring that detects a contact or through wireless (optical, RF or other) communications. The LapStation can be operatively connected to a LapTouch sensing pad that detects contact of a swimmer with the small, lightweight, flexible and inexpensive pad to determine lap times. The sensing pad can employ an accelerometer (or array of accelerometers) that detects movement of the pad along one of a plurality of axes to detect contact of a swimmer with the pool wall. The system is constructed and arranged such that once a signal has been detected from the touchpad, there is a lock-out of the signal from the touchpad for a predetermined period of time, to ensure that unnecessarily duplicative readings are not obtained—thereby guaranteeing that only the first touch per lap (hand or foot) is logged as the lap's actual touch event. The LapTouch can also contain a heart-rate monitor integrated with the control electronics. For multiple swimmers using the same LapTouch at the same time, multi-swimmer environment, the LapTouch is outfitted with an RFID reader and swimmers are outfitted with passive RFID tags on their wrists and feet.

The LapStation can alternatively be operatively connected to a LapEye device in an overall LapTapper system. In the LapTapper system, swimmers are provided with a FingerTapper and ToeTapper to transmit data to a LapEye, and, thus, also to the LapStation. The FingerTapper and ToeTapper can be used to determine lap times, and obtain heart rate and other data from a swimmer. The data is transmitted between the various components of the wireless embodiment of the invention using coded light pulses that are generated by the LapTapper system, including the FingerTapper and the ToeTapper, and are received by the LapEye. The system is constructed and arranged such that once a signal has been detected by the LapEye, there is a lock-out of the signal by the LapEye for a predetermined period of time, to ensure that unnecessarily duplicative readings are not obtained—thereby guaranteeing that only the first touch per lap (hand or foot) is logged as the lap's actual touch event.

In general the system and method aids in improving swim training for numerous swimmers, swim teams, and other swimming persons, in the training of various aquatic environments. The system permits athletes and coaches to prepare long-term swim goals over the course of a season, multiple seasons or swim career. In addition the system permits athletes and coaches to prepare individual swim plans or workouts. These digital swim practices can be brought to the pool stored in the LapStation. In the LapTapper system, each swimmer on a swim team can have a ToeTapper and a FingerTapper. In this manner, multiple swimmers can be monitored, and trained, using a single LapStation, as each ToeTapper and FingerTapper can be programmed with a unique identifier.

Furthermore, the LapStation is convenient to be used by a single, dedicated athlete that is training on his or her own. The LapStation can include hardware and software, or any combination thereof, to perform the processes of the invention. The LapStation includes data entry mechanisms for creating swim plans and uses other techniques and methods available by the swim training base station to train for swim events and improve swimming performance. A touch-screen implementation of the LapStation can be provided that is fully watertight and submersible to provide a base station and display as a single device.

The LapStation is capable of managing a swimmers workout through either (i) a swim plan created by the swimmer, coach or other athlete, (ii) free swim or (iii) a system generated swim plan. A swim plan (either system generated or created by a person) contains one or more swim sets each of which define the number of repetitions, length, pace, duration, stroke, technique, breathing rate, special equipment (e.g., kickboard) and/or other instructions for completing the swim workout. The LapStation assists the swimmer with stepping through the workout by automatically sending the swimmer off on the next swim within a swim set based on pace or rest intervals (e.g., rest 30 seconds between swim) and adjusting the workout if the set is either too hard or easy (e.g., making the pace slower if a swimmer repeatedly misses the interval). The LapStation indicates to the swimmer that it is time to start the next swim within a set using a countdown to an audible buzzer and visible flash, by displaying on a touch-screen implementation of the base, or other visual indicator. In this respect, the LapStation act as a virtual coach progressing a swimmer through a workout. A free swim has no defined sets, and collects the swimmers lap times, lap counts and heart rate from the time the swimmer presses the Start button until the time the swimmer presses the Stop button. The LapStation with touch-screen display is capable of playing videos such as swim technique videos, or replay of practices or races to aid in training.

BRIEF DESCRIPTION OF THE DRAWINGS

The invention description below refers to the accompanying drawings, of which.

DETAILED DESCRIPTION

I. System Overview

In an illustrative embodiment, a system and method for swim training, monitoring and swim plan creation is provided, for swimmers training in an aquatic environment, such as a swimming pool. The system and method is designed for use by individual swimmers, such as those training for general fitness, masters swimming competitions or a triathlon, and also for swim teams and other groups having multiple swimmers, for example training for a swim meet or other team-type event. The swimmers utilize this information to improve their performance and set goals as the swimmers approach events for which they are training. It also improves a swimmer's autonomy in training for swimming, by providing a "virtual" coach, through the use of the LapStation Swim Plan creation, and other techniques and advantages described herein.

Figure 1:
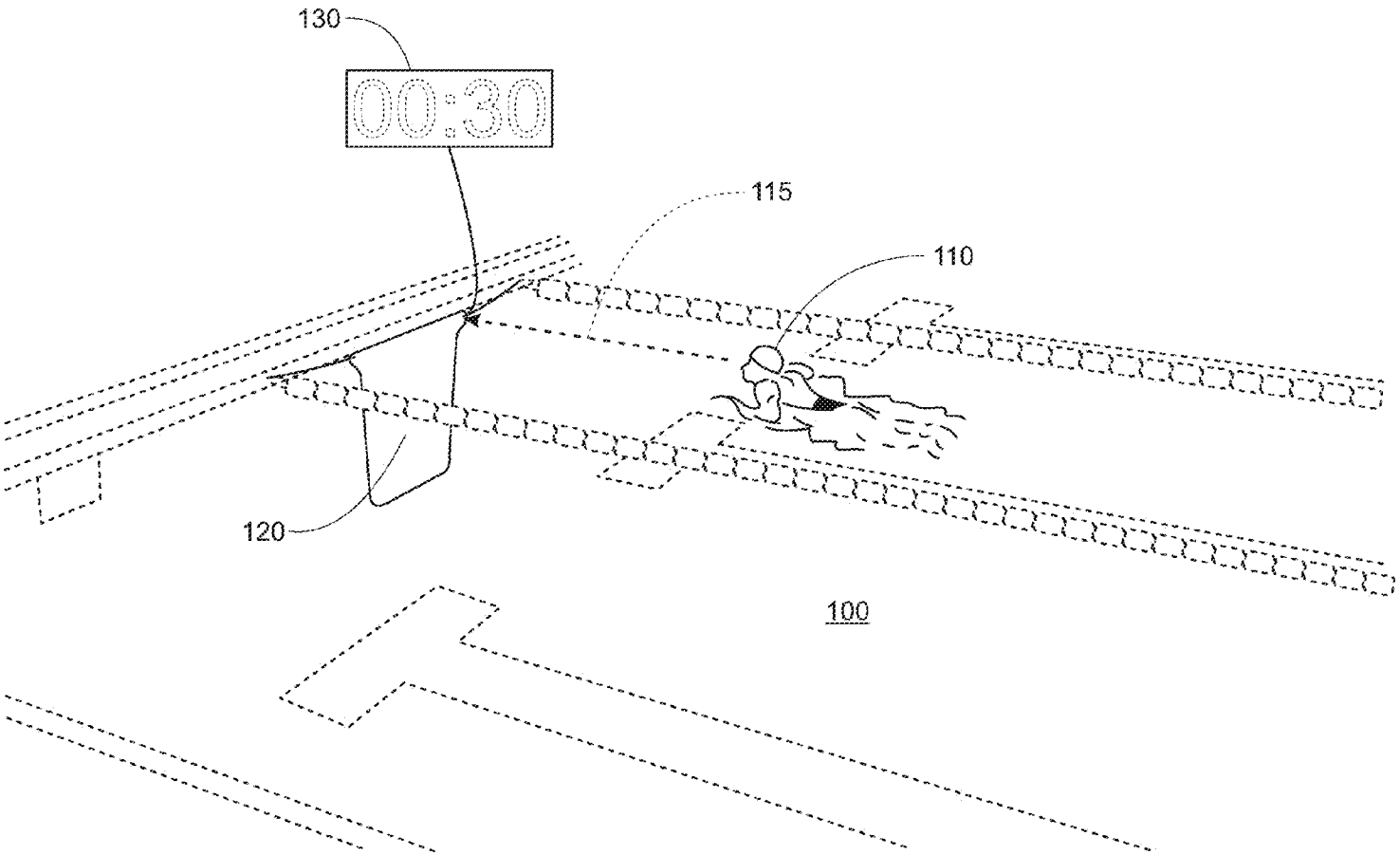
FIG. 1 (Prior Art)
FIG. 1, already described, is a prior art swim training system, employing a touch pad and display for swimmers.
Figure 2:
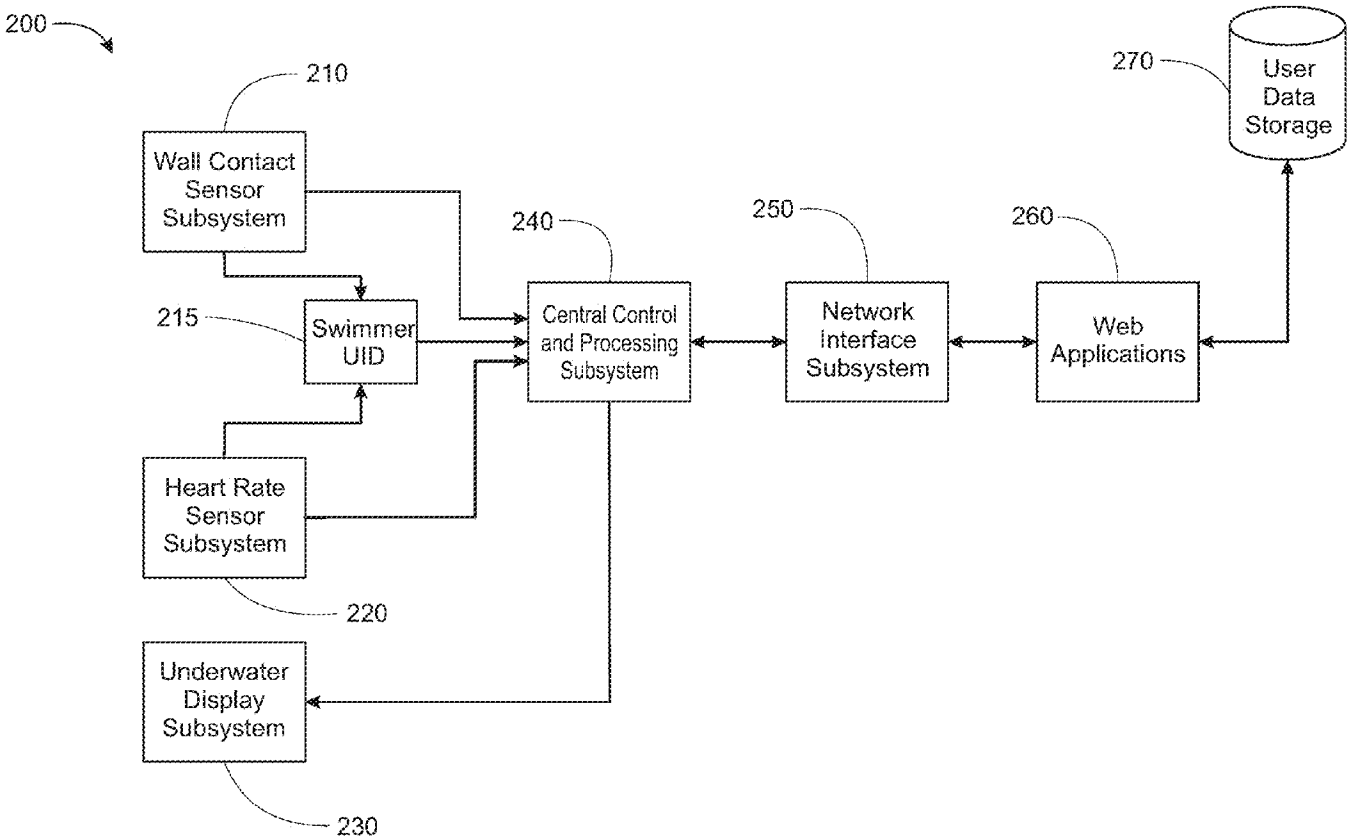
FIG. 2 is a block diagram showing an overview of a system for swim training employing either a wall-contact or tapper system for recording laps according to various illustrative embodiments.

FIG. 2 shows a block diagram 200 of an overview of a system for swim training according to one or more illustrative embodiments contemplated herein. The system includes a plurality of subsystems that communicate with a base station control device (central control and processing subsystem 240) to obtain and analyze swim data. Swim data may be transmitted to a Network Interface Subsystem 250, and the gathered swim data pertinent to each swimmer can be transmitted to other devices, including web applications 260, as shown in FIG. 2, to be stored in a user data storage 270. The swim data may also be transmitted to underwater display subsystem 230. There is a wall contact sensor subsystem 210 that determines whether a swimmer has completed a lap through direct contact with the wall (a pool-mounted touch pad device), or through a hand device and a foot device (a "tapper"). Where the system supports multiple swimmers, each swimmer is assigned a unique identification (UID) number 215 that is associated with and appended to that swimmer's swim data in the base station. The UID is associated with the particular tappers or passive RFID tags being employed by the swimmer being employed by the swimmer so that any data generated by each, is stored/displayed with respect to that swimmer.

The system 200 also optionally includes a heart rate sensor subsystem 220 in which the heart rate of a swimmer is monitored. This sensor arrangement can include sensors directly placed on a swimmer, such as on a hand tapper device, or sensors located on the base station or touch pad for a swimmer to determine heart rate by applying his or her hand, or another body part, directly to the base station or an associated peripheral such as a heart rate strap, for a direct heart rate reading. The hand device-mounted sensors can be used both for instantaneous heart rate monitoring and to continuously monitor and record heart rate, such that a swimmer can subsequently review his or her heart rate continuously throughout the practice, as will be described in greater detail hereinafter.

II. Touch Pad Implementation

Figure 3:
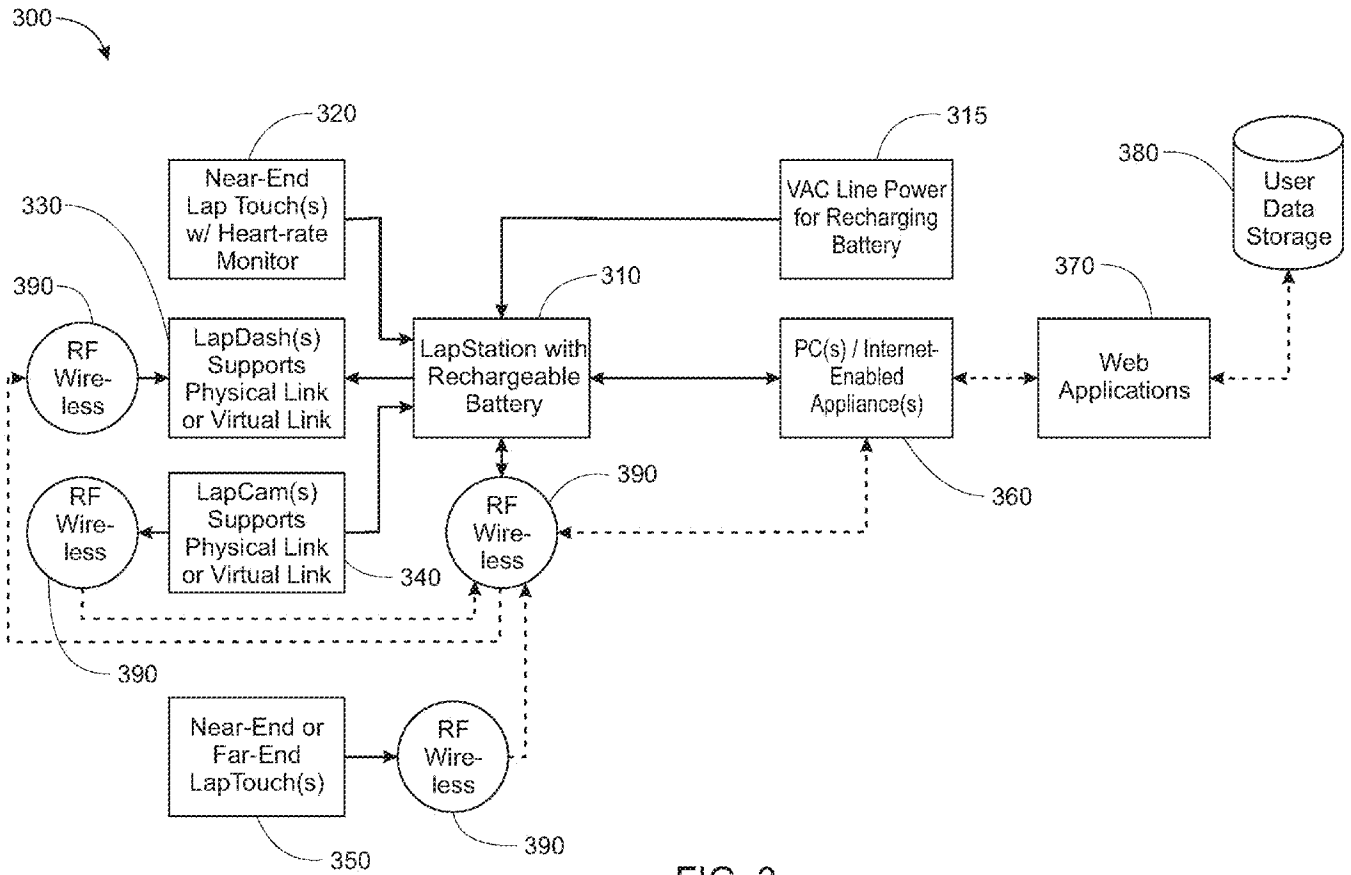
FIG. 3 is a block diagram showing an overview of a system for swim training employing a wall-contact, touch pad system according to illustrative embodiments.

An overview of an illustrative embodiment of a system for swim training that generally employs a touch pad configuration is detailed in the block diagram 300 shown in FIG. 3. The base control device LapStation 310 is a component of the overall system 300 for swim training, and is in communication with the other aspects of the swim training system. The base control device LapStation 310 illustratively includes a rechargeable battery, and can be recharged through an A/C power line 315 or when physically connected to a computer 360. Additionally, multiple LapStation devices 310 can be provided in communication with each other and the various system components. The A/C power line 315 need not be provided in an environment employing a battery or power source that is replaceable or otherwise interchangeable without requiring a hard wired connection. As will be described in greater detail below, the depicted system employs a direct or wireless connection with a "LapTouch" sensor touch pad that is adapted to physically sense contact with a pool wall by a swimmer. The principles of this arrangement can be adapted to a pad-less configuration as described further below (FIG. 13) using the LapTapper configuration that employs a FingerTapper and ToeTapper worn by each swimmer. As will be described, the tapper configuration enables fully wireless communication with an optical sensor connected to the base station by the swimmer using, for example, optical data transmission via LEDs and photodetectors. In general, according to illustrative embodiments, the components of the system, such as the base station can be optionally adapted to support either or both a wireless tapper system and a touch pad system—depending upon the user's preferences.

In a system particularly employing the LapTouch sensor pad, the Near-End lap touch(es) 320 are detected and this information is transmitted to the LapStation. Near-End indicates that the LapTouch sensor pad is located at the same end of the pool as the LapStation base station. A Far-End LapTouch 350 sensor pad can be employed to detect wall contacts at the far end of the pool in relation to the location of the LapStation. Information from the LapTouch pads can be transmitted by wire or wirelessly to the LapStation. The system 300 can also include a LapDash 330 that displays the lap time, and other pertinent information, as provided by the swimmer having made contact, evidenced by a Near-End Touch 320 or Far-End Touch 350. As shown, the components of the system communicate through direct wiring and/or RF wireless communication points 390 that allow the devices to communicate without the need of wires, which can be logistically burdensome and hazardous, particularly in a swimming pool environment.

In a swim training system employing the LapTapper configuration, employing a LapEye optical communication device and a FingerTapper and a ToeTapper, the LapEye device (which will be described in greater detail hereinbelow in reference to FIGS. 8-13) includes an optical sensor that detects optical data transmissions from FingerTapper and ToeTapper. This data is transmitted from the LapEye to the LapStation 310, either by direct wiring or through optical or RF wireless communication. As briefly mentioned above, the LapTapper system employs a FingerTapper and a ToeTapper, having LEDs thereon, for optical, RF or other type of wireless data transmission to the LapEye underwater signal detection and general communication device. FingerTapper and ToeTapper send a signal to the LapEye for each contact with the wall of the pool. Encoded in the signal is the unique identifier of the swimmer. In addition, encoded in the optical data transmission from the FingerTapper can be the swimmer's heart rate, which is detected by an array of electrodes on the underside of the wristband of the FingerTapper. See the heart rate sensors 2140 shown in FIG. 21, for example. FingerTapper and ToeTapper determine a wall contact through the use of small contact switches or similar devices located on the tip of the finger or ball of the foot. See contact switch 2130 of FIG. 21 for the FingerTapper hand device block diagram and contact switch 2230 of FIG. 22 for the ToeTapper foot device block diagram. Contact with the wall activates the contact switch or similar device, which triggers the FingerTapper or ToeTapper to transmit a wall contact event to the LapStation via the LapEye optical sensor. To prevent the LapEye optical communication device from incorrectly duplicating readings for a swimmer, the signal transmitted by the FingerTapper and ToeTapper is, ignored by the LapEye for a predetermined number of seconds following the successful detection of a signal from the swimmer, such that multiple readings do not come through for a single swimmer. The period for which the LapEye ignores secondary data transmission from a swimmer can be configured in the LapStation by the swimmer prior to a workout. In further embodiments, the wireless data transmission between the swimmer tapper devices and the LapEye and/or LapStation can be optical or RF transmission.

Figure 14:
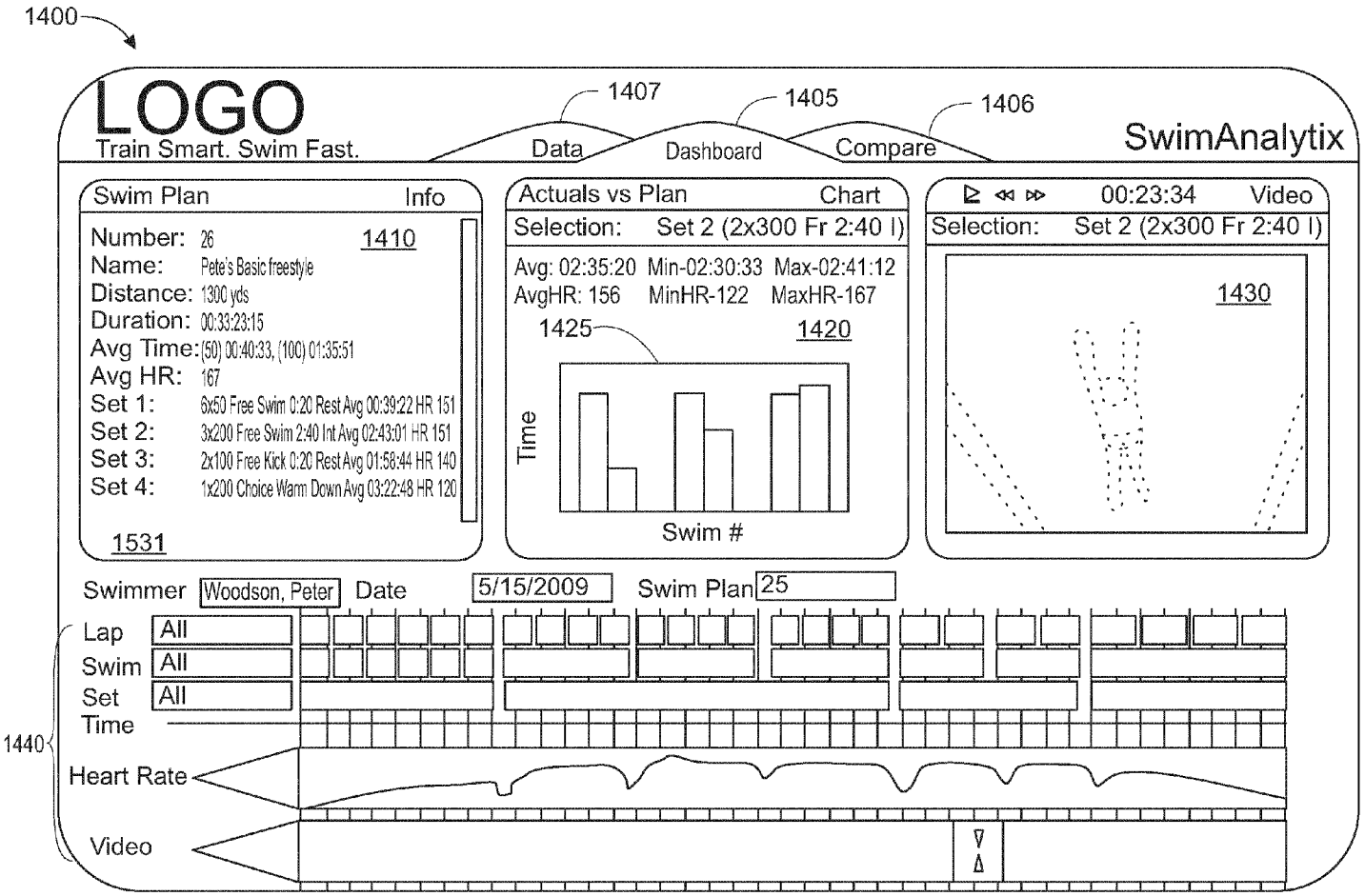
FIG. 14 is a diagram of a graphical user interface display showing a swim training screen for a swimmer to view pertinent data relating to their swimming, according to the illustrative embodiments of the swim training system.
Figure 15:
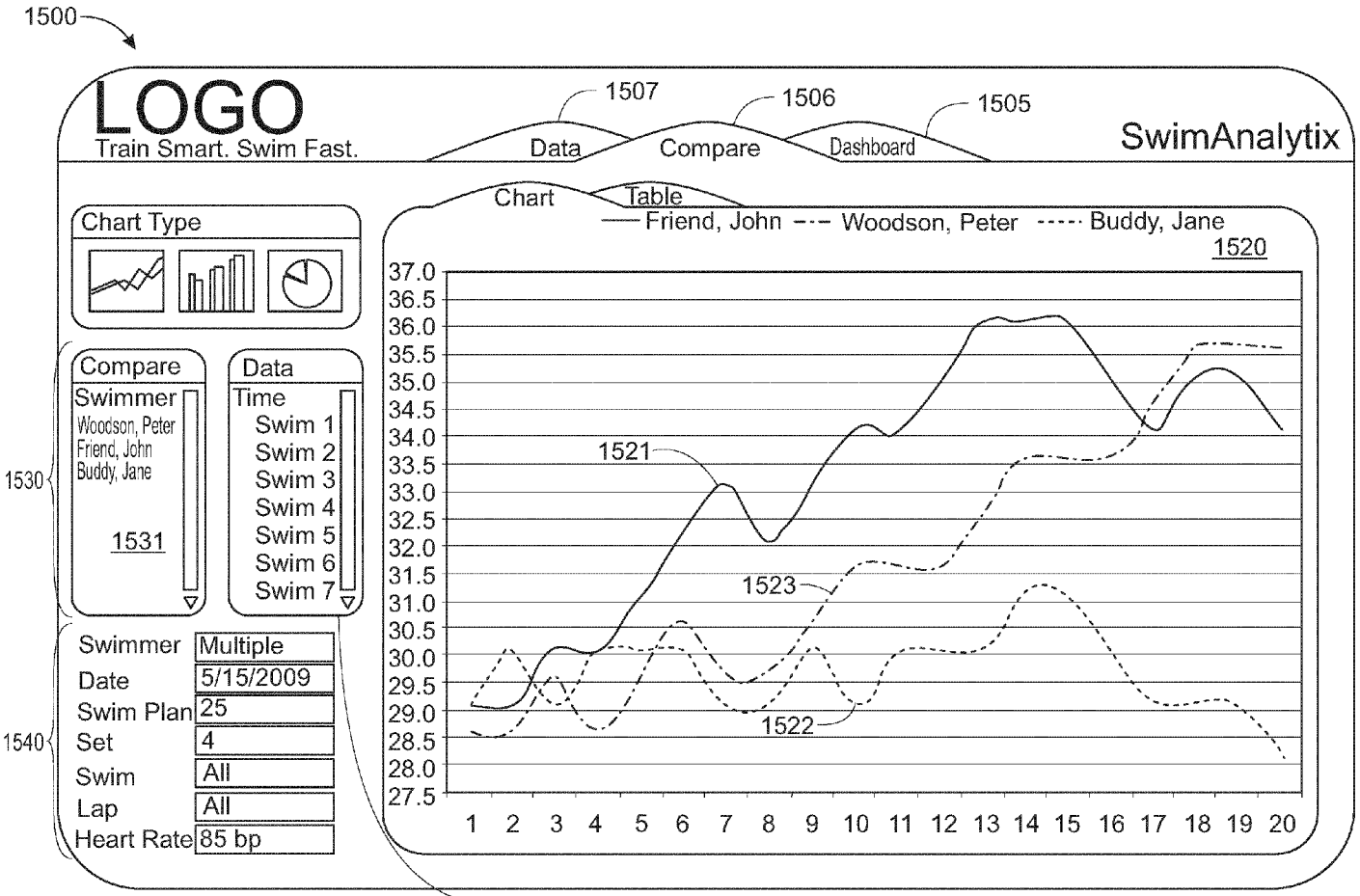
FIG. 15 is a diagram of a graphical user interface display showing a chart comparing lap times of one swimmer to another swimmer, according to the illustrative embodiments.

The lap times, lap counts, heart rates and other data recorded by the LapStation can be transmitted to other devices, such as a Personal Computer (PC) or other Network/Internet-Enabled Appliance 360, as will be described in greater detail below. With reference particularly to FIGS. 14 and 15, exemplary graphical user interface or browser screen displays are shown for allowing swimmer to view, report, analyze and manage their swim data. As will be described in greater detail, the gathered information pertinent to each swimmer can be transmitted to these other devices, including web applications 370, as shown in FIG. 3, to be stored in a user data storage 380. These applications and processes can be carried out via hardware, software, or a combination of both.

One or more discrete, waterproof video cameras, e.g. LapCam 340 of conventional design can be located at one or more positions with respect to the swimmer(s). The video camera arrangement allows the acquisition of video data with respect to swimmers. The LapCam can be interconnected with the LapStation 310 via either a wireless connection point 390 link or a wired link as appropriate.

Figure 4:
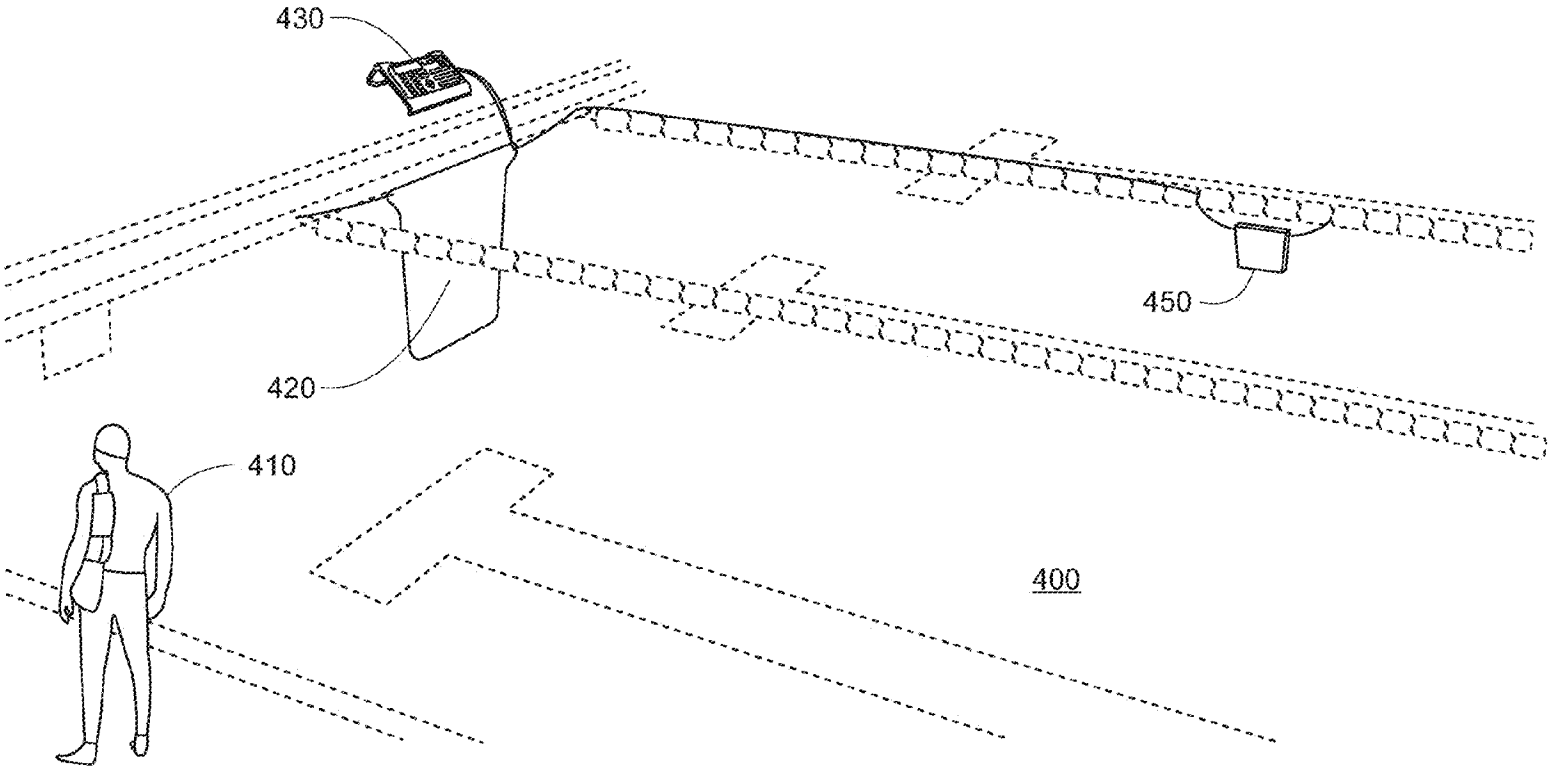
FIG. 4 is a perspective view of a swimming pool environment employing the swim training system according to an illustrative embodiment, including a base station and touch pad operatively connected thereto.

Reference is now made to FIG. 4, detailing a perspective view of a swimming pool 400 employing the base station and touch pad configuration according to the swim training system and method. There is provided a swimmer 410 about to commence swimming in the swimming pool 400. Once the swimmer begins swimming, the touch pad LapTouch 420 is capable of detecting contact with respect to the pool wall, and this information is transmitted to the base station LapStation 430 where the data is recorded and displayed for the swimmer. Alternatively, the LapStation can be integrated with the LapTouch into a single unit. The functionality of the hardware and software components of the swim training system will be described in greater detail hereinafter, particularly with reference to FIGS. 16-23.

The lap time, heart rate, and other information gathered from the swimmer 410 can also be transmitted to an optionally provided underwater display LapDash 450. This display is enclosed in a casing that is resistant to water, and conveniently provides swimmers with an underwater display of pertinent and relevant information to assist in their swim training. Power to the LapDash can be provided via sealed rechargeable or disposable battery, power/data cable and/or inductive charging system (describe generally below). The display on the LapStation base station can also act as an underwater display similar to the optionally provided LapDash.

Figure 4A:
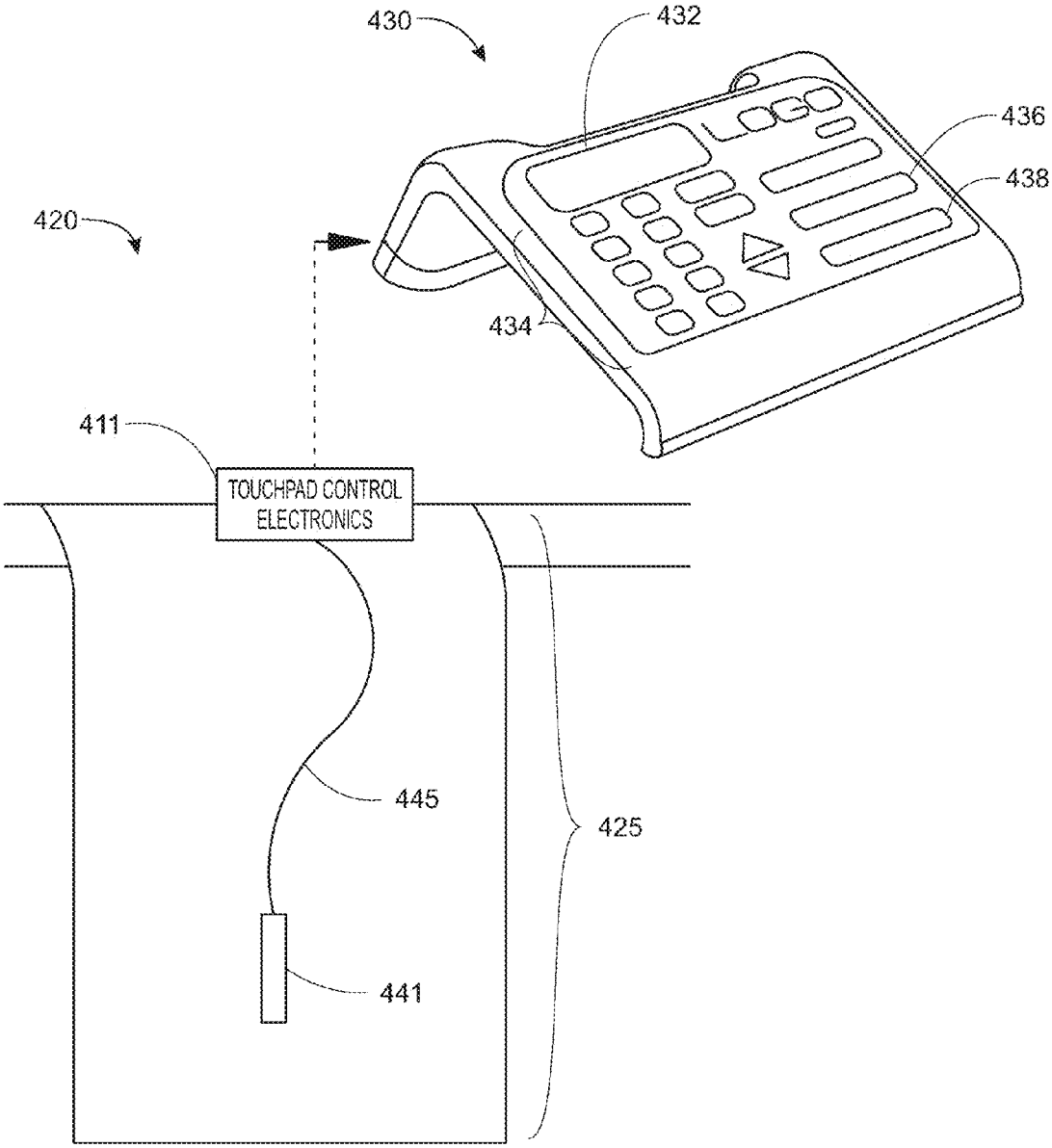
FIG. 4A is a front perspective view of a touch pad employing an accelerometer configuration, operatively connected to the base station, according to illustrative embodiments.

FIG. 4A details a front perspective view of the touch pad for use with the embodiment of FIGS. 3 and 4, employing an accelerometer-based configuration, which is operatively connected to the base station, according to the illustrative swim training system. The components that are operatively connected to each other can be connected by wireless communication or through direct hard-wiring of the components. The LapTouch touch pad 420 includes touchpad control electronics 411, responsible for logging the movement of the accelerometer, evidencing contact with the pool wall by a swimmer and capable of differentiating an actual touch by a swimmer from random water motion by analyzing the three axes of the accelerometer. The LapTouch touch pad 420 includes a flexible (e.g. Nylon, polymer, rubber, textile) sheet 425 that suspends from the side of the pool, as shown in the overview pool environment of FIG. 4. The touchpad control electronics is operatively connected to the LapStation 430. The touchpad control electronics can be embedded in the touch pad, provided as a separate unit or integrated in the base station itself The touch pad supports a conventional tri-axis accelerometer assembly 441 that is integrated with the touchpad control electronics and/or connected to the touchpad control electronics 411 via appropriate wiring 445. In addition, the use of a third-party electronics device with an integrated accelerometer such as smart phones (e.g., Apple Corporation iPhone), personal data assistants (PDAs), windows mobile devices, tablet computers (e.g., Apple Corporation iPad), or similar electronics devices are expressly contemplated. As will be described with reference to FIGS. 6 and 7, the accelerometer assembly 441 is used to detect movement along each of at least three axes of movement. In this manner, a swimmer who does not make a complete contact with the wall, but who causes sufficient movement of the sheet 425, will still cause the touchpad control electronics to indicate that a lap has been completed. This is highly advantageous as it accounts for near-contacts with the wall, for example in instances when a swimmer does not make complete and perfect contact with the wall. The accelerometer assembly 441 is appropriately sealed against water infiltration, either by locating it within the body of the pad, surface mounted to the control electronics or locating it in a waterproof touchpad control electronics that is adhered to a surface (front or rear) of the pad. (See FIG. 5E showing a detailed exploded view of a touch pad configuration with an accelerometer integrated into the circuit card 565).

The touch pad is positioned along the wall by use of a strap or cord (nylon, metal, or other material) that is connected to the two lane lines that define the lane. The strap is directed through slits in the touch pad or otherwise connected to the touch pad. The strap is pulled tight by the swimmer such that the top of the touch pad runs parallel with the top of the water and spaced slightly away from the pool wall. At the end of practice, the swimmer readily releases the strap and unhooks it from the lane lines. In the case where the end lanes (the lanes on the edge of the pool) lack a lane line on the pool edge, a clamp is inserted into the pool gutter to act in place of the missing lane line. The strap is then directed between the clamp and the other lane line.

The LapStation 430, also shown in FIG. 4A, includes a display 432, and a plurality of input buttons 434, that can be used in the creation of a swim plan, for example. These buttons may be dedicated, non-reconfigurable "hard keys" as depicted in FIG. 4A, or software reconfigurable "soft keys" where the label for each soft key is presented to the use in the display. One exemplary creation of a swim plan will be described with reference to FIG. 27 hereinbelow. The LapStation 430 also includes a "START" button 436 to allow a particular swimmer to indicate when he or she will commence swimming, and also a "STOP" button 438 to indicate when a particular swimmer desires to stop swimming.

Figure 5A:
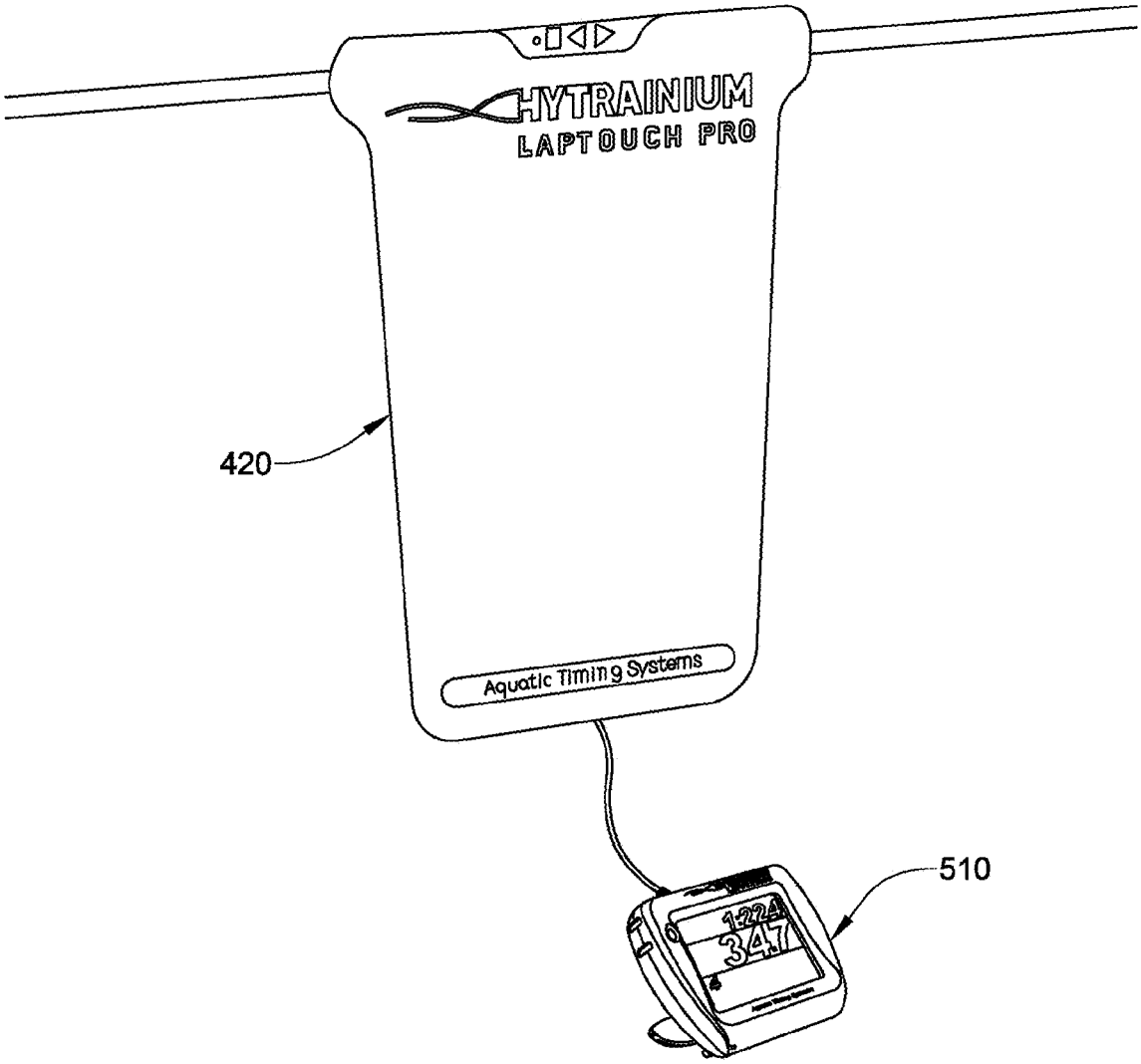
FIG. 5A is a front perspective view of the touch pad operatively connected to a base station having a waterproof touch-screen display, according to an illustrative embodiment.

Reference is now made to FIGS. 5A-5D showing a touch-screen implementation for the LapStation base station of the overall system. As shown in FIG. 5A, a LapStation-TS (touch-screen) device 510 is operatively connected to the LapTouch touchpad 420. The LapStation-TS device 510 is watertight and waterproof and capable of being completely submersed in water, as depicted in FIG. 5A. As described herein, the waterproof rendering of the LapStation base control device is standardized to at least IP-68, and is capable of being submersed and operated under water at deep depths and for long periods of time. This is contrasted with enclosures that are merely splashproof, such as IP-67, which are not suitable for the LapStation base control device, because they are only waterproof for 15 minutes down 1 meter. The waterproofing of the base control device enclosure is described hereinbelow.

Figure 5B:
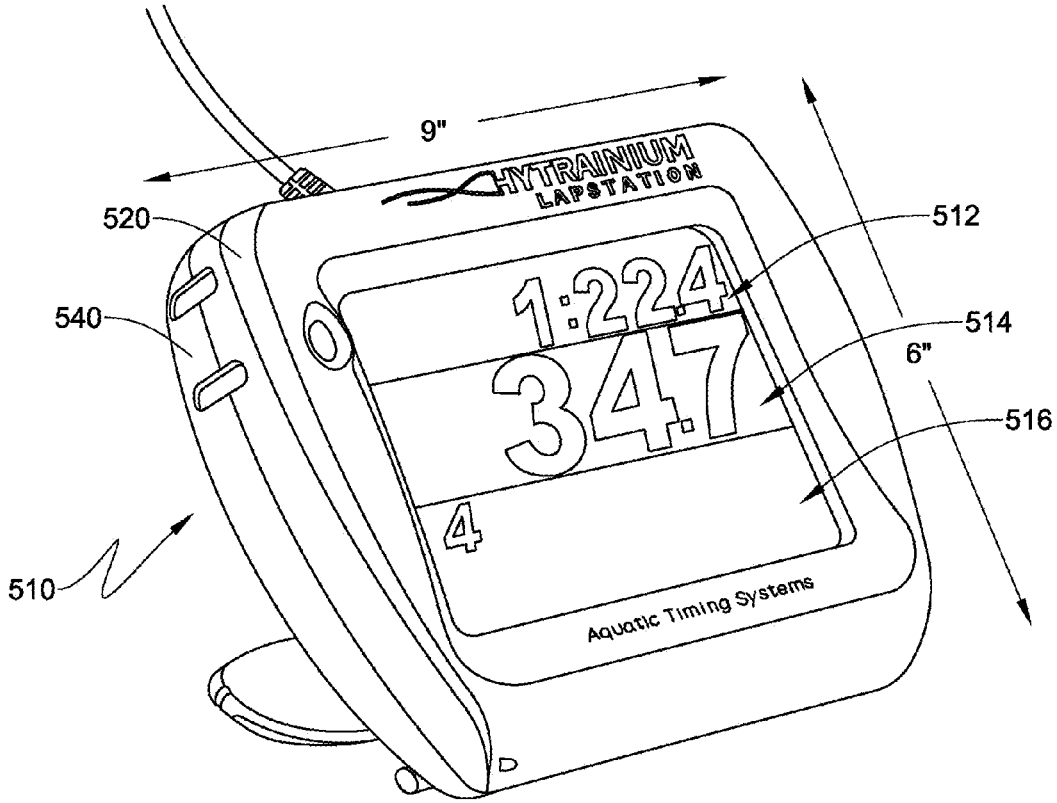
FIG. 5B is a front perspective view of the touch-screen base station according to illustrative embodiments.

The LapStation-TS device 510 displays swimmer data and other information to a user. Exemplary screen displays are shown and described below in greater detail with reference to FIGS. 30-39. As shown in FIG. 5B, the LapStation-TS touch-screen device 510 displays a run-time operational screen including a first display portion 512 that displays the total elapsed time for the swim (1:22.4 in the illustrative embodiment); a second display portion 514 that shows the lap time for the most recent lap (34.7 in the illustrative embodiment) and a third display portion 516 which displays the lap count, showing the number of laps the user has completed this swim (four in the illustrative embodiment).

The LapStation-TS computer device 510 is covered with a removable protective rubber skin 520. The rubber skin 520 serves to protect the touch-screen display and the respective adhesive overlay (shown in greater detail in FIG. 5C). Additionally, the rubber skin 520 provides a stand-off to keep the screen displaced from surfaces when it is set face-down, as well as to provide better grip for the overall LapStation-TS device 510. Furthermore, the rubber skin 520 may be varied in appearance and color, to provide a rubber skin as desired for a particular user.

Figure 5C:
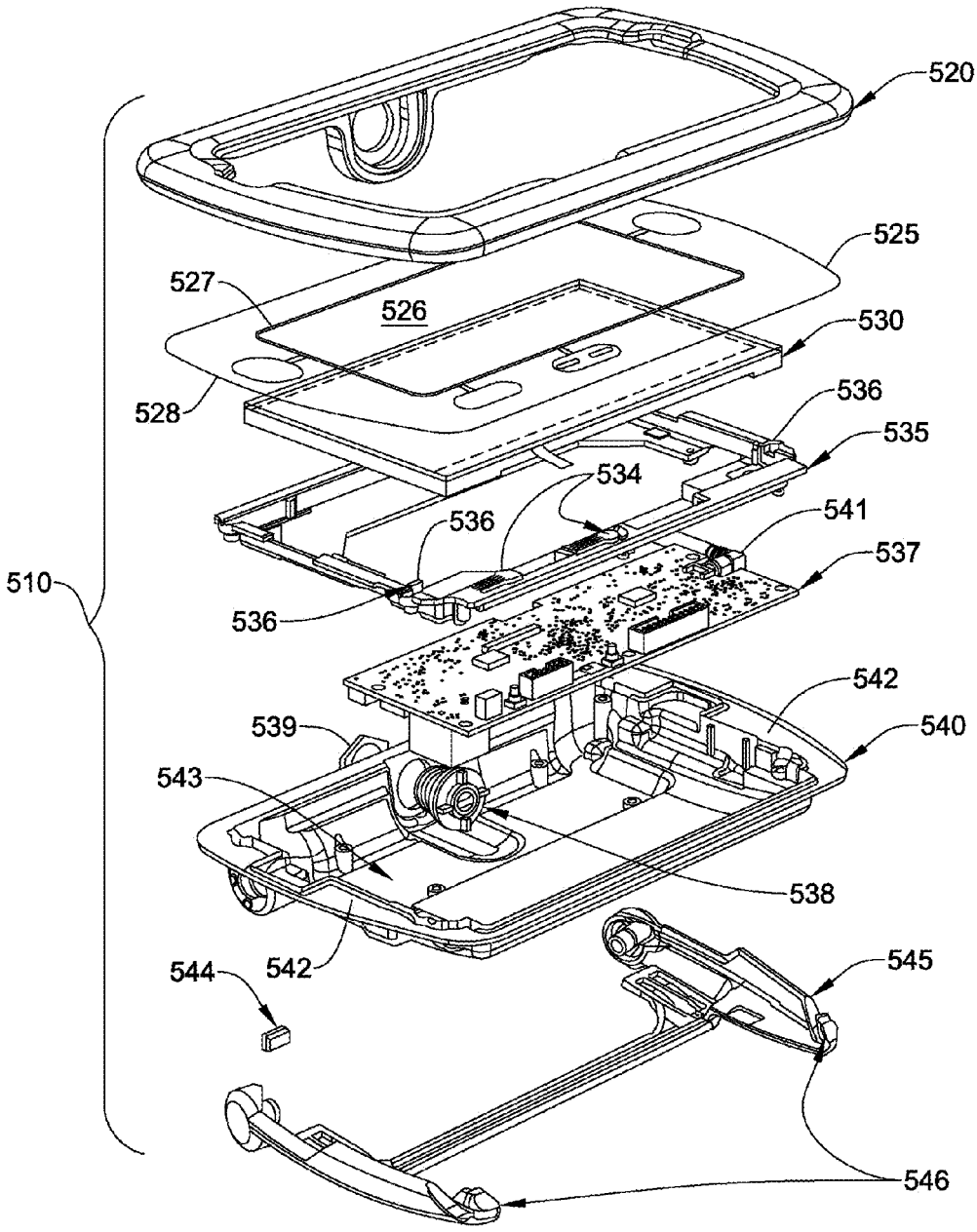
FIG. 5C is an exploded view of the components of the touch-screen base station according to illustrative embodiments.

Reference is now made to FIG. 5C, showing an exploded view of the LapStation-TS base station touch-screen computer device 510. As shown, an adhesive overlay 525 is placed on the top of the touch-screen display 530. The display 530 can comprise a Liquid Crystal Display (LCD) and touch-screen assembly. The adhesive overlay 525 provides a waterproof seal for the screen 530 and further protects the touch-screen from scratches or other damage. Furthermore, the adhesive overlay 525 provides a medium on which to print graphics, logos, key icons, and other markings as appropriate. Although not visible in the drawings, the adhesive overlay can include a plurality of transparent micro-beads which are printed on the clear, non-adhesive portion 526, on the side facing the screen 530. The micro-beads prevent the overlay from sticking to the touch-screen due to the natural build-up of humidity inside the sealed portion. The overlay 525 seals around perimeter 527 to provide the adhesive surface between perimeter 527 and the outer perimeter 528 of the overlay. This bonding technique creates a watertight seal between the overlay and associated components (screen 350, bezel 535, and cover assembly 540, described in greater detail below) to render the device 510 waterproof so it can be submersed and fully operational in water at deep depths.

The touch-screen 530 displays information to a user and is the user interface via touch-screen controls for performing the various functions as described herein for aquatic training. A bezel 535 is provided for receiving the screen 530 therein. As shown in FIG. 5C, the bezel includes adjustable tabs 536 to hold the screen assembly 530 in position, while allowing for changes in screen display dimensions. The bezel 535 further includes levers 534 that depress the on/off and reset switches on the circuit board 537. Additionally, a portion of the adhesive overlay 525 adheres to the exposed surface area of the bezel 535.

The circuit card assembly 537 performs the system processing, power management, connectivity and data storage for the aquatic training system. Additionally, the circuit card assembly 537 includes a wifi/Bluetooth antenna 541 for communicating data wirelessly in accordance with the illustrative embodiment described herein.

The device 510 includes a waterproof connector 538 (which can comprise a USB (Universal Serial Bus) connector) and associated cap 539. The waterproof connector 538 provides waterproof connectivity to the LapStation.

A bottom case assembly 540 provides the structure for the device 510 and further secures the waterproof connector 538 in place, as well as enclosing the electronics assembly of the device 510. The case assembly 540 defines a surface 542 for the adhesive overlay 525 to seal the device. Additionally, the case assembly 540 is structured to receive the rechargeable batteries (batteries not shown in FIG. 5C) within area 543 and to accept the rubber feet 544 and stand assembly 545. Furthermore, the case assembly 540 is specifically designed to minimize the interior air volume, once assembled to form the device 510, such that the LapStation sinks when submersed in water, to improve the visibility to a swimmer. The stand assembly 545 can be for propping the display at an angle (such as 45-degrees) for viewing, or, when fully extended, can hook on lane lines within a pool by hooks 546. The stand assembly 545 is provided with custom detents to hold the stand in preset positions as desired (such as closed, at 45-degrees, and fully extended).

Figure 5D:
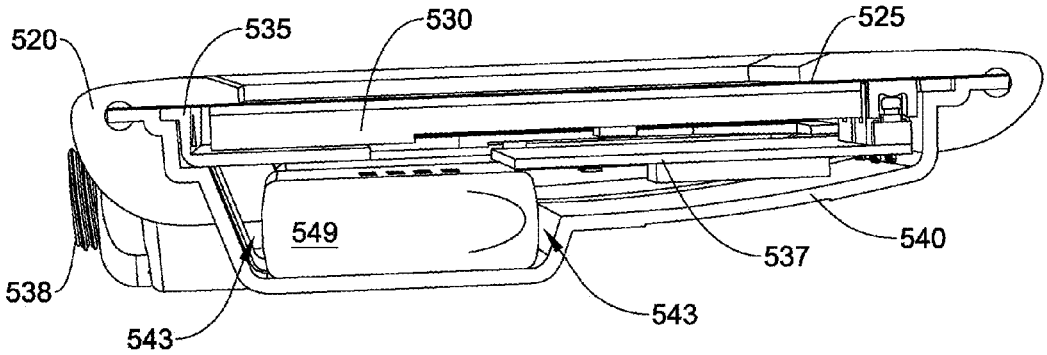
FIG. 5D is a cross-sectional view of an assembled touch-screen base station according to illustrative embodiments.
Figure 5E:
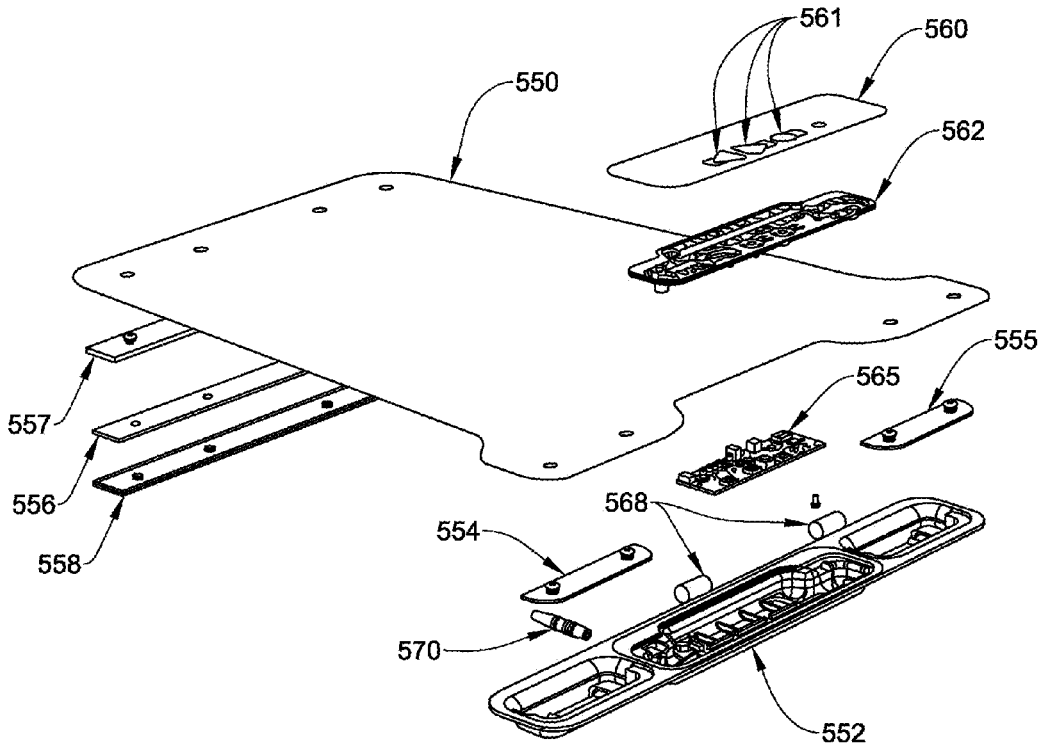
FIG. 5E is an exploded view of the touch pad employing an accelerometer configuration, according to illustrative embodiments.

A cross-sectional view of the LapStation-TS base station device 510 is shown in FIG. 5D. As shown, the rubber skin 520 surrounds the perimeter of the device 510 and engages with the bottom case assembly 540. The adhesive overlay 525 is constructed and arranged so as to cover the screen 530 about perimeter 527 of the overlay, the bezel 535, and surface 542 of the bottom case assembly 540 to provide a watertight, waterproof structure capable of being fully submersed in water. The rechargeable battery 549 is shown in FIG. 5D, and resides within the area 543 of the bottom case assembly 540. It is noted that the assembled device 510 minimizes the interior air space such that the device can sink quickly when submersed in water. In this manner, the device can be properly situated for viewing by a user.

Reference is now made to FIG. 5E, detailing a further embodiment of the touch pad 420 as described herein. As shown, a sheet 550 is provided, secured to a back plate 552 if a waterproof touchpad control electronics, using sheet mounting elements 554, 555. Additionally, stiffener 556 and associated sheet mounting elements 557, 558 are provided to secure the sheet 550. Furthermore, the stiffener 556 and mounting elements 557, 558 serve as weights to position the bottom of the sheet appropriately, such that the sheet lays flat against a pool wall when submersed in water (as described in greater detail with reference to FIGS. 6 and 7 hereinbelow). Additional accelerometers can be placed elsewhere on the touchpad sheet in waterproof enclosures and operatively connected to the touchpad to provide additional sensors for detecting a wall contact.

A flexible cover 560 is provided that overlays the cover plate 562. The cover 560 and cover plate 562 provide protection for the circuit board assembly 565, which resides within the back plate 552. The flexible cover 560 includes indentations or other appropriate markings 561 for identifying the buttons of the circuit board assembly 565. The accelerometer or accelerometer assembly is formed integral with the circuit board assembly 565 according to an illustrative embodiment. The capacitors 568 for RFID pulse generation reside within the back plate 552, as does a connector 570 for operatively connecting the circuit board assembly 565 to a base station. When assembled, the flexible cover 560, cover plate 562 and back plate 552 form a waterproof electronic control for the touch pad, which is an add-on touchpad control electronics for the touch pad to provide the accelerometer or accelerometer assembly thereon.

Figure 6:
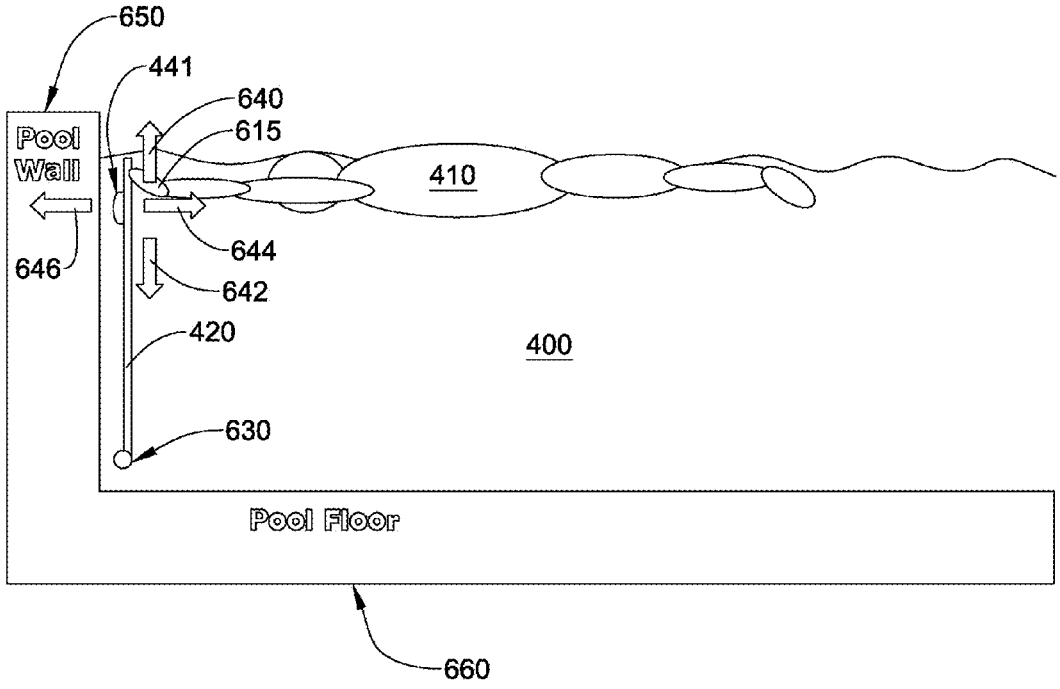
FIG. 6 is a side view of a swimmer approaching a pool wall employing the accelerometer configuration touch pad to detect movement of the touch pad, and thus indicate contact with the pool wall by a swimmer, according illustrative embodiments.

Referring now to FIG. 6, a side view of a swimmer approaching a pool wall is shown. The swimming pool 400 has a swimmer 410 swimming therein, employing an accelerometer-based touch pad as illustrated and described herein. Note that the swimmer makes contact with the pool wall via a hand 615 in this image, by contacting the LapTouch touch pad 420. The LapTouch touch pad 420 includes the accelerometer assembly 441, as described in FIG. 4A, which detects movement of the LapTouch touch pad 420 in each of at least three axes of movement. Note in further embodiments a one-, two-, or multi-axis accelerometer, aligned to best detect the typical movement of the pad during a wall-touch by a swimmer can be employed.

As shown, the force of the swimmer's hand 615 pushes the top of the LapTouch touch pad 420 toward the wall 650. This results in the accelerometer assembly 441 detecting a movement back and forth toward the wall. In addition, the swimmer contact with the touch pad also causes a detection and measurement of an up and down motion. These detected/measured movements can be used to determine contact with the wall, and are used in determining lap times for graphical representation, such as that shown in FIG. 15, as will be described in greater detail hereinafter. The tri-axis accelerometer assembly 441 in this embodiment particularly detects movement along an X-axis (left-to-right movement, as shown by arrow 644), a Y-axis (up-and-down movement, as shown by arrows 640, 642) and Z-axis (movement in and out from the wall 650, shown by arrow 646).

The LapTouch touch pad 420 can also include a weight 630 (stiffeners/weights 557, 558 of FIG. 5E) at the bottom that causes the touch pad to be biased downwardly toward the pool floor (660) under gravity so that the LapTouch touch pad 420 maintains a substantially upright direction along the side of the pool wall 650. This improves accuracy of readings by keeping the LapTouch touch pad 420 in the appropriate position within the swimming pool 400.

Additionally, the LapTouch touch pad 420 can include a flexible arched assembly or "rib" (not shown) running parallel to the floor of the pool and integrated onto the underside of the touch pad to help spring the touch pad back into its original position following a wall contact. This improves accuracy of readings by keeping the LapTouch touch pad 420 in the appropriate position separated from the pool wall 650.

Figure 7:
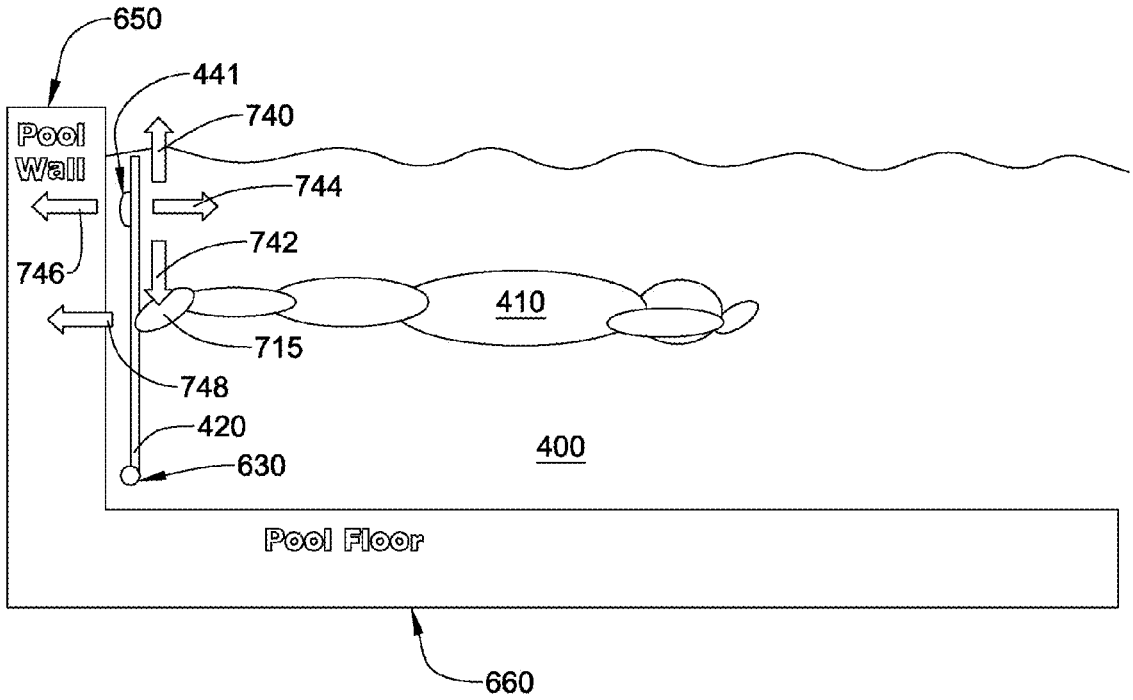
FIG. 7 is a side view of a swimmer pushing away from a pool wall with his or her foot, employing the accelerometer configuration touch pad to detect contact with the pool wall, according to illustrative embodiments.

FIG. 7 details a side view of a swimmer 410 pushing away from a swimming pool 400 wall with his or her foot. A LapTouch touch pad 420 is mounted to the wall in the swimmer's associated lane, as determined by appropriate dividing lane lines. Note that the swimmer in FIG. 7 is shown making contact with the pool wall 650 via a foot 715, for example after performing a "flip turn", which is a common method of turning around once the end of a pool is reached, instead of touching the wall with the hand and then turning to commence swimming in the opposite direction. Similar to the view of FIG. 6, the LapTouch 420 includes an accelerometer assembly 441 that detects proximal contact of the swimmer's foot 715 with the LapTouch 420. The force of the swimmer's foot 715 biases the center of the LapTouch 420 toward the pool wall 650. In addition, the swimmer's contact with the LapTouch 420 also causes a measurable movement up and down. These combined movements can be used to determine positive contact with the wall, and used in determining lap times of each swimmer.

The tri-axis accelerometer assembly 441 detects movement along an X-axis (left-to-right movement, as shown by arrow 744), a Y-axis (up-and-down movement, as shown by arrows 740, 742) and Z-axis (movement in and out from the wall 650, shown by arrows 746, 748). A circuit of conventional design is adapted to detect movement along each axis and log a positive contact when the movement exceeds a predetermined magnitude. The magnitude value(s) can be determined empirically or through trial and error experimentation. Note this LapTouch 420 can also include a weight 630 located at the bottom that causes the touch pad to extend downwardly toward the pool floor 660 so that the LapTouch 420 maintains an upright direction along the side of the pool wall 650.

III. Wireless Tapper Implementation

Figure 8:
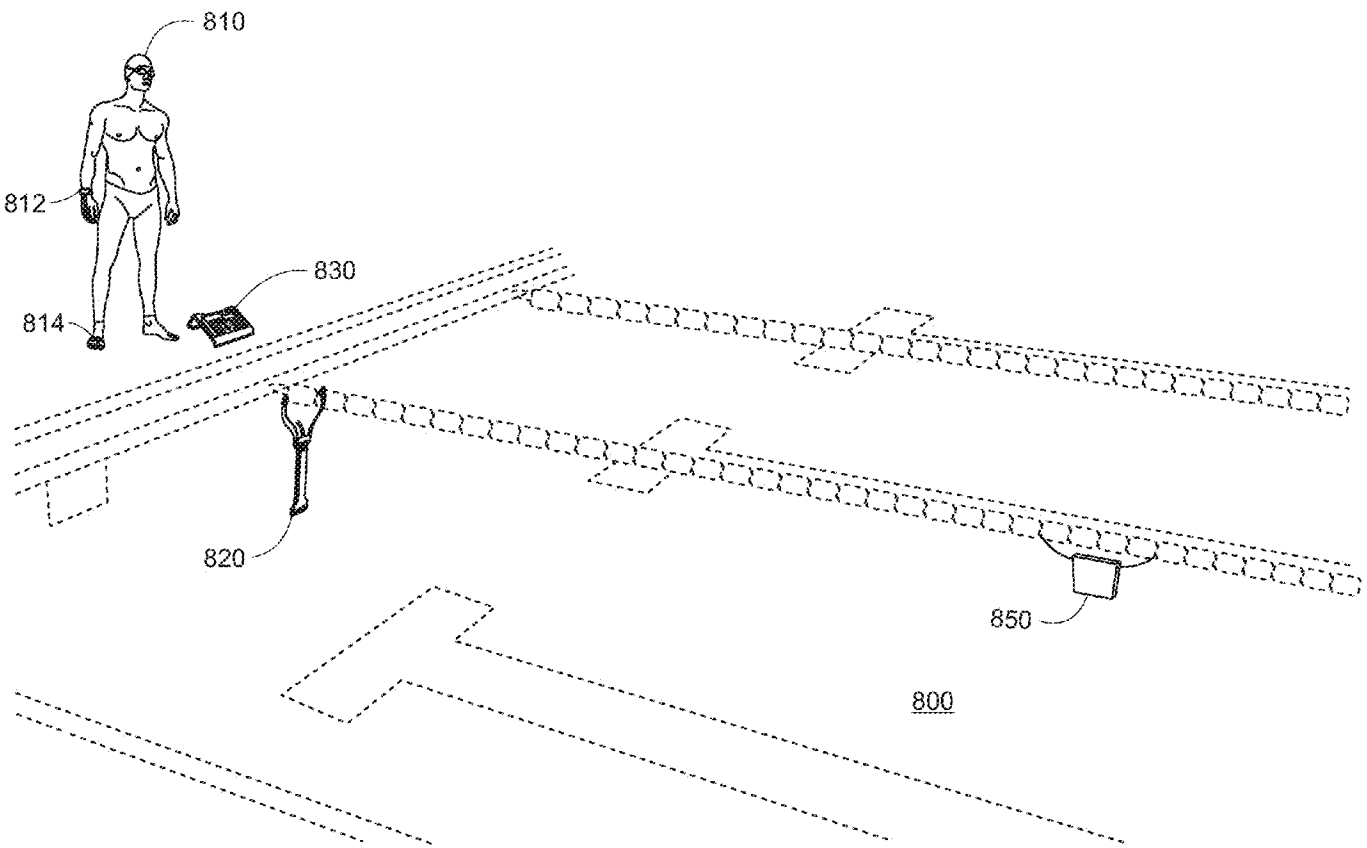
FIG. 8 is a perspective view of a swimming pool employing a swim training system including a LapEye device operatively connected to the base station, according to an illustrative embodiment.

As described generally above, in an alternate embodiment, the swim training system can employ a LapEye communication device operatively connected to the base station for obtaining lap times and other pertinent swim data through wireless communication and free of a mechanical touch device. As shown in FIG. 8, a swimming pool 800 has a swimmer 810 about to commence swimming therein. Note the swimmer 810 has a FingerTapper 812 and a ToeTapper 814, as briefly described previously, that performs the swim training data acquisition wirelessly. The tappers 812 and 814 each include a LED (light-emitting-diode) array, or other appropriate optical (light) transmission device, for communicating with a LapEye communication device 820. The LapEye receiving device 820 is operatively connected to the base station 830. The base station can also be operatively connected to an underwater display 850 or the base station itself can be an underwater display. This can be used to display pertinent data to the swimmer 810 while the swimmer is swimming.

Figure 9:
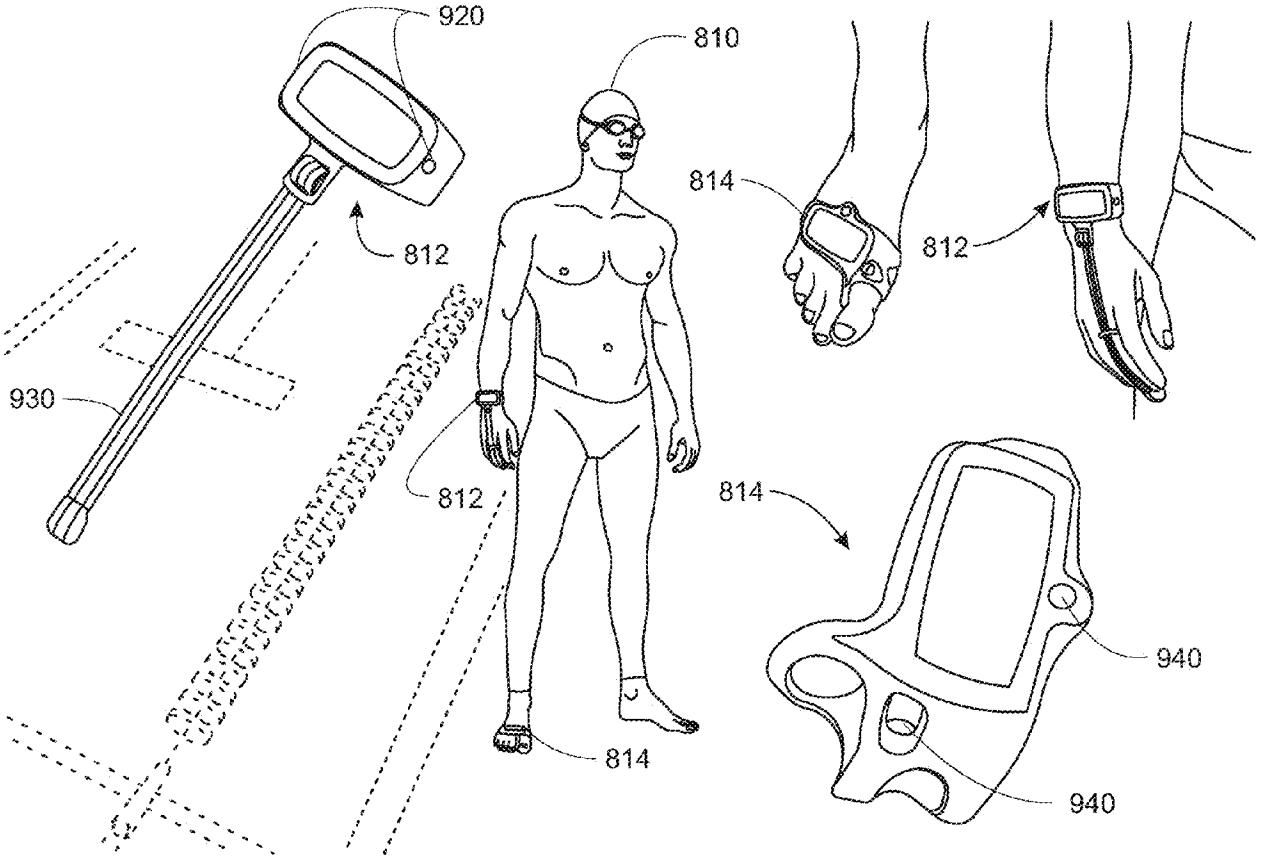
FIG. 9 is a front perspective view of a swimmer employing the LapTapper configuration according to the illustrative embodiment in FIG. 8, including a FingerTapper and a ToeTapper.

The FingerTapper 812 hand device and Toe Tapper 814 foot device of FIG. 8 are shown in greater detail as the FingerTapper 812 and ToeTapper 814 of FIG. 9. FIG. 9 details a front perspective view of a swimmer 810 having the FingerTapper 812 and a ToeTapper 814 disposed on his or her hand and foot, respectively. The FingerTapper 812 includes LEDs 920 for transmitting a signal to the LapEye device, such as the device 820 shown in FIG. 8. The FingerTapper 812 also includes a fingertip sensor 930 that includes a contact switch or similar device to detect a wall contact.

Figure 9A:
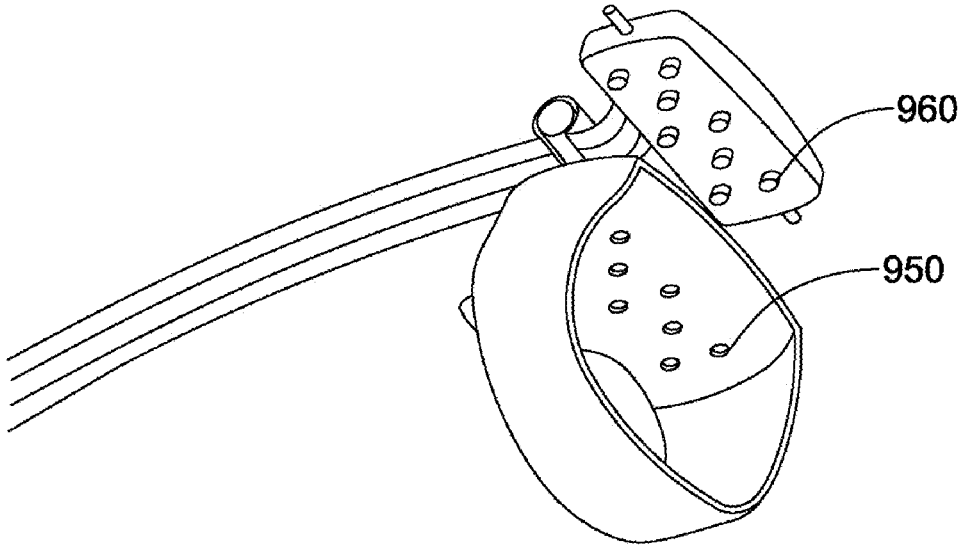
FIG. 9A is a perspective view of the FingerTapper device, where the sensors and watertight seals are in a disengaged configuration, according to the illustrative embodiment in FIG. 8.
Figure 9B:
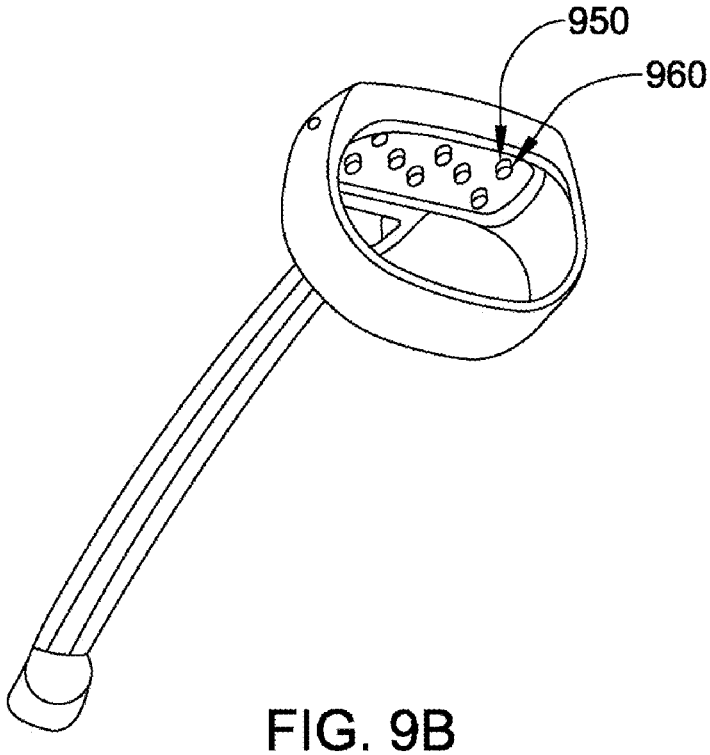
FIG. 9B is a perspective view of the FingerTapper device, where the sensors and watertight seals are in an engaged configuration, according to the illustrative embodiment in FIG. 8.

The FingerTapper hand device can be provided with an array of heart rate sensors. Underwater, a heart rate sensor is capable of having one contact pad on the skin of the person and isolated from the water, and another contact that passes though the water (due to its inherent conductivity) to a remote location on the skin in contact with the water, as described in U.S. Pat. No. 6,580,943, entitled ECG ELECTRODE STRUCTURE AND METHOD FOR MEASURING ECG SIGNAL FROM A PERSON IN WATER. Disadvantageously, the '943 patent only contemplates providing a single sensor on the skin. As shown in FIGS. 9A and 9B, there are a plurality of sensors 960, individually sealed by watertight seals 950, having an interconnected circuit that distinguishes sensor contact pads that have lost their seal (for example, via detection of a short circuit). In this manner, the surrounding water provides a remote ground on the body, and ensures an accurate reading of the heart rate of the swimmer at all times, even if one or more contact pads become unsealed.

The ToeTapper 814 also includes LEDs 940 for optical transmission of data and relevant information to the LapEye device for transmission to the base station of the swim training system. The FingerTapper 812 and ToeTapper 814 are constructed and arranged to easily be placed on a swimmer's hand and foot, respectively, without distracting from their swim or altering their natural swim stroke. Ergonomic, water resistant straps are provided to both.

Figure 10:
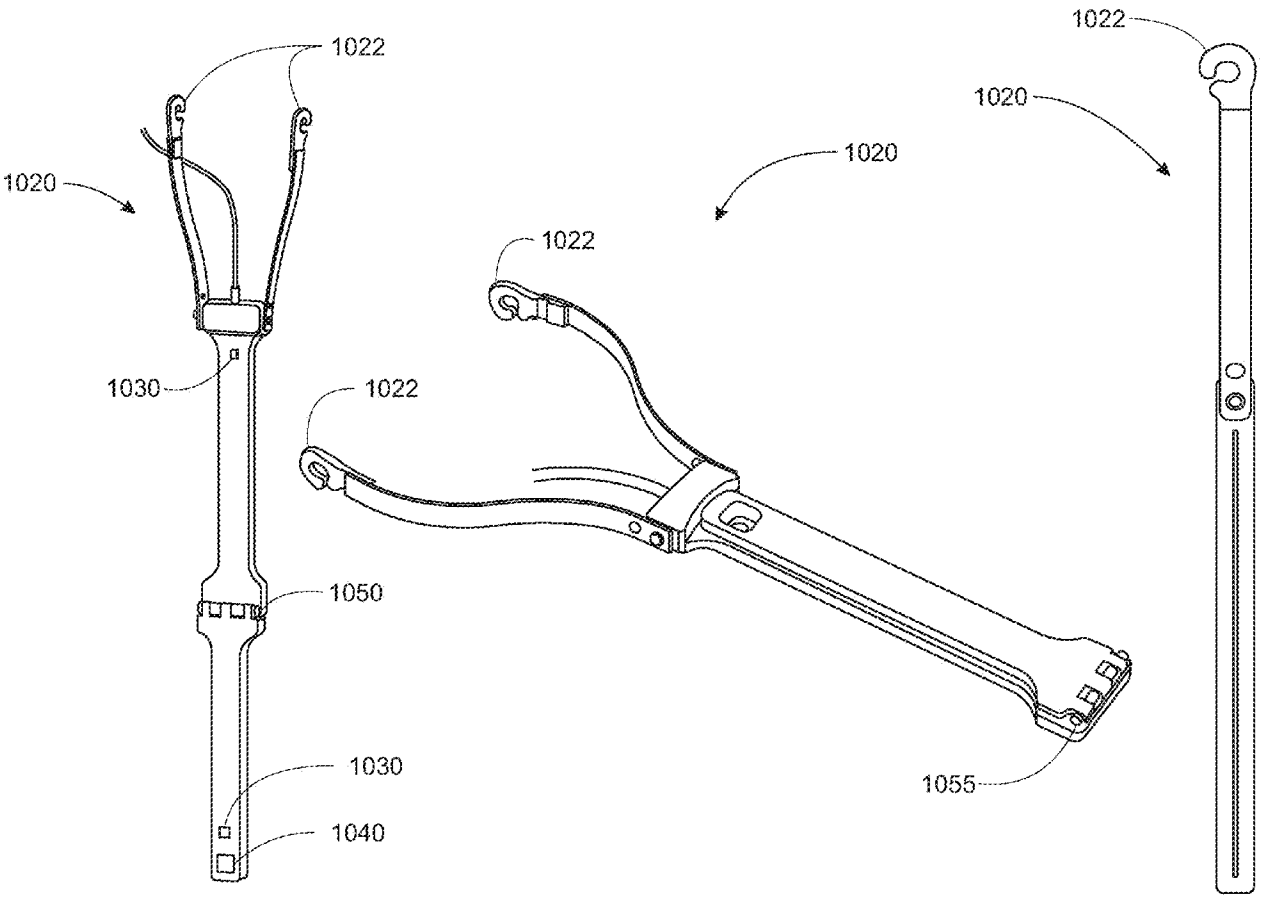
FIG. 10 shows front, top and side perspective views of the LapEye device of the swim training method, according to the illustrative embodiment in FIG. 8.

Also shown in FIG. 8 is the LapEye device 820, shown in greater detail as device 1020 of FIG. 10. The device 1020 includes hooks 1022 that allow the LapEye to be suspended from lane lines (the dividers present in the pool to specify lanes within the pool). In this manner, the LapEye device 1020 is suspended in the pool. The device 1020 includes a bendable joint 1050 midway down, such that it may be stored in a closed position, and then extended down to reveal optical sensors 1030 for detecting a signal from the FingerTapper and ToeTapper of the swim training system. The LapEye 1020 also includes a hole or port 1040 for permitting optical sensing by the top optical sensor when the assembly is folded in the closed position. This is useful for enabling batch data transmission of heart rate data for an entire practice from the FingerTapper hand device when the system is stored and recharging. In particular, as described with respect to FIG. 29 below, the LapEye is adapted to be stored in a folded/closed orientation in the illustrative embodiment. When stored in the associated case, the hole 1040, and underlying sensor 1030 is in proximity with, and optical communication with, the transmitter of the tapper device (FingerTapper). The tapper is directed, either automatically, or based upon a signal provided by the user, to optically offload the stored heart rate data collected during the swim training set. The offloaded data is collected by the interconnected base station in association with the user. The offloaded data can include the user's identification and other appropriate data. In alternate embodiment, RF transmission, or another communication medium, can be employed to offload stored tapper data.

It should be clear to those of ordinary skill that the technique for coding of the transmitted data can vary widely. In general, the code defines a binary pattern that corresponds to various alphanumeric information, among other types. The code can include address information related to type of data, user identity, data stream/packet size, data stream beginning and data stream ending. Codes can be repeated a multiplicity of times within a given transmission cycle to ensure accuracy in the transmission of the complete data stream to the LapStation.

Note further that the display of recorded and/or realtime video of a respective swimmer (for example acquired by the LapCam 340, 1340 or provided by other sources) is depicted as exemplary image 1430 of the graphical user interface display screen 1400 of FIG. 14, described hereinafter.

Figure 11:
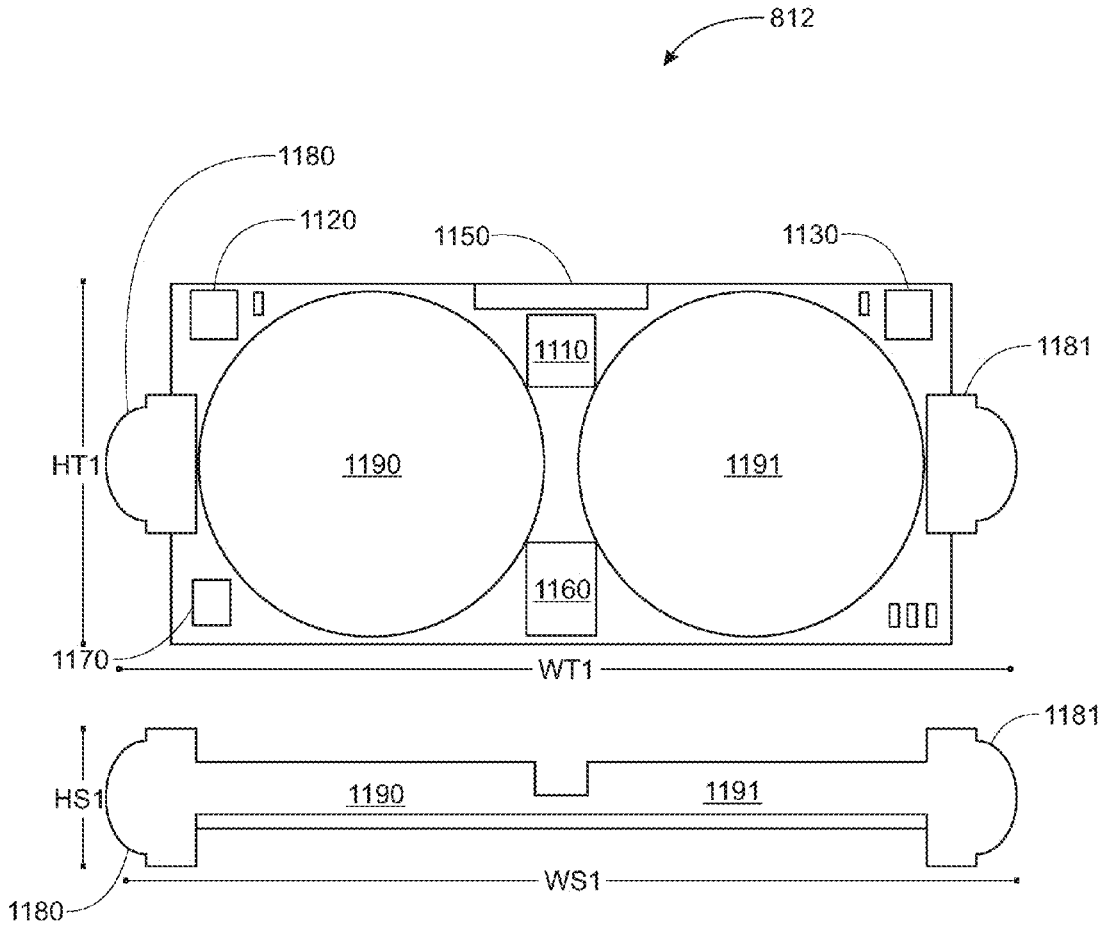
FIG. 11 shows a top and side view of the components comprising the FingerTapper device, according to the illustrative embodiment in FIG. 8.
Figure 12:
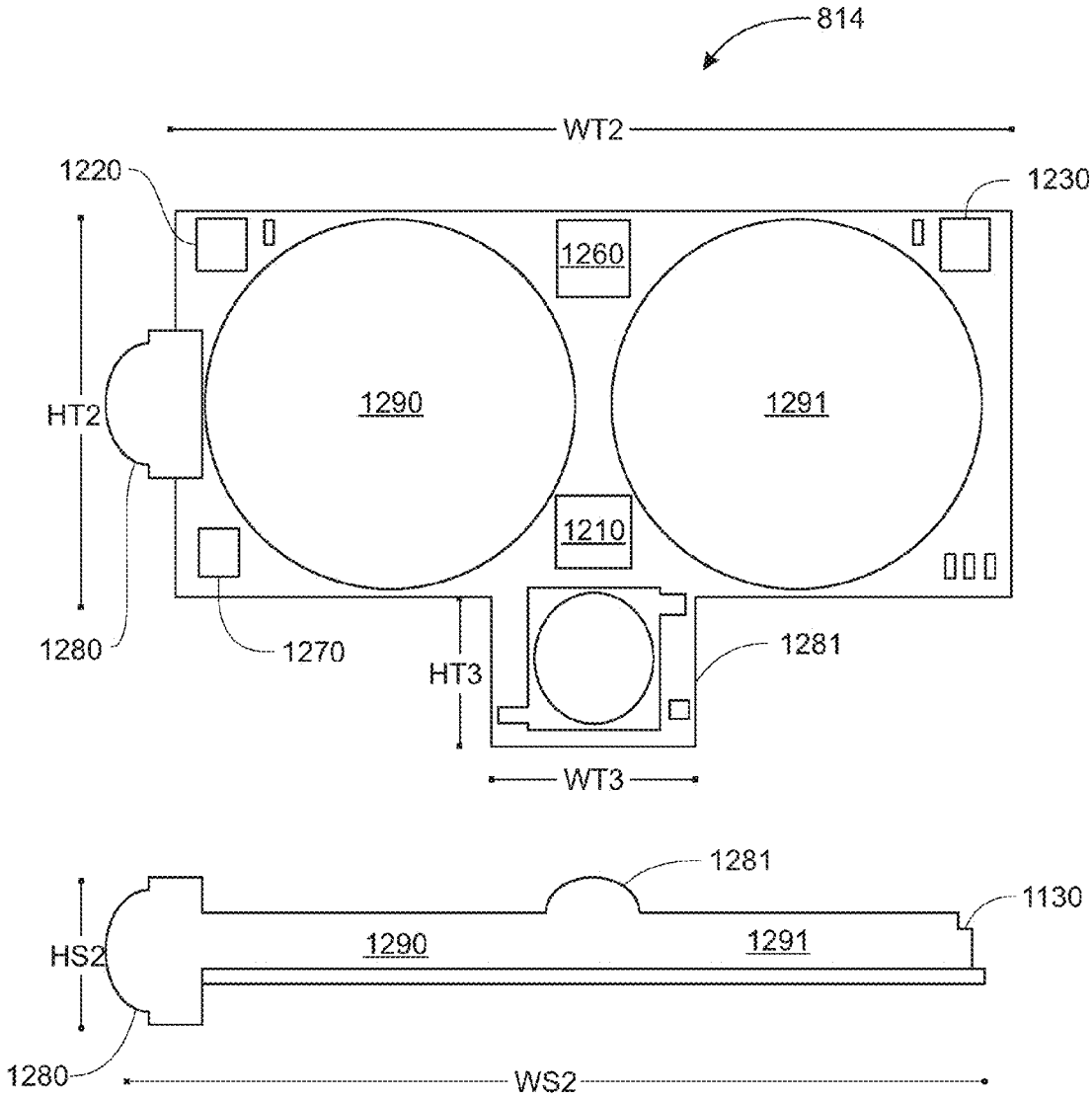
FIG. 12 shows a top and side view of the components comprising the ToeTapper device, according to the illustrative embodiment in FIG. 8.

Reference is now made to FIGS. 11 and 12, detailing top and side views of the FingerTapper and ToeTapper, respectively. As shown in FIG. 11, the FingerTapper 812 includes a microcontroller 1110, a regulator 1120, a power enable 1130, and a memory 1160, the connectivity of which will be described in greater detail with reference to FIG. 21 below, to process the data gathered from the contact switch and heart rate monitors, and transmit the data via appropriate LEDs. The FingerTapper 812 also includes an LED driver 1170 operatively connected to LEDs 1180 and 1181. These LEDs transmit the data optically to a LapEye device located within the pool.

Arrow 1150 shows the connectivity location where a fingertip sensor can be inserted into the FingerTapper 1100. The FingerTapper 812 is also equipped with rechargeable (or disposable) batteries 1190 and 1191, typically in the shape of a round battery, such as 23 mm round. As shown, the top view of the FingerTapper 1100, in an exemplary embodiment, has a height HT1 of approximately 23.9 mm (0.94 in), and an approximate top view width WT1 of 52.2 mm (2.06 in). As shown from the side view, the FingerTapper 812 has a height HS1 of approximately 10 mm, in an exemplary embodiment, and a width, from LED to LED, WS1, of approximately 59.2 mm (2.06 in). These and other measurements are only exemplary of a wide range of sizes and/or shapes for components of this and other devices described herein.

The ToeTapper 814 is shown in greater detail in FIG. 12. The ToeTapper 814 includes a microcontroller 1210, a regulator 1220, a power enable 1230, and a memory 1260, the connectivity of which will be described in greater detail with reference to FIG. 22 below, to process the data gathered from the contact switch and other sensors located on the ToeTapper 814. The ToeTapper 814 also includes an LED driver 1270 operatively connected to LEDs 1280 and 1281. These LEDs are used to transmit the data optically to the receiving device located within the pool. In this manner, wireless communication between the swimmers and the base station is achieved. One advantage of optical transmission is that its range is sufficient to allow reception over a reasonable distance between the transmitter and receiver. The distance is not so great as to reach the opposing side of the pool. The transmission of data at the speed of light avoids the multi-path issues associated with acoustical means of underwater data transmission. In addition, the rapid edges between on and off enabled by LEDs allows for discrete coding of information in the LED transmission and transmission of a message several times to ensure successful receipt.

The ToeTapper 814 1200 foot device, as shown by the top view, has a height HT2, in an exemplary embodiment, of approximately 23.9 mm (0.94 in), and an approximate top view width WT2 of approximately 52.2 mm (2.06 in). The second LED on the ToeTapper 814 protrudes out at another height, HT3, of approximately 9 mm, and having an approximate width, WT3, of 15 mm. From the side view of the ToeTapper 814 of FIG. 12, the approximate height, in an exemplary embodiment, of HS2, is 10 mm, and the approximate width, in an exemplary embodiment, of WS2, is 55.7 mm (2.06 in).

Figure 13:
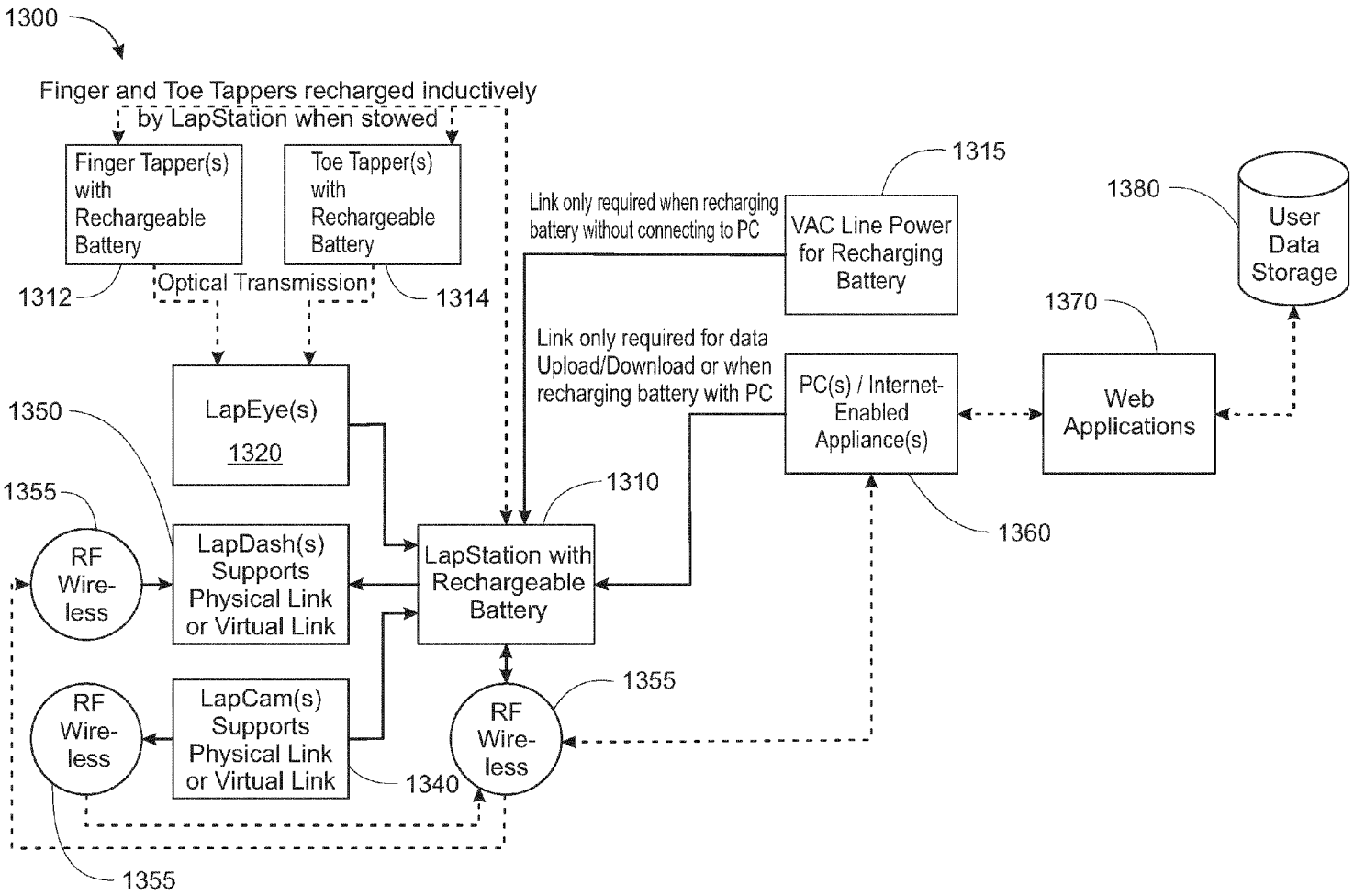
FIG. 13 is a block diagram showing an overview of the LapTapper system configuration, according to the illustrative embodiment in FIG. 8.

Reference is now made to FIG. 13, a block diagram showing an overview of the tapping ("LapTapper") configuration of the swim training system. The LapTapper system 1300 includes the base station LapStation 1310, that includes a rechargeable battery. The base station 1310 can be connected to an AC power source 1315 (or another supply such as a computer) for recharging the battery. As described, the system 1300 includes the FingerTapper 1312 and ToeTapper 1314. These devices are each in communication with the LapEye device 1320, which sends information to the base station 1310 for analysis and further data storage or display as mandated by the system. The system 1300 can also include a LapCam camera 1340 that obtains a video of a swimmer within a pool. This video is shown as video display 1430 on screen 1400 of FIG. 14. As discussed above, the communication between the base station 1310 and various components, including the underwater display 1350 ("LapDash"), and the LapCam 1340, can be accomplished using RF wireless devices 1355 disposed within the pool and having antennas protruding from the water. The RF device can be standalone devices or integrated directly into the other components of the system. These devices, as shown in greater detail with reference to FIG. 23 below, communicate with the base station and other components within the system, to transmit and receive relevant information. The base station can transmit this information to other devices, such as a Personal Computer (PC) or other Internet-Enabled Appliance 1360, to be displayed as shown in FIGS. 14 and 15. As will be described in greater detail, the gathered information pertinent to each swimmer can be transmitted to these other devices, including web applications 1370, as shown in FIG. 13, to be stored in a user data storage 1380. These applications and processes can be carried out and implemented using hardware, software, or a combination of both. Storage and/or applications to manipulate swim data can be contained locally on, for example, a PC, or provided via a network such as the Internet at an appropriate web-based server that interacts with the user via a browser.

Reference is now made to FIGS. 14 and 15, showing graphical user interface displays for off-site, remote viewing of swim training data and other relevant information, such as that transmitted to the PCs as 360 of FIG. 3 and 1360 of FIG. 13. As shown in FIG. 14, the display screen 1400 includes a "Dashboard" tab 1405, a "Compare" tab 1406 and a "Data" tab 1407, for navigating through the various pages available for viewing. The screen 1400 under the "Dashboard" tab 1405 includes a "Swim Plan" screen 1410 that shows pertinent data and relevant information about a particular swim plan. There is provided a detailed screen 1420, showing the actual swim values, compared to the planned swim values, in the chart 1425. As described hereinabove, the swim training system can also include a camera for capturing a video of the swimmer. This video content can be viewed at the video display 1430. The display screen 1400 also includes other pertinent data 1440 relevant to the selected swimmer. This can include the lap times, heart rate and other information desired by a swimmer to assist in improving performance.

A person viewing the screen 1400 can select the "Compare" tab 1406 and is directed to a screen, such as that shown in FIG. 15. The screen 1500 includes the tabs 1505, 1506 and 1507 for navigating through the various pages available. The Compare screen is designed to show the particular swimmer his lap times as compared to other values in a data series, as selected. This is demonstrated as the chart 1520 showing the lap times for one person as 1521 (for "Friend, John), and another friend 1522 (for "Buddy, Jane"), and the swimmer being analyzed is shown as line 1523. Notice options 1530 have a box 1531 for selecting the other swimmers to be compared to, and the data box 1532 for selecting the amount of data to be used in creating the graph 1520. The display 1500 also includes information relevant to the swimmer's performance, as elements 1540, including the swimmer name, date, swim plan name, lap time, heart rate, and other pertinent information. The comparison process and associated displays can be implemented using conventional statistical techniques and programming procedures.

IV. Hardware Implementations

Figure 16:
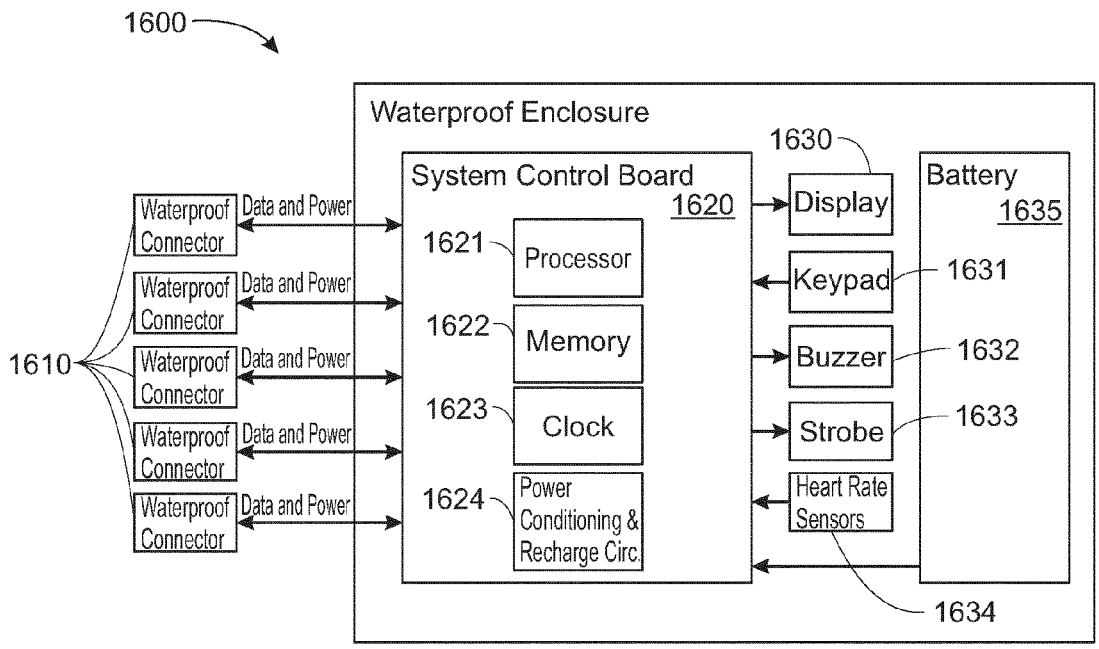
FIG. 16 is a block diagram summarizing the components of the LapStation base station of the swim training system, according to the illustrative embodiments.

Reference is now made to the block diagrams of FIGS. 16-23, detailing the components of the various elements within the swim training system of the illustrative embodiment. FIG. 16 details the components of the LapStation base station 1600 of the swim training system. As shown the base station 1600 includes a waterproof enclosure and includes a system control board 1620. The control board 1620 includes a processor 1621, which can comprise any appropriate hardware- or software-implemented device that inputs data for creating swim plans, notifies a swimmer when to commence swimming, and communicates with the other components of the system through waterproof connectors 1610. The control board 1620 also includes a memory 1622 for storing the pertinent information obtained from the various components of the system through the waterproof connectors 1610. The control board 1620 includes a clock 1623 for counting the elapsed time between contacts, for determining lap times, and used in identifying a particular piece of data stored within the system. The control board 1620 further includes a power conditioning and recharge circuitry 1624 for recharging the battery 1635 that powers the base station 1600. When outfitted with a large display, the LapStation can act as an underwater display, so swimmers can see their swim data without the need for an optional under water display accessory. The display can also include touch-screen control and associated electronics.

The base station 1600 includes a display 1630 (532 of FIG. 5) for displaying information to a swimmer or coach using the base station. The base station also includes a keypad 1631 that allows a user to input data, such as in the creation of a swim plan. The display 1630 and keypad 1631 are provided mostly for creating a swim plan and inputting other data into the system. In one example, the keypad may be used to permit a coach to type messages for swimmers to read underwater, via an optional underwater display. The buzzer 1632 and strobe light 1633 provided on the base station are used to audibly and visually alert a swimmer when he or she should commence swimming, according to their pre-selected swim plan. The base station 1600 can also include stationary heart rate sensors 1634 that can be used by a swimmer to obtain their heart rate in between laps by contacting the fixed base sensors, as another technique for providing and obtaining swimmer information.

Figure 17:
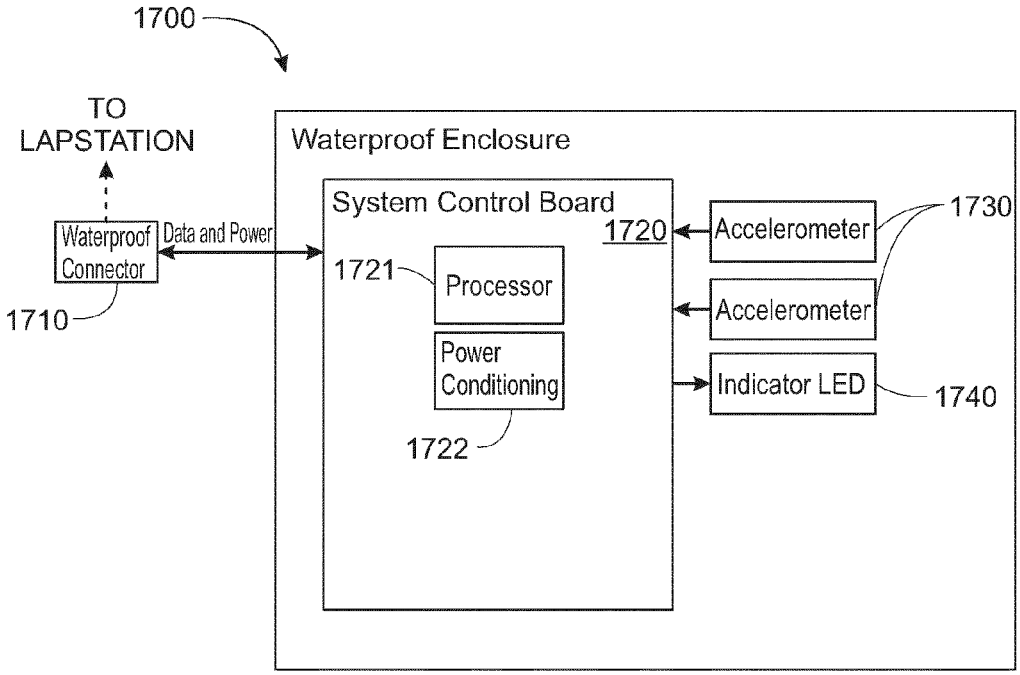
FIG. 17 is a block diagram summarizing the components of the LapTouch touch pad of the swim training system, according to the illustrative embodiments.

FIG. 17 details the components of the LapTouch touch pad 1700, encased in a waterproof enclosure. The touch pad 1700 includes a subsystem control board 1720 that controls the operation of the touch pad. It includes a processor 1721 that receives data from the accelerometers 1730 to detect when contact with the side of the pool has been made by a swimmer. The touch pad 1700 further includes a power conditioning circuit 1722 disposed within the control board 1720 for powering the touch pad 1700 with the appropriate circuit level voltage when connected to the lap station. The touch pad 1700 is connected to the lap station via a waterproof connector 1710 of conventional design. The touch pad 1700 can also include buttons to allow the swimmer to perform basic functions such as "start", "stop", "next" and previous" and an indicator LED 1740 and buzzer to notify a user that the touch pad is on and operating properly and to indicated the start of a swim.

Figure 18:
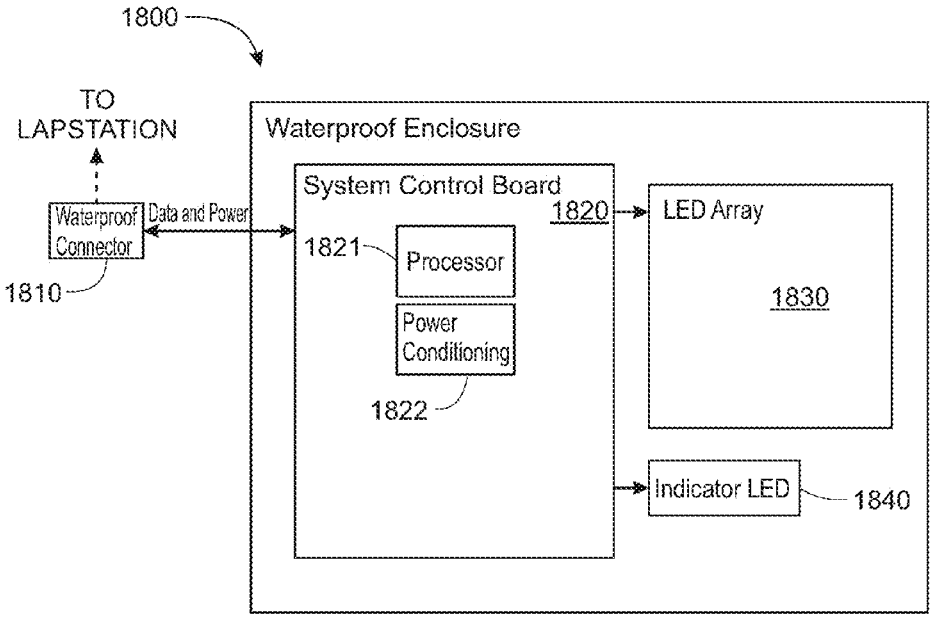
FIG. 18 is a block diagram summarizing the components of the LapDash display of the swim training system, according to the illustrative embodiments.

FIG. 18 is a block diagram detailing the components of the LapD ash underwater display that can be optionally provided in the swim training system to show instant feedback to swimmers. The underwater display 1800 is operatively connected to the base station of the swim training system via a waterproof connector 1810. The display 1800 includes a subsystem control board 1820 having a processor 1821 that obtains lap times as determined by the base station and processes this data to display on an LED, LCD or other reflective or emissive display array 1830 representative of the lap time. The display 1800 further includes a power conditioning circuitry 1822 on the control board 1820 for powering the display 1800 when connected to the base station. The display 1800 can also include an indicator LED 1840 to notify a user that the display is on and functioning correctly.

Figure 19:
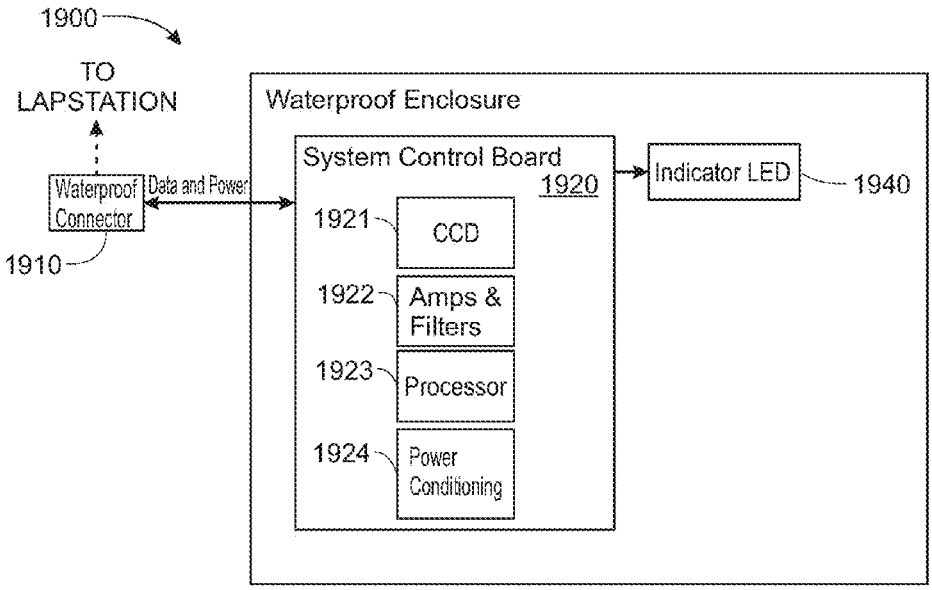
FIG. 19 is a block diagram summarizing the components of the LapCam camera of the swim training system, according to the illustrative embodiments.

Reference is now made to FIG. 19, a block diagram of the components of the underwater camera LapCam device 1900. As shown the camera 1900 is connected to the base station (LapStation) via a waterproof connector 1910. The communication between the camera and the base station, as well as between the various components of the system, can also occur via RF wireless transmission whereby the communication link is free of any direct connections, cables, wires, etc., as shown in FIG. 3. The device 1900 includes a subsystem control board 1920 having a camera 1921 that receives a signal from the processor 1923 to record a video, as determined by the base station. The control board 1920 further includes amplifiers and filters 1922 for the acquisition of the video file. The device 1900 includes power conditioning circuitry 1924 on the control board 1920 for powering the camera when the camera 1900 is connected to the base station. The camera device 1900 can further include an indicator LED 1940 to notify a user that the camera is on and functioning properly. The camera sensor can be implemented as a CCD, CMOS or another acceptable type of black and white, or color, motion video or frame acquisition device.

Figure 20:
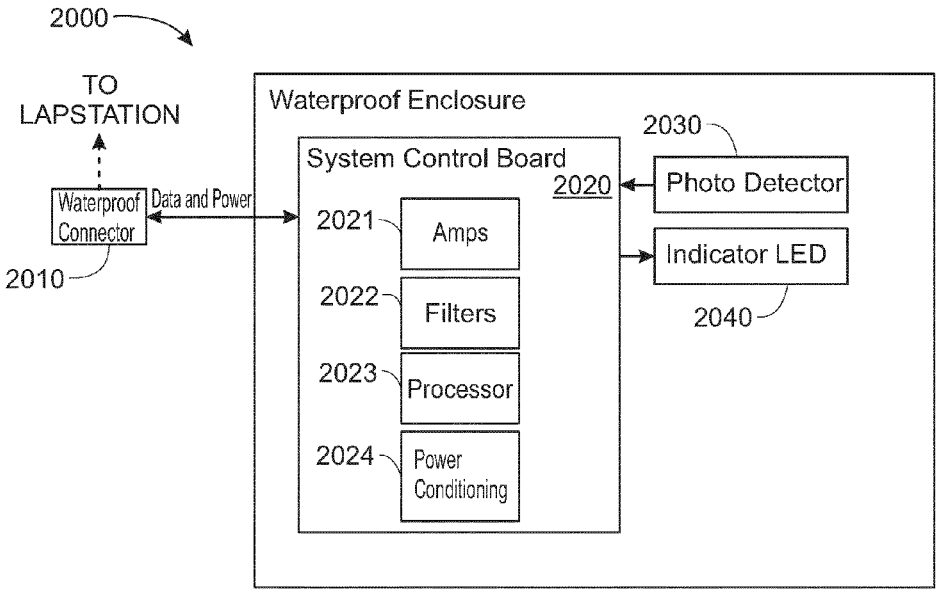
FIG. 20 is a block diagram summarizing the components of the LapEye device of the swim training system, according to the illustrative embodiments.

FIG. 20 is a block diagram detailing the LapEye device 2000 of the swim training system. The LapEye 2000 is operatively connected to the base station using a waterproof connector 2010. The LapEye 2000 includes a subsystem control board 2020 having amplifiers 2021 and filters 2022 for properly processing and obtaining signals from the FingerTappers and ToeTappers, as described herein wirelessly. The control board 2020 includes a processor 2023 that determines when a signal has been detected by the photo detector 2030, and if so transmits this data to the base station via the waterproof connection 2010. The device 2000 includes power conditioning circuitry 2024 on the control board 2020 for powering the device when it is connected to the base station. The device 2000 can further include an indicator LED 2040 to notify a user that the LapEye is on and functioning properly.

Figure 21:
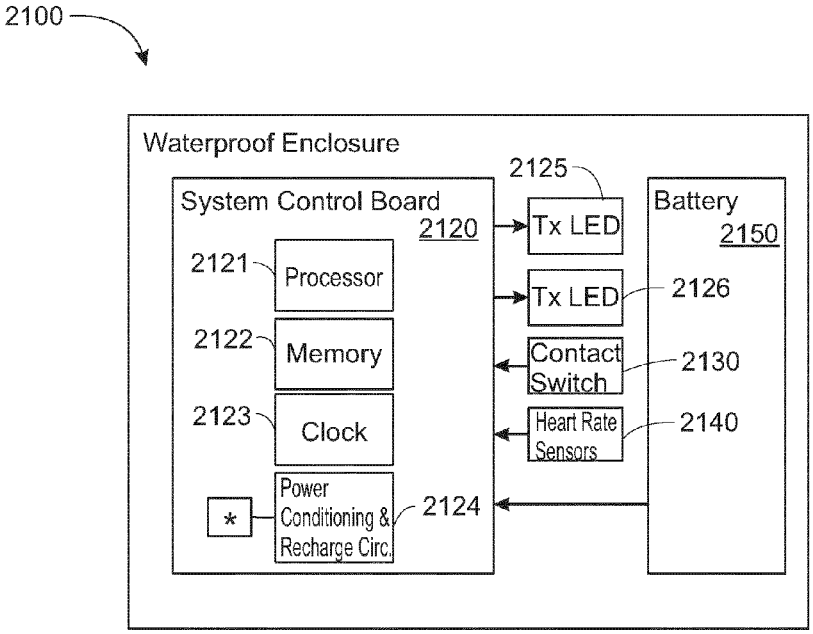
FIG. 21 is a block diagram summarizing the components of the FingerTapper device of the swim training system, according to the illustrative embodiments.

FIG. 21 is a block diagram detailing the FingerTapper 2100 of the swim training system. The FingerTapper 2100 is encased in a waterproof enclosure, and includes a system control board 2120 having a processor 2121 that transmits relevant data to the LEDs 2125 and 2126 to be received by the LapEye device. The FingerTapper 2100 further includes a contact switch 2130 and can optionally further include heart rate sensors 2140. The heart rate sensor can use one or more contacts that are isolated from the external water, and bear against the swimmer's skin to measure the differential current between the two locations on the swimmer. The data gathered from these elements is obtained by the processor 2121 and stored in memory 2122 on the control board 2120. The FingerTapper 2100 also includes a clock circuit 2123 on the control board 2120 to synchronize the clock in the LapStation with the clock in the FingerTapper. The FingerTapper 2100 can further include a power conditioning circuitry 2124 for inductively charging the battery 2150 when placed on a charging stand located at the base station.

Figure 22:
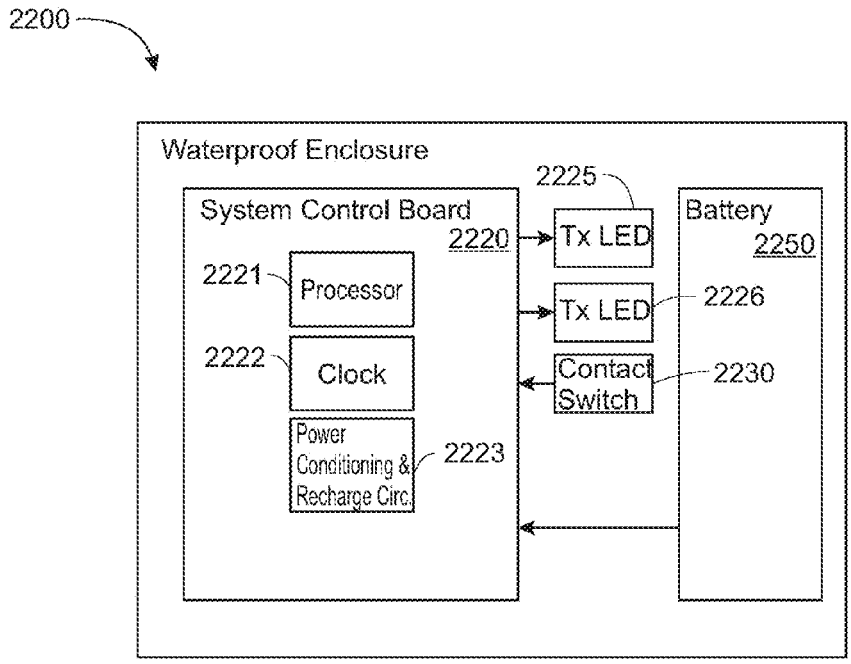
FIG. 22 is a block diagram summarizing the components of the ToeTapper device of the swim training system, according to the illustrative embodiments.

FIG. 22 is a block diagram detailing the ToeTapper 2200 of the swim training system. The ToeTapper 2200 is encased in a waterproof enclosure, and includes a system control board 2220 having a processor 2221 that transmits relevant data to the LEDS 2225 and 2226, such that it can be received by the photo detector of the LapEye device. The ToeTapper 2200 includes a contact switch 2230, which when detected by the processor 2221, is used to trigger a wall contact data transmission. The ToeTapper 2200 can also include a power conditioning circuitry 2224 for inductively charging the battery 2350 when placed on a charging stand located at the base station.

Figure 23:
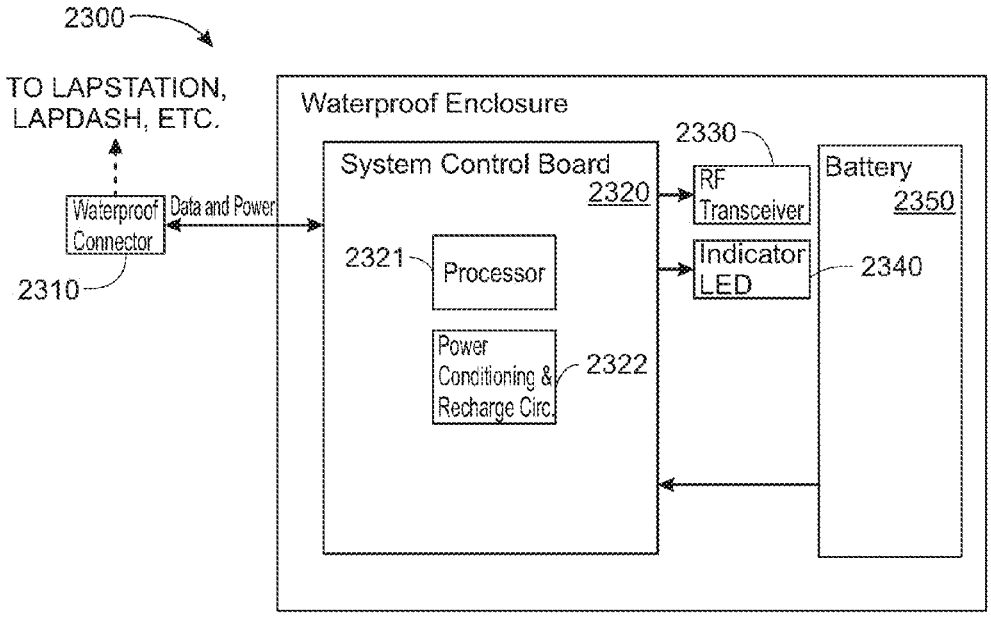
FIG. 23 is a block diagram summarizing the components of the LapWi RF wireless devices of the swim training system, according to the illustrative embodiments.

FIG. 23 is a block diagram detailing the LapWi wireless (RF or other) device 2300 of the swim training system. These devices may be placed throughout the pool to provide additional locations for receiving and transmitting information, through the RF transceiver 2330, for example. The wireless device 2300 is operatively connected to the various components, including the base station, underwater display, or other device, using a waterproof connector 2310. In addition, this wireless capability can be integrated directly into the other components of the system. The wireless device 2300 includes a subsystem control board 2320 having a processor 2321 thereon for transmitting and receiving relevant swimming data through the RF transceiver 2330. The wireless device 2300 includes a power conditioning circuitry 2322 for charging the battery 2350 when connected to a device through the waterproof connector 2310. The wireless device 2300 can also include an indicator LED 2340 to notify a user, such as the swimmer in the pool, that the wireless device is operating and functioning properly.

V. System Operation

Figure 24:
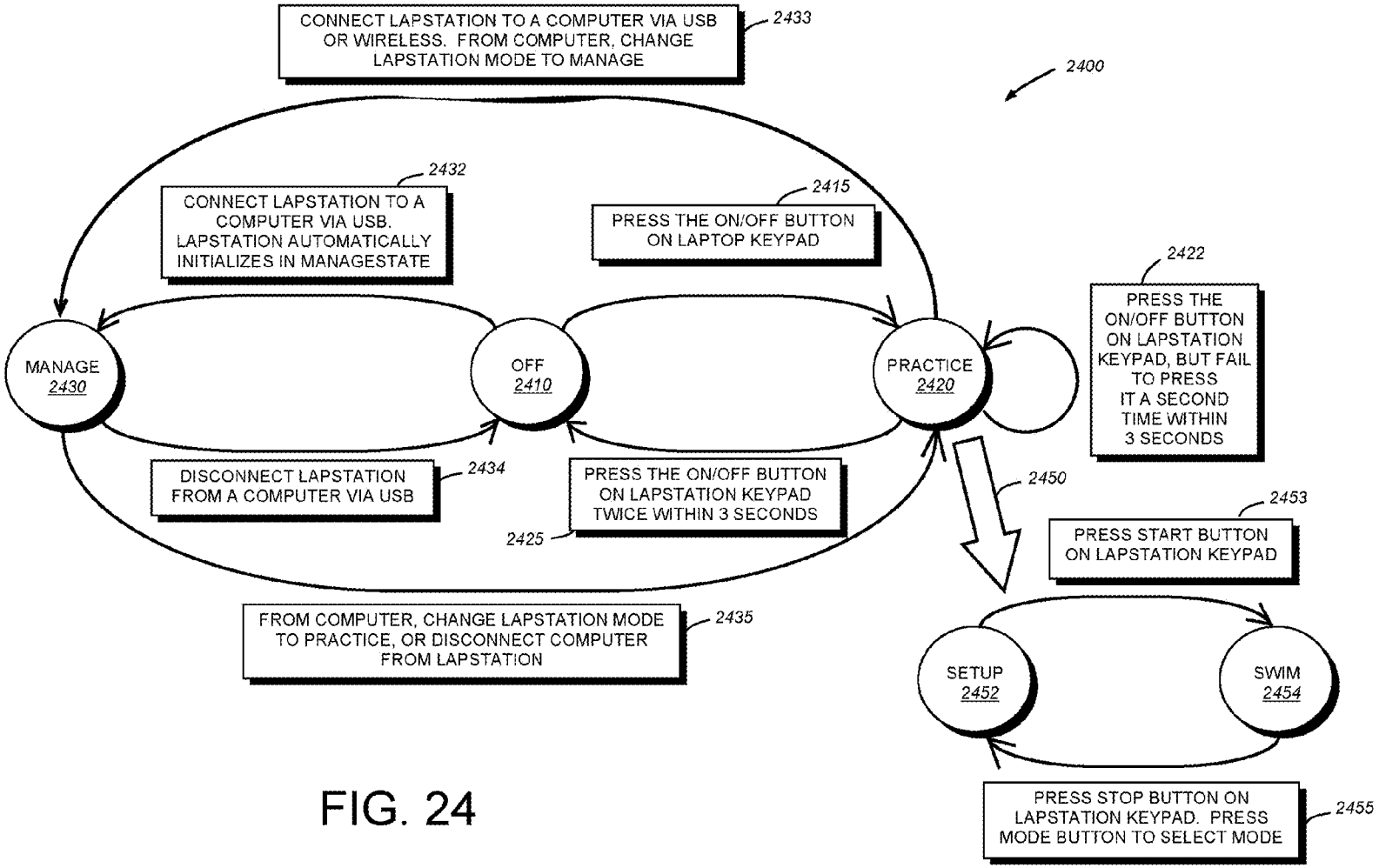
FIG. 24 is a flow diagram of the system states available as various modes of the base station of the swim training system, according to the illustrative embodiments.

Referring now to FIG. 24, a flow diagram of the various modes of operation of the base station of the swim training system is shown. The modes of operation are demonstrated by operation process 2400. In operation, the base station typically stays in an "OFF" mode 2410 until it is turned on, as described by datastream 2415, at which point it turns into "PRACTICE" mode 2420. The system is designed to prevent a user from inadvertently turning off the device. As shown by datastream 2422, if a user presses the on/off button only a single time within a specified time (i.e. 3 seconds), the base station maintains the "PRACTICE" mode 2420. However, as datastream 2425 indicates, pressing the on/off button twice within 3 seconds results in the base station returning to the "OFF" mode 2410. Connecting the base station to a computer, such as via USB connection, transitions the base station to a "MANAGE" mode 2430. As shown by data streams 2432 and 2433, connecting the base station to a computer via USB or wireless connection, changes the mode of the base station to "MANAGE" mode. Similarly, disconnecting the base station from a computer, as shown via datastreams 2434 and 2435, returns the base station to its previous state, being "OFF" for datastream 2434 and "PRACTICE" for datastream 2435.

The "PRACTICE" mode of operation 2420 includes submodes, shown by arrow 2450, and in practice a swimmer can be in a "SETUP" sub-mode 2452, where he or she has not yet selected the "start" button to begin their practice. Once a swimmer presses the "start" button, as shown by the datastream 2453, the "PRACTICE" mode is in "SWIM" sub-mode 2454. Pressing the "stop" button, as datastream 2455 indicates, returns the "PRACTICE" mode to its "SETUP" submode 2452, in which a swimmer can set up their desired swim plan, and otherwise use the base station.

Figure 25:
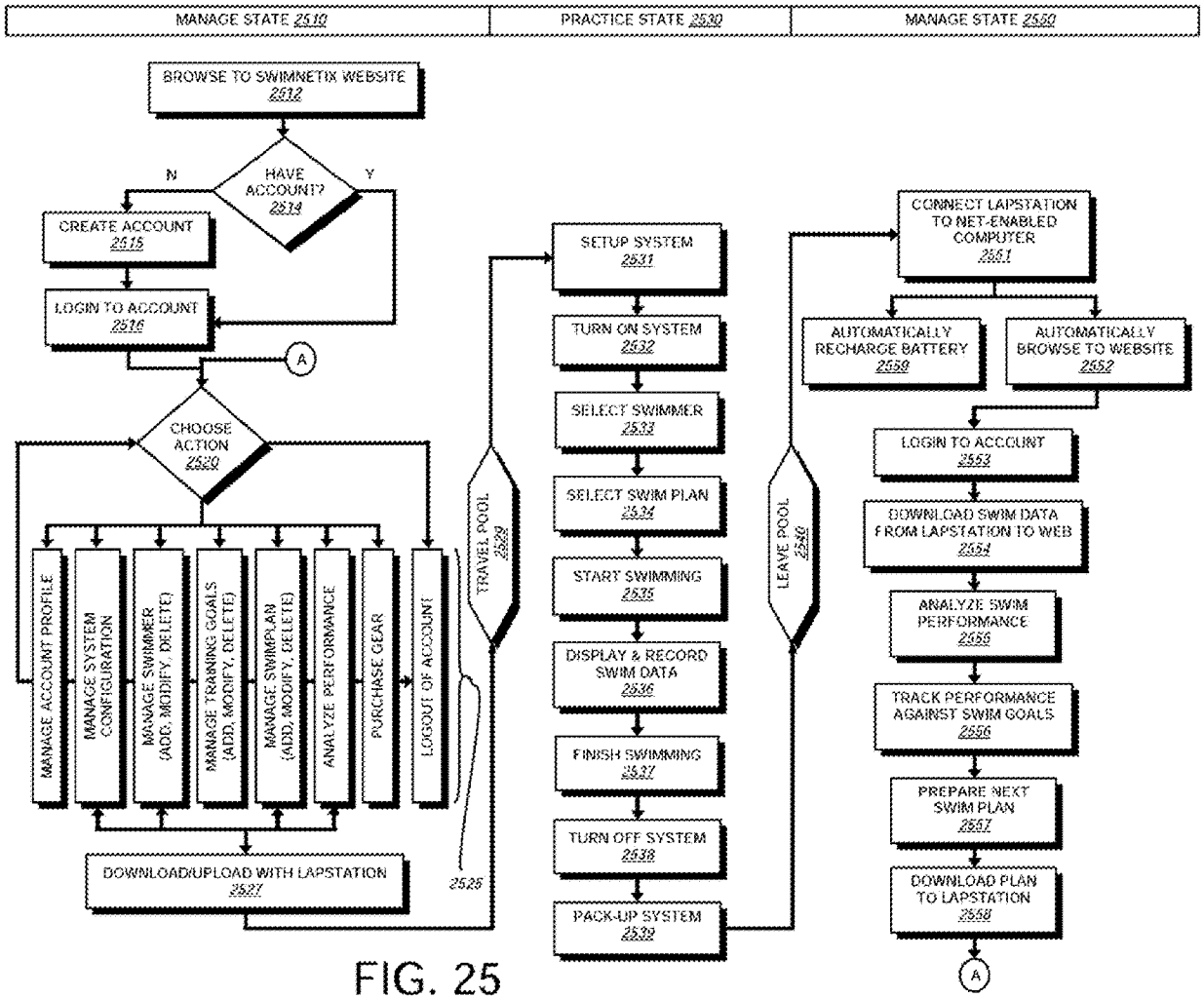
FIG. 25 is a flow diagram of an exemplary operation of the base station including the modes of operation, according to the illustrative embodiments.

An exemplary flow chart detailing an operational embodiment of the present invention is shown in FIG. 25. As shown, the "MANAGE" state 2510 includes a series of steps to managing the swim data. This can begin at step 2512 with a user browsing to the SwimNetix Internet-based website. Next a user determines if he or she possesses an account at decision step 2514. If he or she does not have an account, he or she must create the account at step 2515, and then at step 2516 log into the account. A swimmer can then choose an action at decision step 2520 from the various actions available 2525. These allow a swimmer to perform various tasks prior to going to the swim pool, such as purchasing gear, analyzing their performance, managing a swim plan, or other tasks. This information can then be downloaded and/or uploaded to the base station at step 2527.

The swimmer, if not yet at the pool, travels to the pool at decision step 2529 and then he or she engages in the "PRACTICE" mode 2530 of the swim training system. The swimmer sets up the system at 2531, by connecting the various components and placing them at their appropriate locations. The system is activated at step 2532, and the identity of the particular swimmer is selected at step 2533. A swim plan is selected by the swimmer at step 2534 and he or she starts swimming at step 2535. The swim data is displayed and recorded, continuously, at step 2536, until the swimmer finishes swimming at step 2537. The system is then deactivated at step 2538 and the system can be packed up for storage and/or transport at 2539. Note that the compact nature of the system and ease of use render it easy to transport and store when not in use.

The swimmer can depart the pool if desired at decision step 2540 and the system returns to a "MANAGE" state 2550. This is similar to the above-described "MANAGE" state 2510, in that the swimmer is remotely accessing and managing their swim training data and relevant information. The swimmer begins by connecting the base station to a computer at step 2551. In this manner, the battery is automatically recharged at step 2559 (as described hereinabove through the AC source and power conditioning circuitry connected to the battery), and the website can be browsed at step 2552. The user then logs into their account at 2553, and the swim data is downloaded from the base station to the web application at step 2554. The swimmer has the opportunity to analyze their swim performance at step 2555, track their performance against swim goals at step 2556, and prepare for the next swim plan at step 2557. The new swim plan can then be downloaded to the base station at step 2558. This continues to point 'A' which is continued under "MANAGE" state 2510, where a user is directed to choose an action, and the flow chart diagram continues as long as the user continues to manage their data and practice in the pool, gathering data.

Figure 26:
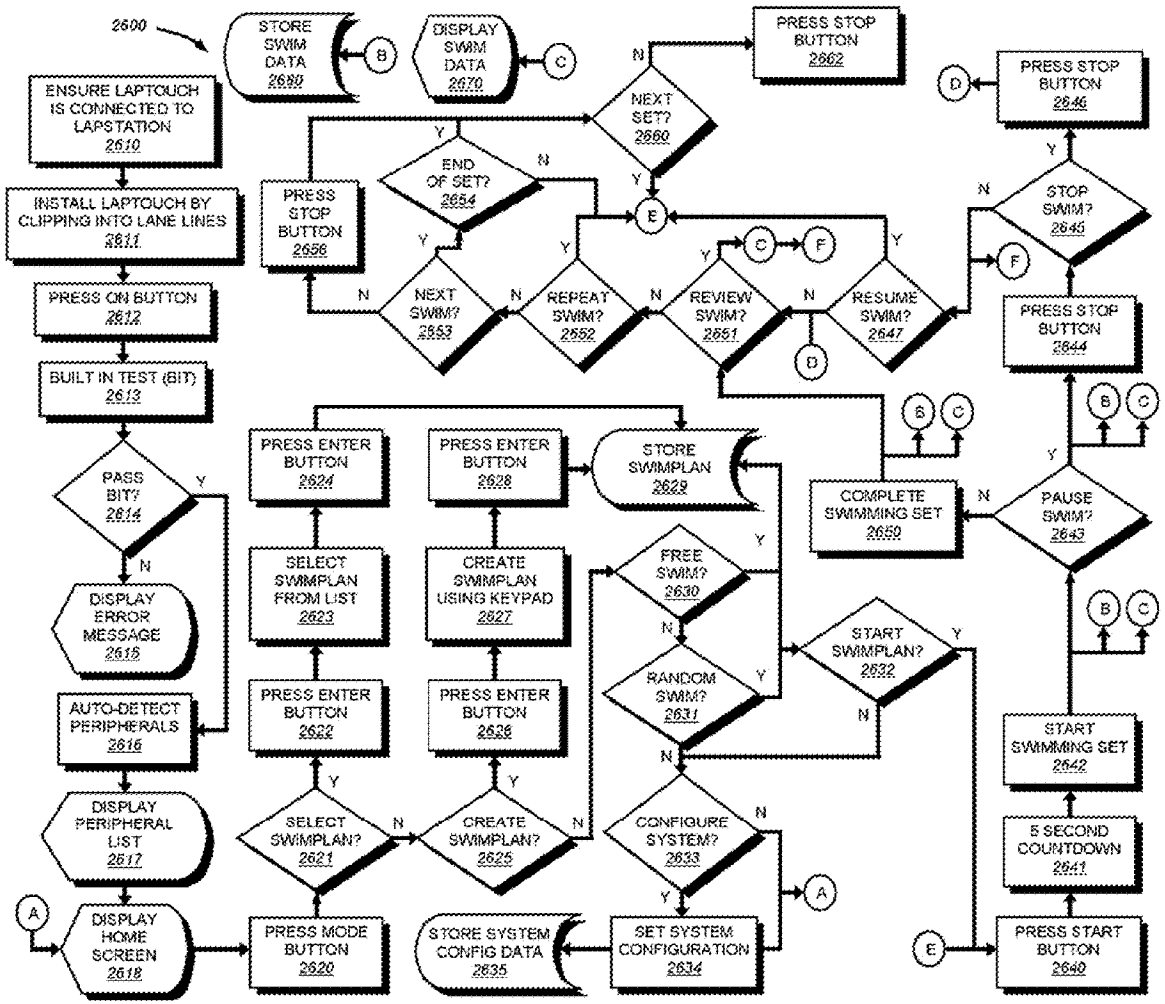
FIG. 26 is a flow diagram of the touch pad configuration, in operation, of the swim training system, according to the illustrative embodiments.

FIG. 26 details a flow diagram of the touch pad LapTouch configuration according to a procedure 2600 for monitoring swimming using the touch pad. As shown, the procedure 2600 begins by a user ensuring the touch pad is connected to the base station at step 2610. The touch pad is then secured within the pool at step 2611 by appropriate mechanisms, such as clips, hook or suction cups, provided thereon that can be secured to the lane lines. The "On" button is actuated at step 2612 and a Built-in Test is performed at step 2613. If the Built-in Test is not passed at decision step 2614, an error message is displayed to the user at step 2615. If the test is passed at step 2614, the peripherals are automatically detected by the base station at step 2616 and the peripheral list is displayed at step 2617. Then a home screen display is presented to the user at step 2618.

The user then selects the "MODE" button at step 2620 to determine the mode of operation, of the state of the swim training system. A user can then select a swim plan at decision step 2621, and if he or she selects a swim plan he or she presses the ENTER button at step 2622, and select a swim plan from the list provided at step 2623, then the ENTER Button is selected at step 2624 and this swim plan is stored at step 2629. If a swim plan is not selected at step 2621, a swim plan is created at decision step 2625, if desired, by selecting the ENTER button at step 2626.

A swim plan is then created using a touch screen keypad at step 2627, and upon pressing the ENTER button at step 2628, the swim plan is stored at step 2629. If a swim plan is not created at step 2625, the process prompts the user to determine if he or she wishes to participate in a free swim at decision step 2630. If yes, the free swim plan is initiated, if available, by pressing the start button at step 2640. If the user does not want to start the free swim plan, he or she is prompted to configure the system at decision step 2633. If the user does not want to configure the system, the user is directed ('A') back to the display home screen at step 2618. If a user desires to configure the system the user can set the system configuration at step 2634 and this information is stored as system configuration data at step 2635.

A swimmer that does start the swim plan then presses the start button at step 2640 and the swimmer is given a 5 second countdown at step 2641 to provide time prior to commencing the plan. The swimming set commences at step 2642 and the swimming data is constantly displayed at step 2670, and stored at step 2680 for a swimmer. If the user desires to pause swimming at decision step 2643, he or she can press the STOP button at step 2644. The swimmer is asked whether he or she wishes to stop swimming, and a 'no' answer directs the user to a second "resume swim" decision step 2647. If he or she wishes to stop swimming at step 2645, he or she must press the "STOP" button again at step 2646. The user can then determine if the user wishes to review their swim at decision step 2651. If yes, the information is displayed and stored for the swimmer.

If a user does not wish to review the swim data, he or she is prompted whether the user wishes to repeat the swim at decision step 2652, and if yes, he or she is directed back ('E') to press the START button at step 2640 and the swimming continues. A user can alternatively select no, and he or she is prompted as to whether he or she wishes to commence the "next" swim at decision step 2653. If a user wishes to stop, he or she must press the STOP button at step 2656, or if he or she is unsure, he or she is queried to determine if it is the end of a set at decision step 2654. Then the user is asked if he or she wants to swim the next set at procedure step 2660, and if yes, he or she is again directed to step 2640 by pressing the START button to commence swimming. If not, the user selects the STOP button at step 2662 and the swimming is completed.

Figure 27:
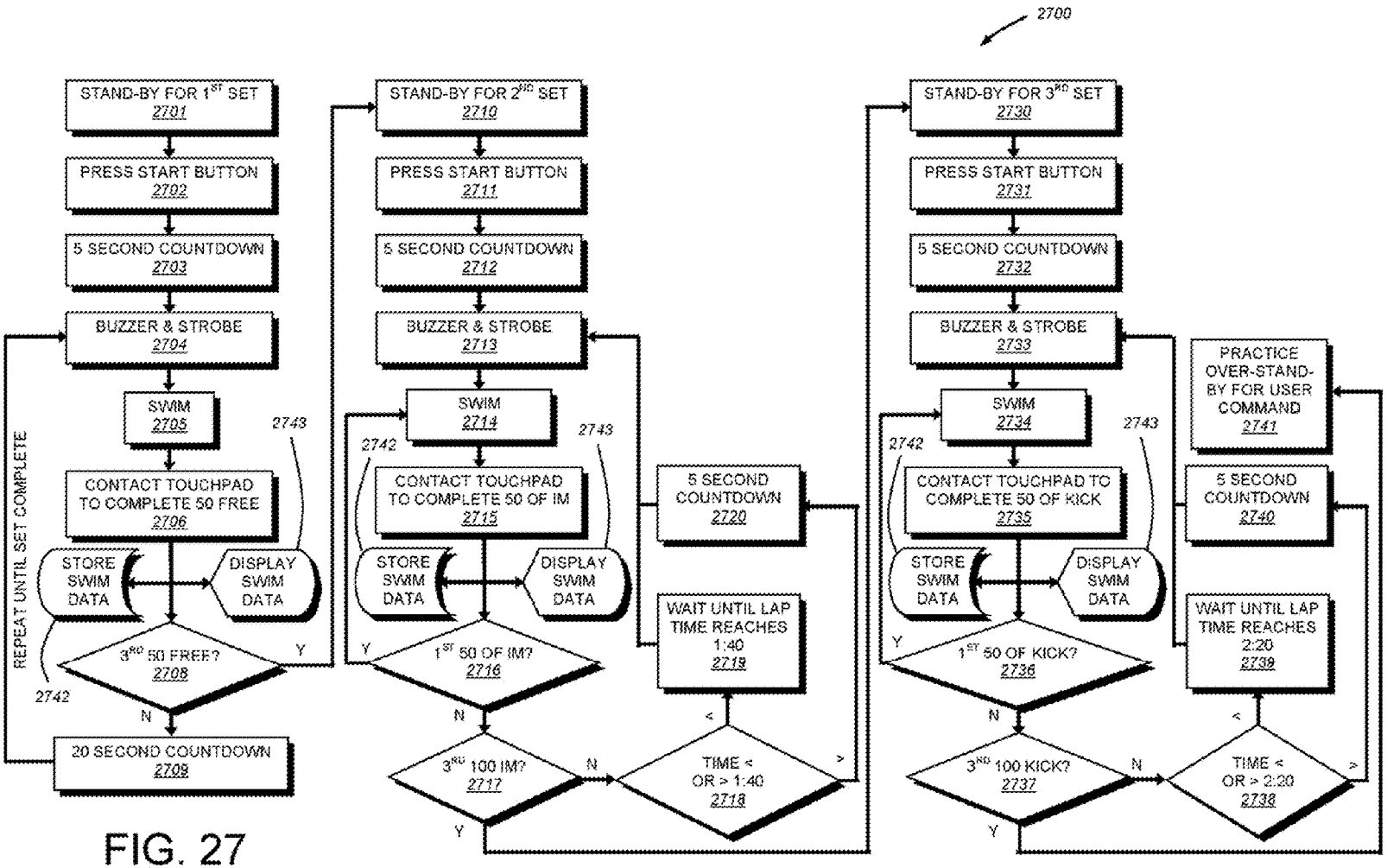
FIG. 27 is a flow diagram of an exemplary Swim Plan created using the base station of the swim training system, according to an illustrative embodiments.

The completion of exemplary swim plan is shown in the swim plan procedure 2700 of FIG. 27. As shown, the system begins with a stand-by for the first set at step 2701. The user begins by pressing the START button at step 2702. There is then a 5 second countdown at step 2703 to provide the swimmer with adequate time to prepare for the swim plan to commence. The buzzer and strobe are then activated at step 2704 to notify the swimmer that it is time to commence swimming at step 2705. The touch pad contact is acquired at step 2706 and is continuously stored and displayed to the swimmer as desired by the swim plan, until it has detected that it is the third "50 Free". The "50 Free" is a term known to those in the swimming field, representative of 50 yards of a particular stroke (freestyle). If the third set has not been completed, the procedure initiates a 20 second countdown at step 2709 and repeats step 2704 until the specified set is complete. Once a third set of these have been completed, as determined at decision step 2708, the procedure advances to the second set of the swim plan, at procedure step 2710. The swimmer then presses the START button at step 2711 and is given a 5 second countdown at step 2712 to prepare the swimmer. The buzzer and strobe are activated at step 2713 to notify the swimmer to begin to swim at step 2714. At step 2715, the touch pad contact is used to determine if one 50 IM (another type of swim stroke) has been completed. If is it the first 50, as determined by decision step 2716, the swimmer continues to swim until the set is complete. If it is the third set of 100 IM, as determined at decision step 2717.

A user can specify the time limits within which the user desires to complete a particular set, by time credentials or by completed laps. For example, decision step 2718 prompts the system whether the lap time is less than 1:40 or greater than 1:40. If less than 1:40, wait until the lap time reaches 1:40 total at step 2719, and then resound the buzzer and strobe, and if it has been more than 1:40 but the swimmer has not completed the desired set, there is a 5 second countdown given at step 2720 and then the buzzer and strobe are activated to notify the swimmer.

Once the swimmer has completed the sets of 100 IM satisfactorily, the swimmer then begins the third set at step 2730. The user begins by pressing the START button at step 2731, and then are given the preparatory 5 second countdown 2732. The buzzer and strobe are activated at the appropriate time at step 2733 and the swimmer begins swimming at step 2734. The contact of the touch pad at step 2735 is used to count the number of laps, and swimming data is constantly displayed at step 2743, and stored at step 2742 for a swimmer. If it is the first kick as determined at decision step 2736, then the user continues to swim. If it is not, the system determines if it is the third set that has been completed at step 2737. If it is not the third set, the system determines if too much time has elapsed.

If it is less than 2:20, as specified by the swimmer in their swim plan, the procedure waits until the lap time reaches 2:20 at step 2739 and then activates the buzzer and strobe. If is has been more than 2:20 in elapsed time, the procedure gives the swimmer a 5 second countdown at step 2740 and then activates the buzzer and the strobe. Once the third set of kicks has been detected by the procedure at decision step 2737, the procedure determines the practice is over and at step 2741 returns to stand-by mode and waits for further instruction from the user.

Figure 28:
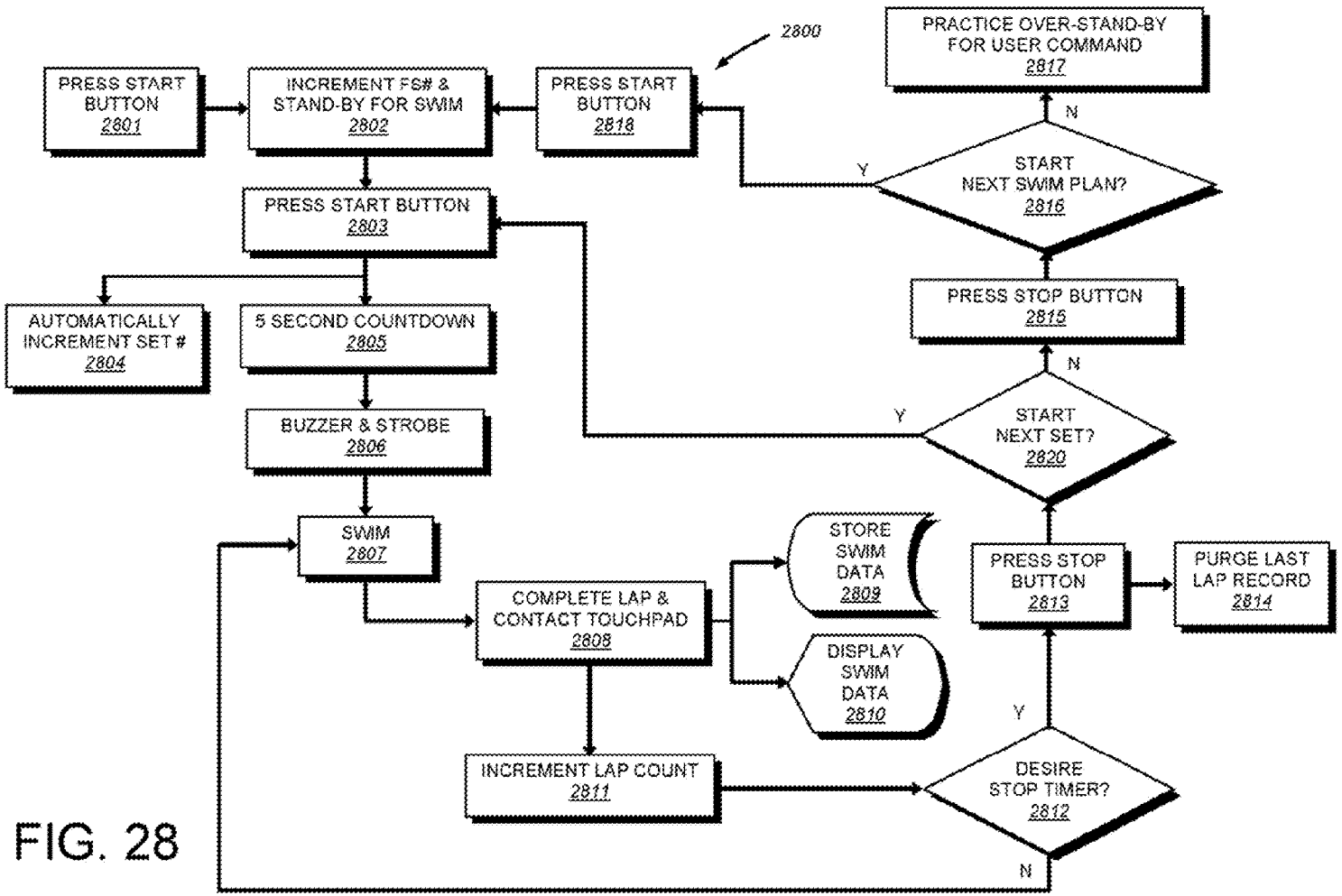
FIG. 28 is a flow diagram illustrating a Free Swim Plan created using the base station of the swim training system, according to the illustrative embodiments.

Reference is now made to FIG. 28, a flow diagram illustrating a free swim plan implemented using the base station of the swim training system. The procedure 2800 for a free swim plan begins when the user starts by pressing the START button 2801. The increment set number and stand-by for swim at step 2802 and then the user begins swimming by pressing the START button at step 2803. Next, the increment set number is automatically incremented at step 2804 and simultaneously, the swimmer is provided with a 5 second countdown at step 2805. The buzzer and strobe are activated at step 2806. This notifies the swimmer to begin to swim at step 2807.

A complete lap, and contact with a touch pad, are each registered at step 2808, and the swim data is then stored at step 2809 and displayed to a swimmer at step 2810. The lap count is incremented at step 2811, and then a swimmer is prompted as to whether the swimmer desires to stop the set at decision step 2812. If the user does not desire to stop, the swimmer continues to swim at step 2807 and continue to increment the lap counter until the swimmer decides he or she does want to stop the set. The user does this by pressing the STOP button at step 2813. This causes the last lap record to be purged at step 2814, and then at decision step 2820 the swimmer determines whether they desire to start the next set. If they do, they press the START button at step 2803 and continue through the procedure for determining lap counts and thus lap times, according to the free swim plan.

A swimmer that desires to, at decision step 2820, stop the next set, presses the STOP button at step 2815 and then at decision step 2816 determines whether they want to start the next swim plan. A swimmer can determine they would like to start the next swim plan, and if so, select the next swim plan and press the START button at step 2818 and the procedure begins at step 2802. The swimmer can determine they do not want to start the next swim plan and accordingly the practice is over at step 2817 and the system returns to a stand-by mode, waiting for user command.

VI. System Storage, Data Download and Recharging

Figure 29:
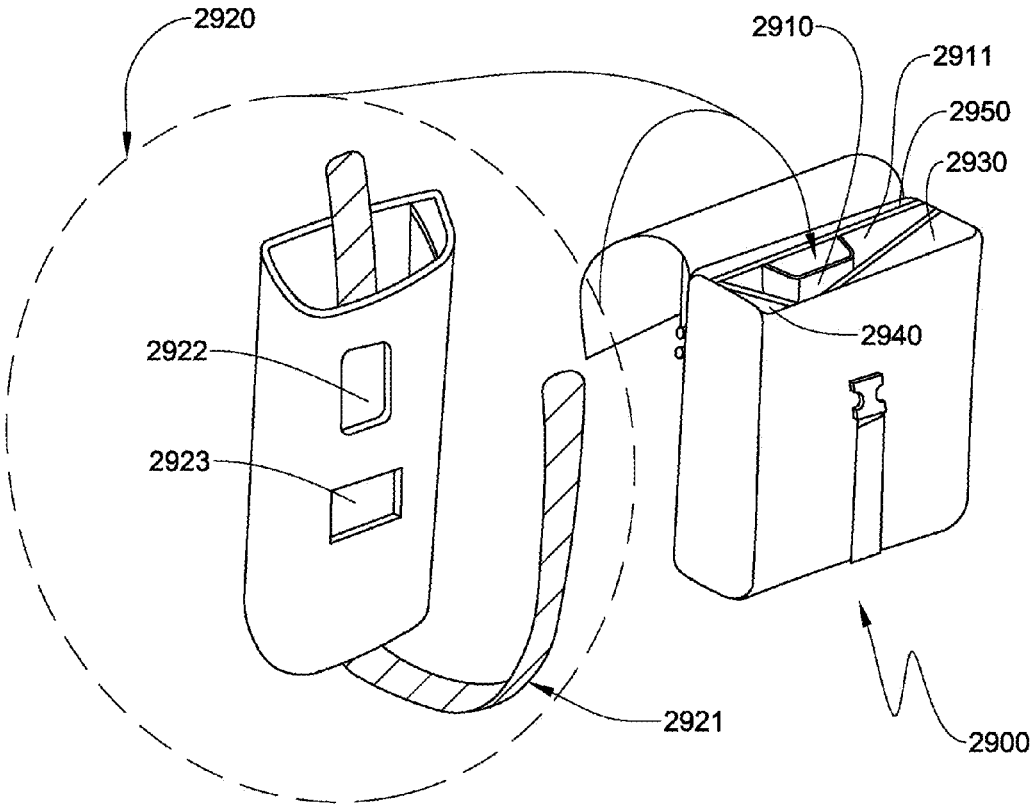
FIG. 29 is a front perspective view of a carrying case for convenient portability of all system components, according to the illustrative embodiments.

FIG. 29 shows a front perspective view of a carrying case ("LapSack"), constructed and arranged to carry the components of the swim training system. The carrying case 2900 includes a plurality of pockets and storage compartments for the swim training system. There is provided a compartment 2910 for storage of the LapStation base station. There is extra space 2911 in the compartment 2910 for a pigtail or other appropriate type of connector. The compartment defines a storage space 2920 for the FingerTapper hand device, ToeTapper foot device, and LapEye signal detection device. By way of further detail FIG. 29 also depicts the storage space 2920 in partial breakaway view. The storage space 2920 includes a compression strap 2921 for storing the hand device and foot device therein. The hand device and foot device are held tightly against the LapStation base station by a compression strap 2921. Area 2922 includes space for the FingerTapper hand device, and area 2923 for the ToeTapper foot device. The LapEye underwater detection device is also stored in the storage space 2920 in a folded orientation and oriented such that the FingerTapper LED is aligned with the LapEye photodetector or sensor. This orientation allows data to be transmitted in the carrying case while FingerTapper is recharging. The carrying case 2900 further includes a compartment 2930 which is an extra storage pocket for keys, credit cards, and other appropriate items that are not worn during swimming. The case can also provide an additional compartment 2940 and more storage space 2950 for storing additional items therein.

It is noted that the area 2922 is constructed and arranged to particularly accommodate the FingerTapper hand device, and respectively area 2923 for the ToeTapper foot device, such that the device may be inductively charged while placed in the carrying case 2900. For this purpose, each device illustratively includes an inductive receiver (e.g. an induction coil, not shown) of conventional design that allows receipt of electromagnetic energy through the case of the device free of any mechanical electrical connector. Likewise, the base station includes an inductive transmitter (one or more coils, also not shown) that is/are energized to induce a magnetic field in each receiving device. Thus, each device is placed in relatively close proximity to the LapStation by the layout of the case 2900 so as to complete the inductive link and thereby receive charging energy from the base station and its associated power source. Due to the solid state nature of each tapper device, the storage batteries in each device can be relatively small (in size and storage capacity (for example a Lithium-type cell).

VII. Touch-Screen LapStation—Operational Embodiment

Reference is now made to FIGS. 30-39 showing diagrams of exemplary Graphical User Interface (GUI) displays for the LapStation in accordance with a touch-screen embodiment (hereinafter LapStation-TS). The exemplary screen shots of FIGS. 30-39 illustrate an operational embodiment of the application that performs the various functions associated with aquatic training and the overall system described herein.

Figure 30:
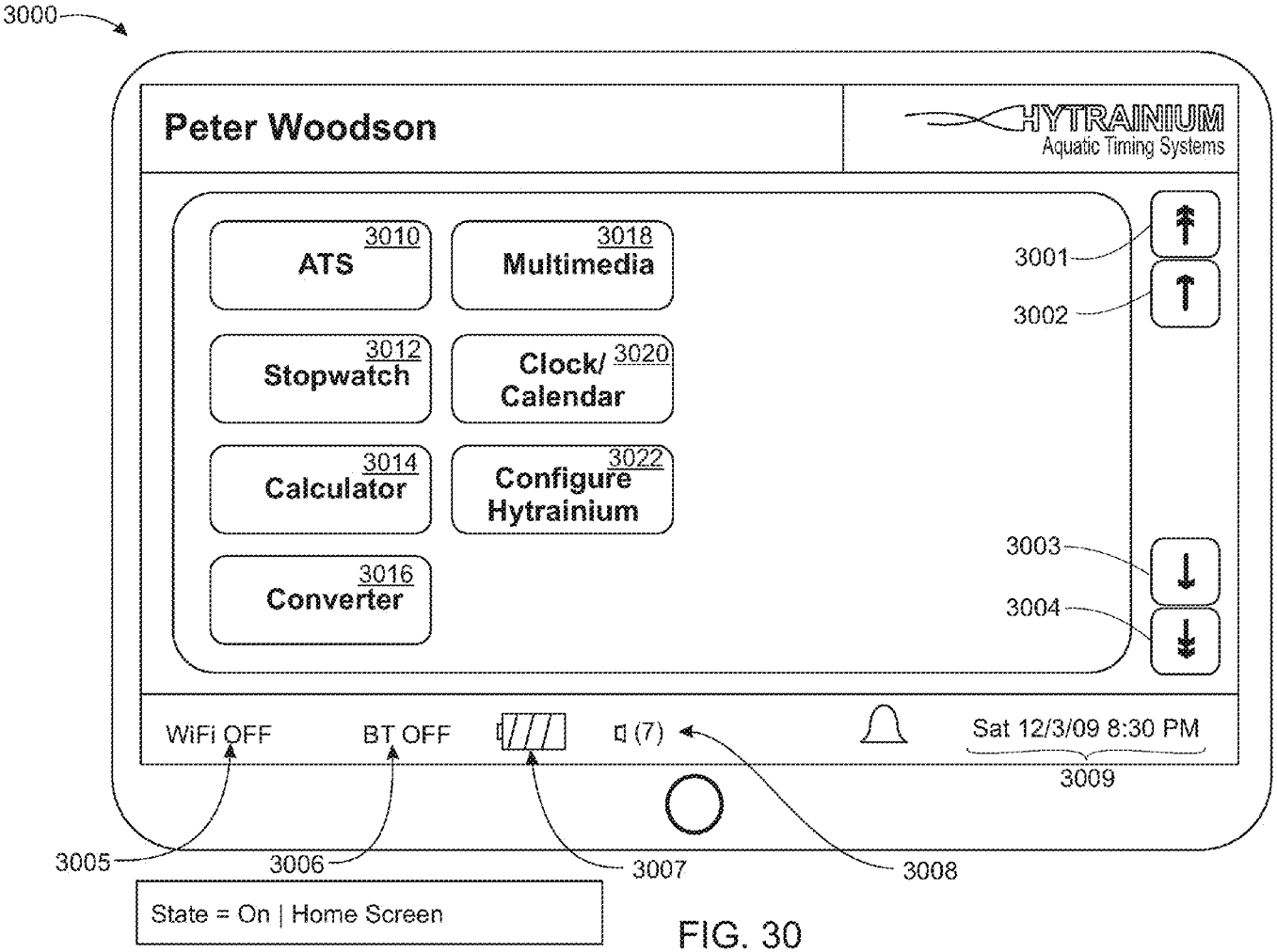
FIG. 30 is a diagram of an exemplary computer Graphical User Interface (GUI) display for a home screen of the touch-screen base station, according to the illustrative embodiments.

FIG. 30 is a diagram of an exemplary GUI display showing a home screen 3000 in accordance with the illustrative embodiment. The home screen 3000 provides users with several categories for aquatic training, including an Aquatic Timing System (ATS) button 3010, which is the link to run the application for creation of a swim plan or performance of a swim plan. Additionally, the home screen 3000 provides users with a Stopwatch button 3012 to use a stopwatch, a Calculator button 3014 for a calculator application, a Converter button 3016, a Multimedia button 3018, a Clock/Calendar button 3020 to view the clock and/or calendar, and a Configure Hytranium button 3022. The Configure Hytranium button 3022 directs a user through a series of steps and/or screens for managing the settings, including profile name, WiFi/BlueTooth connectivity, volume settings, display properties, touch-screen calibration, application manager, device information and a reset to reset device configurations.

Each screen display includes scrolling buttons to return to the top 3001, scroll up 3002, scroll down 3003, and return to the bottom 3004. Additionally, each screen displays the WiFi status 3005, BlueTooth (BT) status 3006, battery status 3007, volume level 3008 and date/time 3009.

Figure 31:
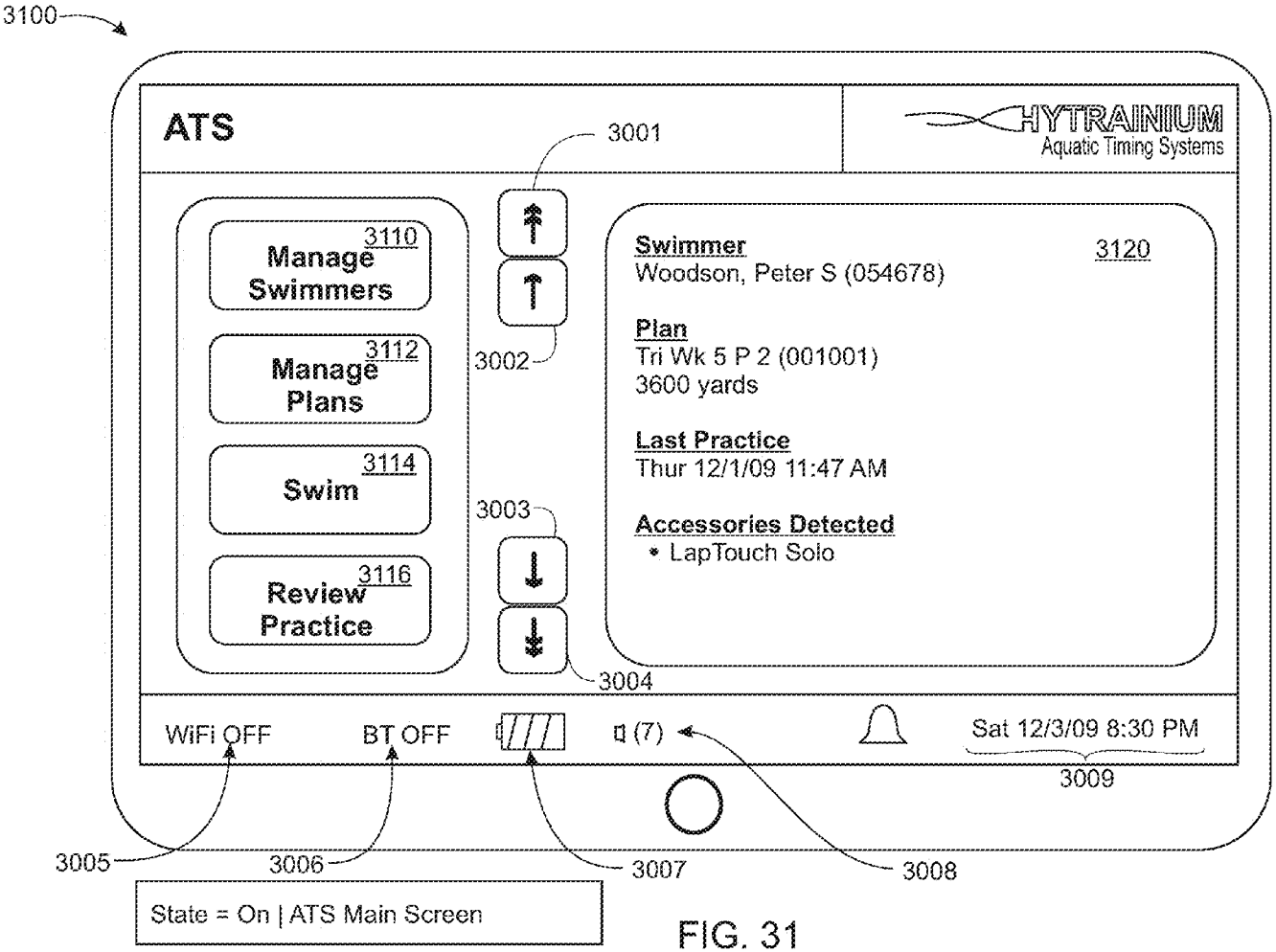
FIG. 31 is a diagram of an exemplary GUI display for an ATS main screen, according to the illustrative embodiments.

A user selecting the ATS button 3010 on screen display 3000 is directed to exemplary GUI display of FIG. 31, showing an ATS main screen 3100. The ATS main screen 3100 provides users with a menu of options for performing various functions of the aquatic training system. These functions include a manage swimmers application 3110, a manage plans application 3112, a swim application 3114 and a review practice application 3116. The user also has options (although not shown in FIG. 31) to configure ATS and to undergo a tutorial to understand how to use the device properly. Moreover, the ATS main screen 3100 includes a display portion 3120 that displays information and details for a particular user. A user can select the manage swimmers application 3110 to manage the swimmer(s) using the device for aquatic training and timing.

Figure 32:
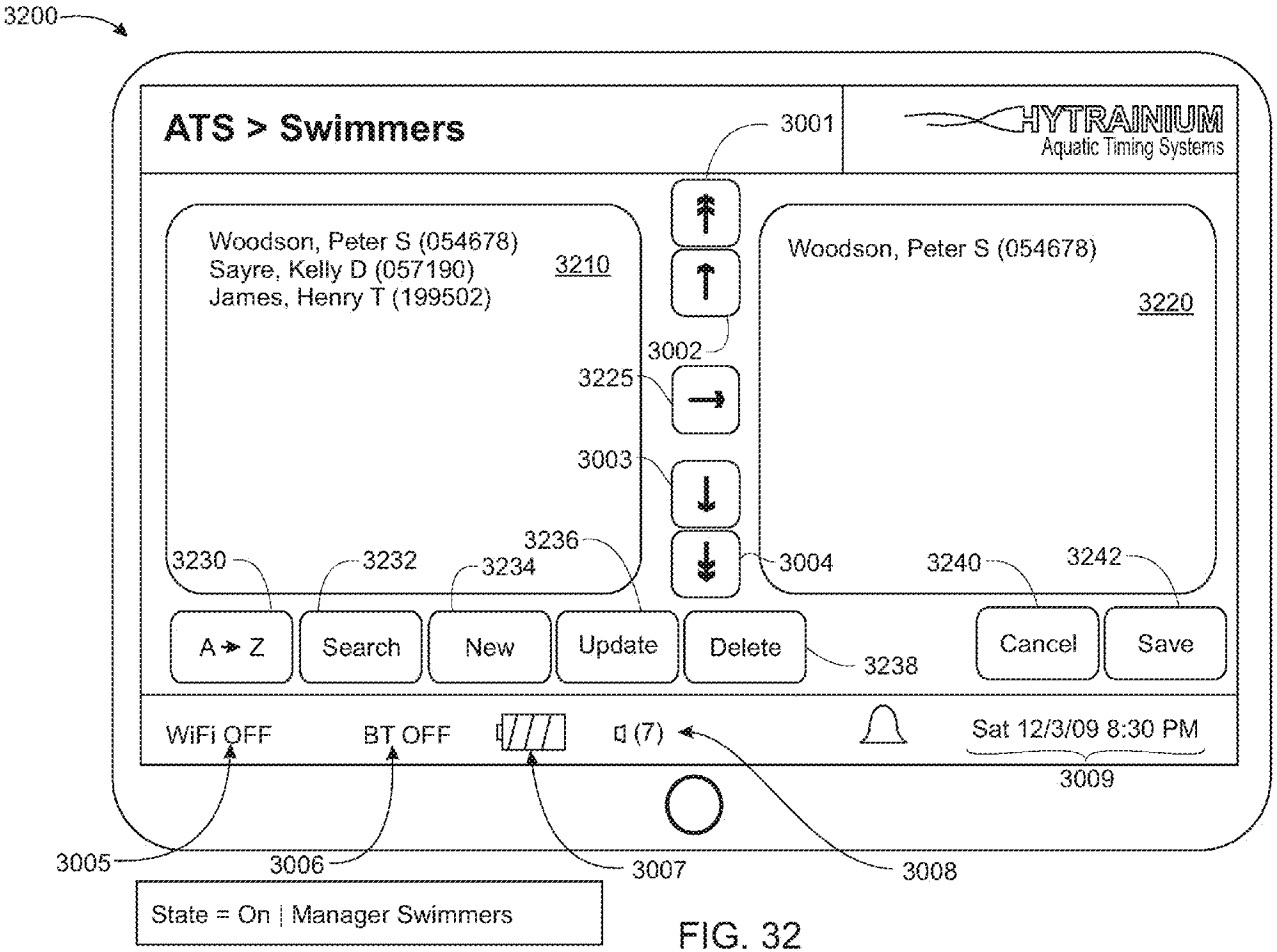
FIG. 32 is a diagram of an exemplary GUI display for a manage swimmers screen, according to the illustrative embodiments.

A user selecting the "Manage Swimmers" button 3110 of FIG. 31 is directed to exemplary GUI display of FIG. 32, showing a manage swimmers screen 3200. The manage swimmers screen 3200 provides a list of available swimmers in display portion 3220. Additionally, the user is provided with an "A→Z" button 3230 to specify that the swimmers listed in the display portion 3210 are listed in alphabetical order. A "Search" button 3232 is provided for users to search for additional swimmers. A new swimmer can be entered into the system by selecting "New" button 3234. An existing swimmer can be updated by selecting the "Update" button 3236 or deleted by selecting the "Delete" button 3238. Finally, a user can cancel the changes by selecting the "Cancel" button 3240 or save the changes by selecting the "Save" button 3242.

Figure 33:
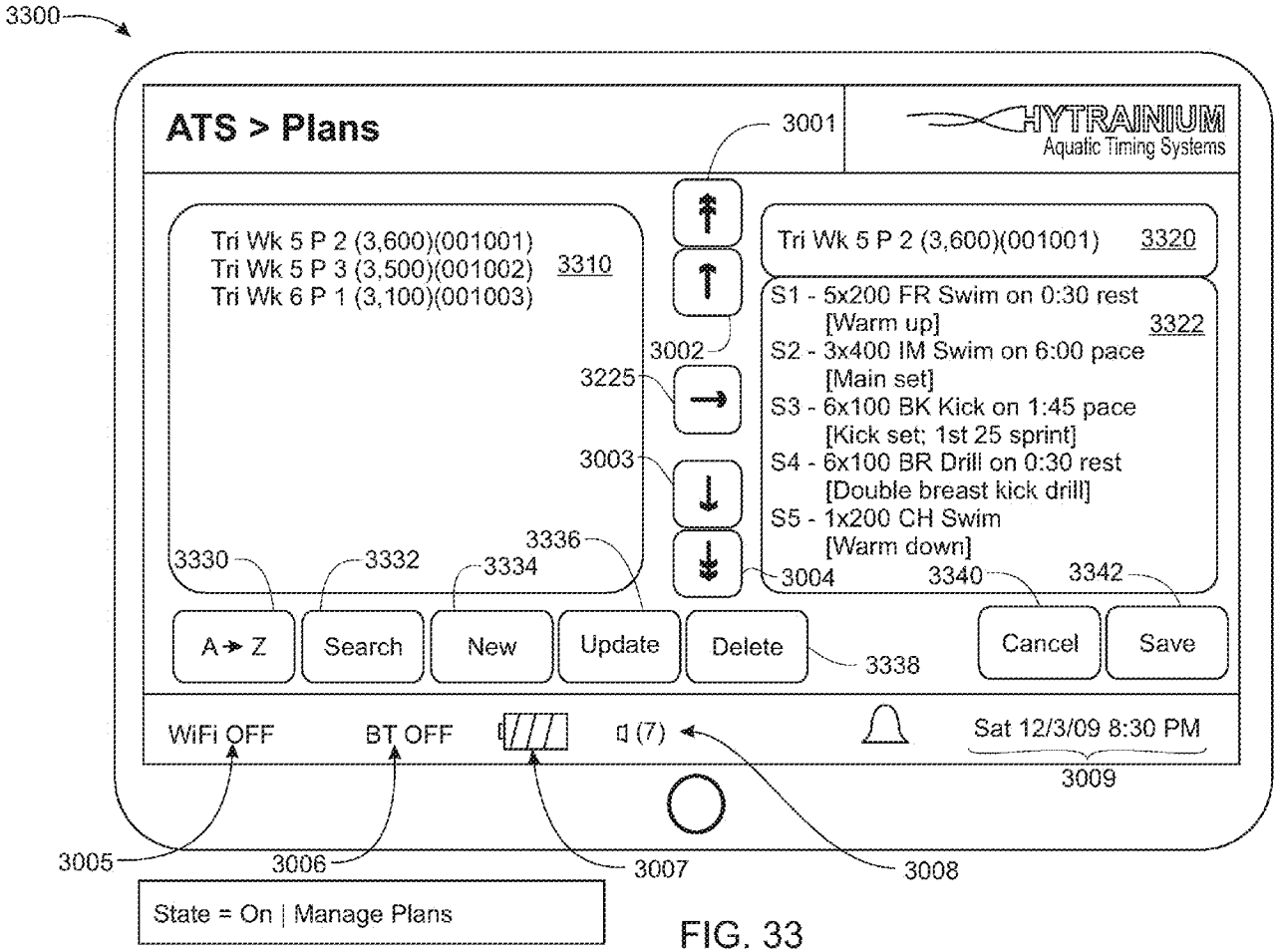
FIG. 33 is a diagram of an exemplary GUI display for a manage plan screen, according to the illustrative embodiments.
Figure 34:
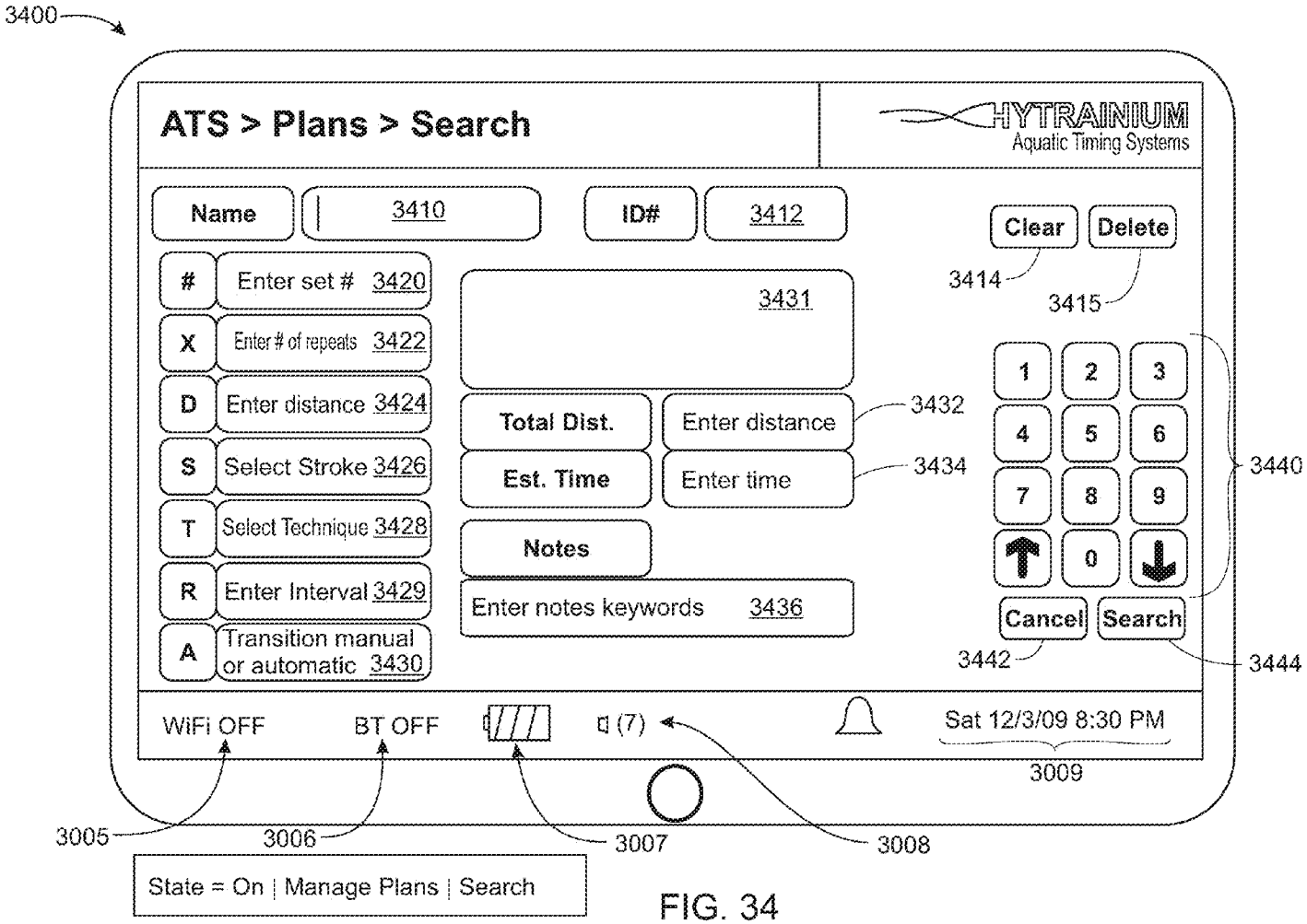
FIG. 34 is a diagram of an exemplary GUI display for a search plans screen, according to the illustrative embodiments.

A user selecting the "Manage Plans" button 3112 of screen 3100 is directed to exemplary GUI display of FIG. 33, showing a manage plans screen 3300. The screen 3300 includes a display portion 3310 which lists the available plans that have been entered into the system. Once a plan is selected, the user uses arrow button 3225 to select the plan. The title of the plan is then displayed in box 3320 and the details of the plan are displayed in display portion 3322. A user can organize the plans listed in display portion 3310 in alphabetical order by selecting the "A→Z" button 3330. Additionally, a user can search for other plans by selecting the "Search" button 3332, which directs a user to the exemplary GUI display of FIG. 34. As shown in the search plans screen 3400, a user can assign a name to the plan by typing into the box 3410, and an ID# can also be assigned by typing the number into the box 3412. The user then enters the set number 3420, number of repeats 3422, distance 3424, stroke to be swam 3426, technique used 3428, interval 3429, and the transition 3430. The transition 3430 can be set to be manual, so that a swimmer needs to manually press start to commence each set in the swim plan, or can be automatic so that the LapStation automatically advances to the next set in the swim plan. The data entered by the user is displayed in display box 3431, and the user can then enter the total time in box 3432 and estimated time in box 3434. Keywords can also be entered into box 3436 to provide notes regarding the swim plan. The keypad numbers 3440 are used for entering the data into the various boxes, and the user can cancel specific number entries by selecting "Cancel" 3442, or search for the entry by selecting "Search" 3444. The swim plan itself can be cleared by selecting the "Clear" button 3414 or deleted by selecting the "Delete" button 3415. Referring back to FIG. 33, a new plan can be created by selecting the "New" button 3334, or an existing plan can be updated by selecting the "Update" button 3336 or deleted by selecting the "Delete" button 3338. The user can then cancel any changes made by selecting the "Cancel" button 3340, or save any changes by selecting the "Save" button 3342.

Figure 35:
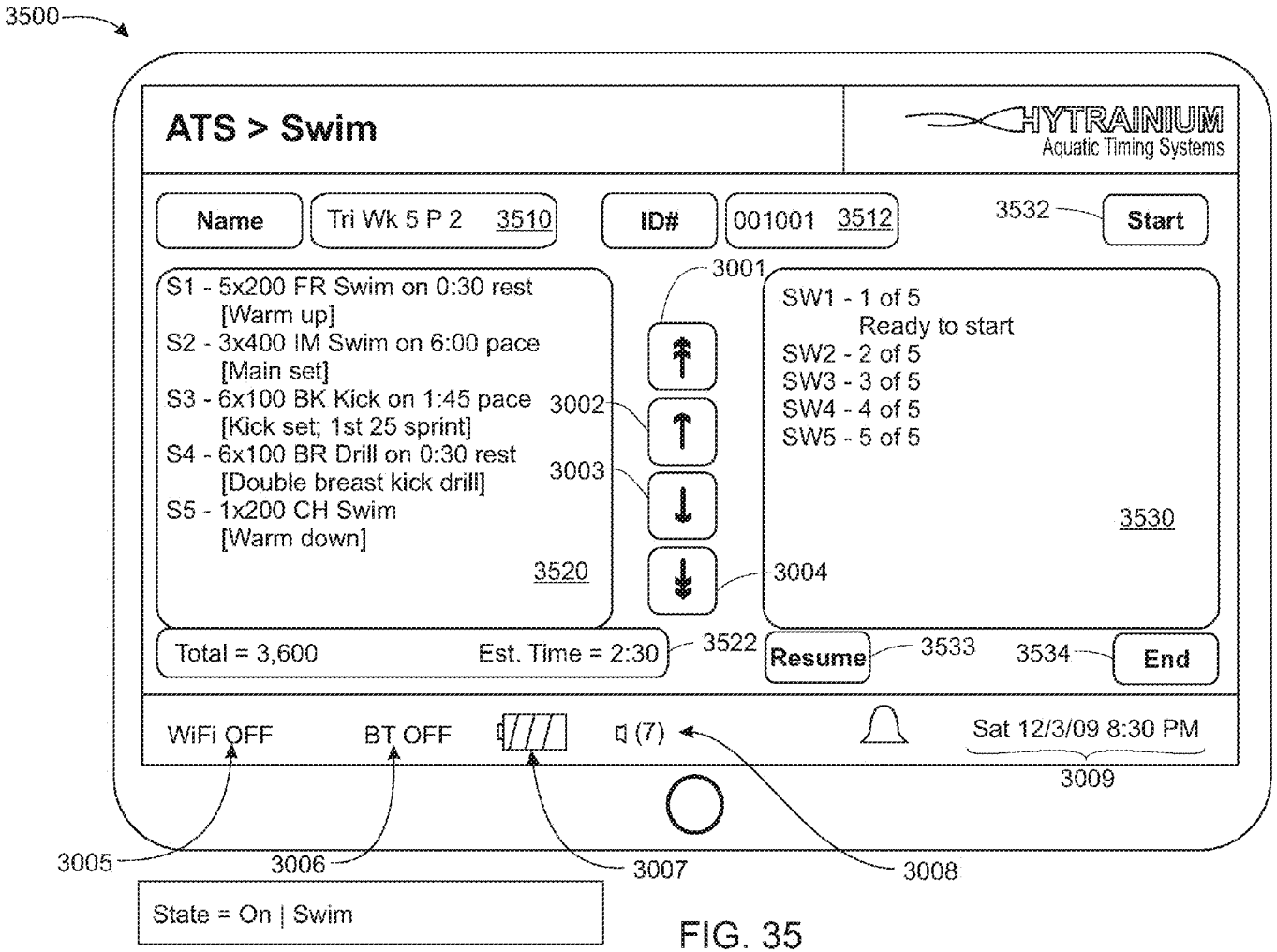
FIG. 35 is a diagram of an exemplary GUI display for a swim overview screen, according to the illustrative embodiments.

A user selecting the "Swim" button 3114 of screen 3100 is directed to exemplary GUI display of FIG. 35, showing a swim overview screen 3500. The swim overview screen 3500 provides users with the details for the particular swim plan which they have selected. The swim plan name is listed in box 3510, and the ID # is listed in box 3512. The details of the swim plan are provided in display portion 3520, and the total distance and total estimated time are provided in box 3522. The display portion 3530 provides users with the total swim plan and where the swimmer is in terms of progress for the swim plan. As shown, the swimmer is "ready to start" SW1, which is the first set of the swim plan. The user can select the "Start" button 3532 to commence swimming. The user can also select the "Resume" button 3533 to resume swimming once it has commenced, or the "End" button 3534 to end the swim plan.

Figure 36:
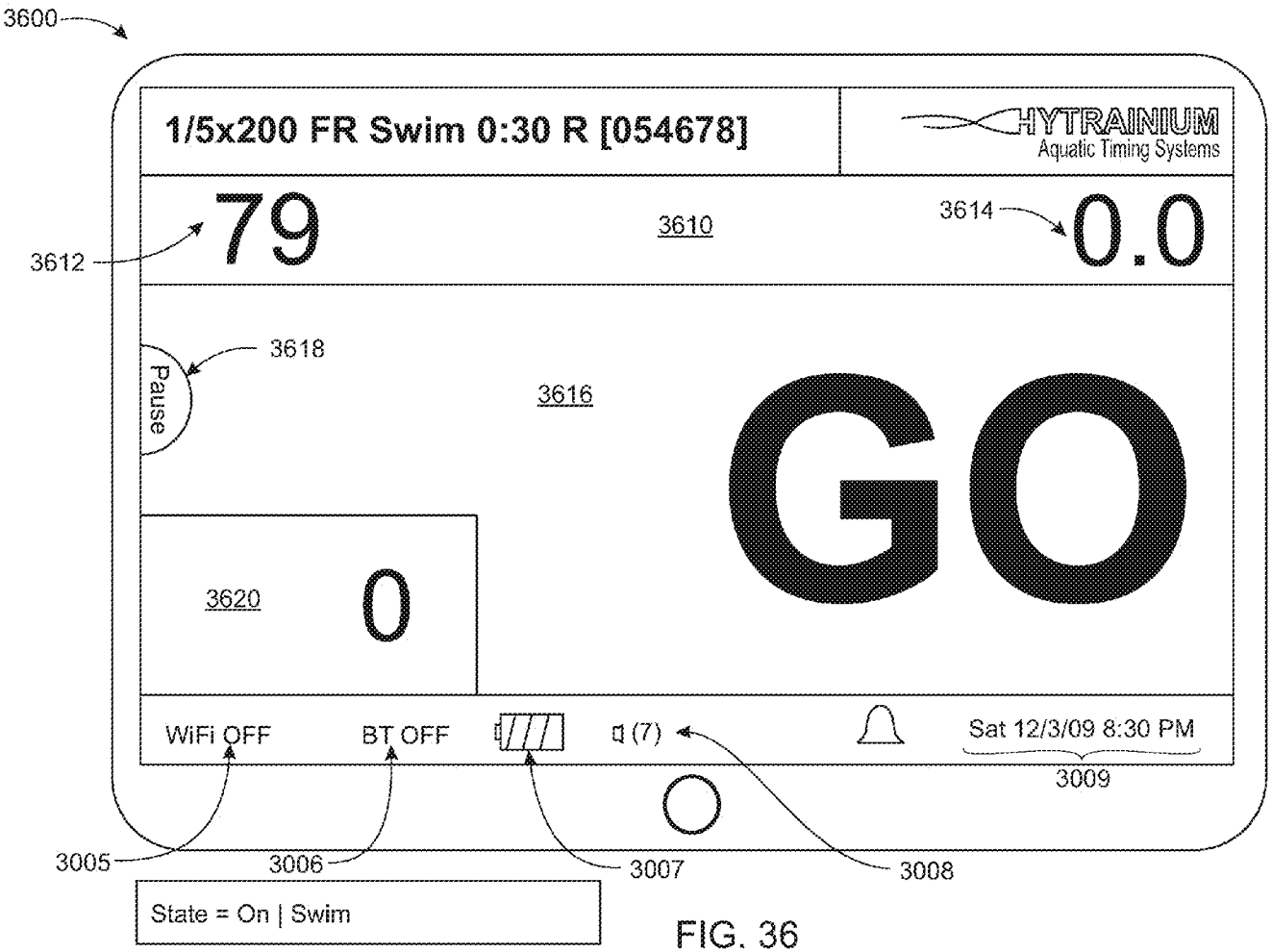
FIG. 36 is a diagram of an exemplary GUI display for a swim commencement screen, according to the illustrative embodiments.
Figure 37:
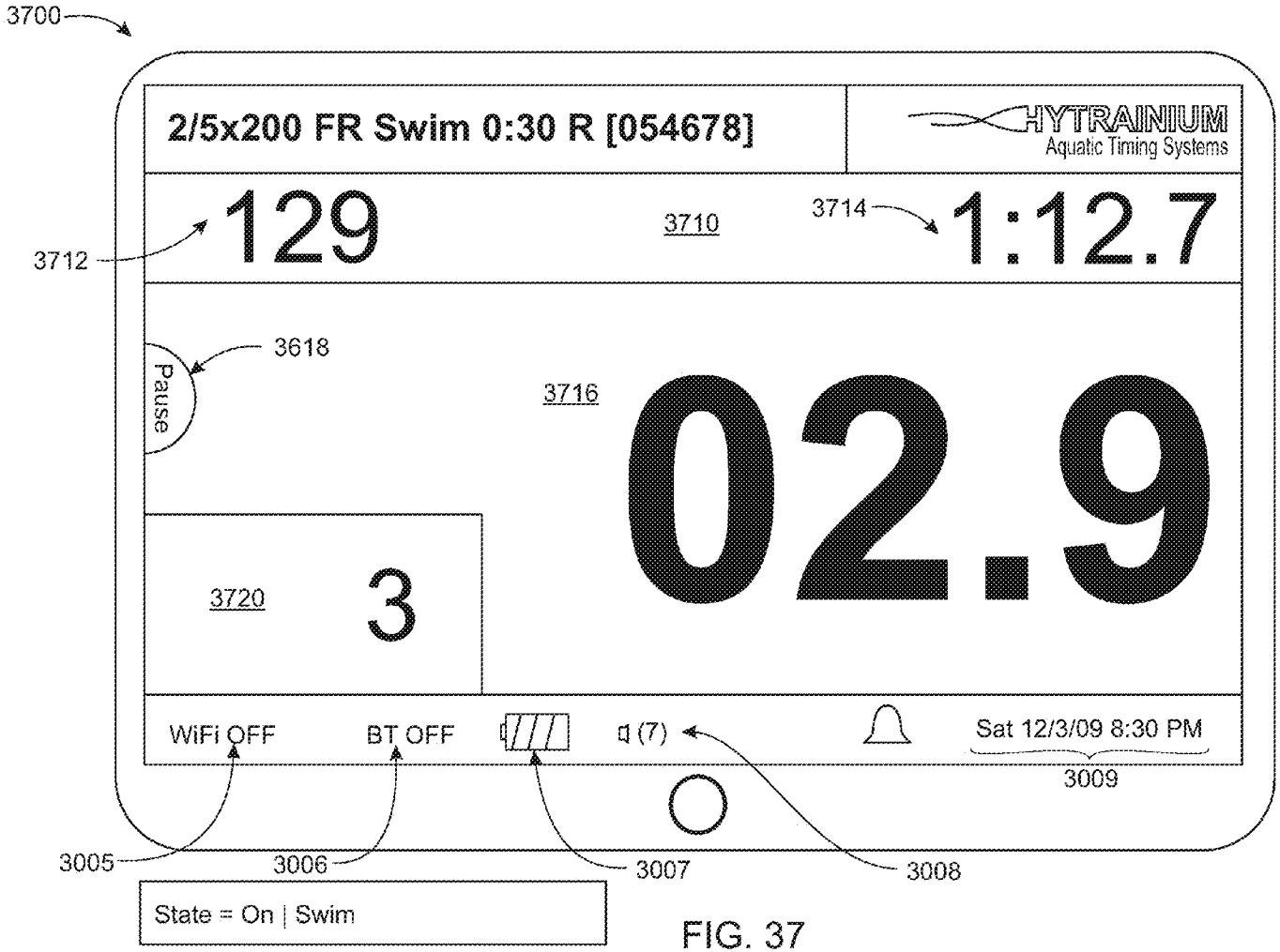
FIG. 37 is a diagram of an exemplary GUI display for a run-time swimming screen, according to the illustrative embodiments.
Figure 38:
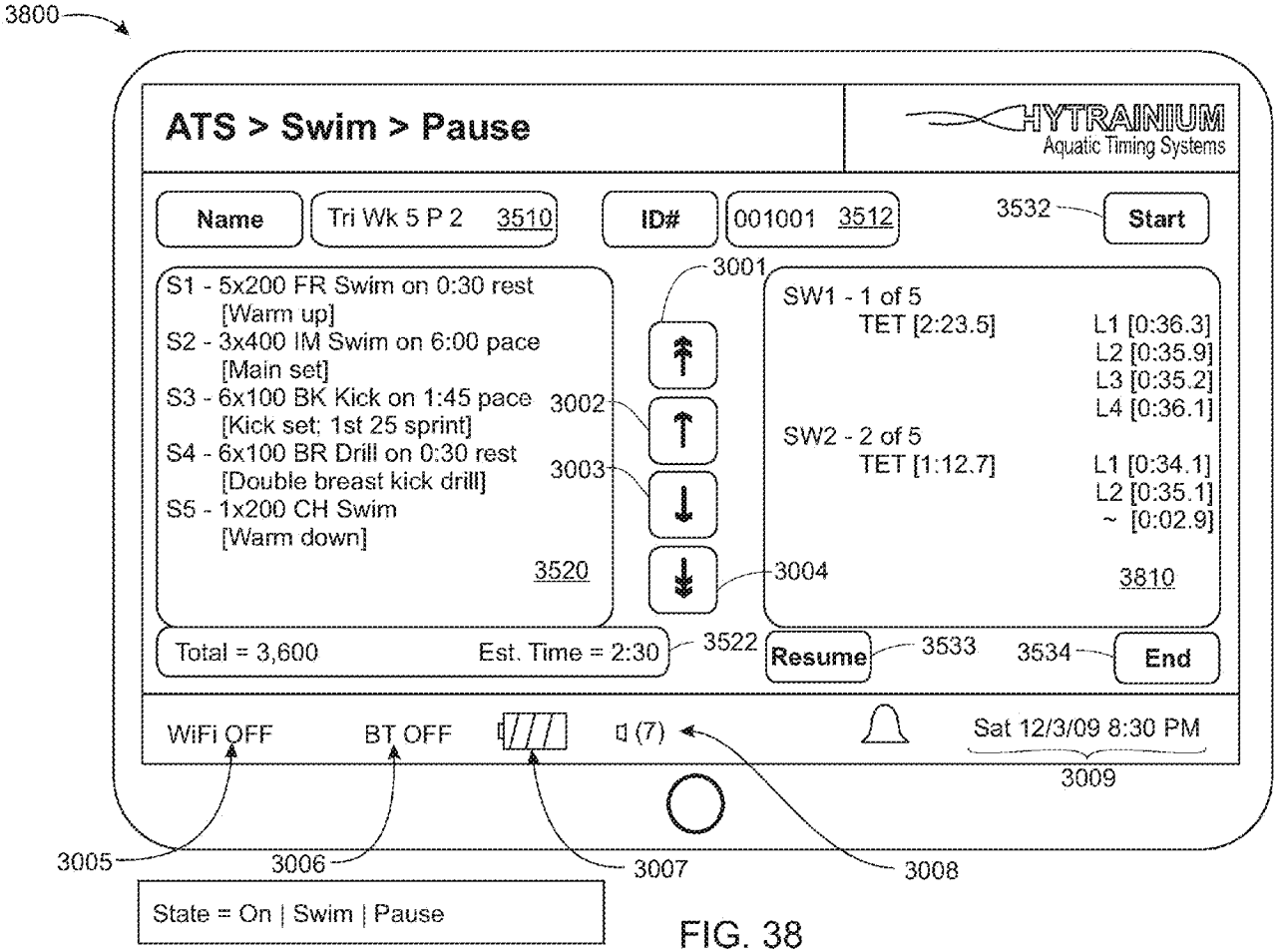
FIG. 38 is a diagram of an exemplary GUI display for a pause swimming screen, according to the illustrative embodiments.

To commence swimming when at the swim overview screen 3500, a user selects the "Start" button 3532 and is directed to the commence swimming screen 3600 shown in FIG. 36. The commence swimming screen 3600 provides users with information pertaining to the swim plan. The upper display portion 3610 displays the heart-rate 3612 (if available) for a particular swimmer, shown to be 79 in this display. Additionally, the upper display portion 3610 provides the elapsed time for a swim (which is 0.0 in this display because the swimming is just about to commence). When the user is to begin swimming, the central display portion 3616 displays "GO" or another appropriate visual queue to instruct the swimmer to begin. The central display portion 3616 also includes a "Pause" button 3618 to allow the swimmer to pause during the swim. There is also provided a lower display portion 3620 which displays the lap count for the swim. It is noted that in an illustrative embodiment, the display can count down from 5 to 1 before displaying GO to provide ample time for the swimmer to get prepared for the swim. As the swimmer continues to swim, the display changes to reflect the state of the swim. As shown in the exemplary GUI display of FIG. 37, showing a run-time swimming screen 3700. As shown, the upper display portion 3710 now displays a heart-rate 3712 of 129 and an elapsed swim time 3714 of 1:12.7. Also note that the central display portion 3716, which shows the lap time for the most recent lap, is 2.9 in this display. The lower display portion 3720 now reads 3 laps completed. A user can select the "Pause" button 3618 to pause the swimming, which directs the user to the exemplary GUI display of FIG. 38, showing a pause swimming screen 3800. As shown, the display portion 3810 shows the details for the swim plan thus far, and the overall lap times for each set. The user can resume the swim by selecting the "Resume" button 3533 or end the swim by selecting the "End" button 3534. Swimmers can also start, stop, resume, repeat, skip, swim using LapTouch keypad (see 561 of FIG. 5E).

Figure 39:
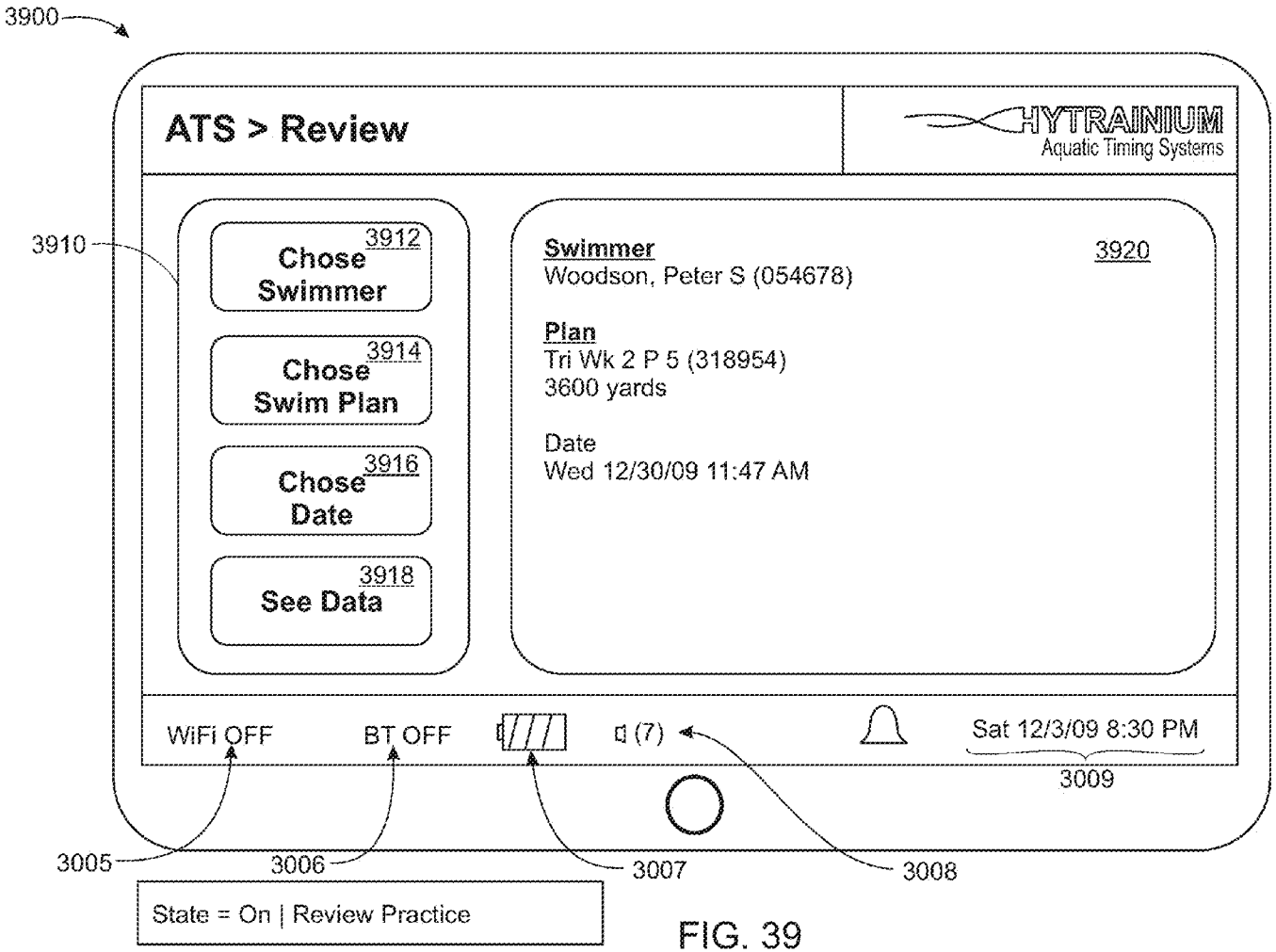
FIG. 39 is a diagram of an exemplary GUI display for a review practice screen, according to the illustrative embodiments.

To review a practice, a user can select the "Review Practice" button 3116 of FIG. 31, which directs the user to exemplary GUI display of FIG. 39. As shown in FIG. 39, a review screen 3900 is provided having a menu 3910 with various options for reviewing a particular swimmer or plan, to review the data corresponding thereto. The menu 3910 includes a "Choose Swimmer" button 3912 which allows the user to select the particular swimmer for review, a "Choose Swim Plan" button 3914 which allows the user to select the particular swim plan for review, a "Choose Date" button 3916 to select the date for review, and a "See Data" button 3918 to view corresponding data. The review screen 3900 further includes a display portion 3920 which displays the corresponding data for a particular swimmer, swim plan, and date. The parameters can be adjusted accordingly using the menu 3910 buttons to review data as desired.

A variety of alternate swim plans, training routines and monitoring procedures can be implemented in alternate exemplary embodiments. In general, it should be clear that the system and method of this invention provides a versatile, user-friendly, portable, durable and information-rich toolkit for training and monitoring competitive swimmers. The system and method is personalized to an individual swimmer's characteristics and needs but scalable to an entire swim team and/or program. The information gathered, displayed and provided is useful to the individual, the coach and the team as a whole.

The foregoing has been a detailed description of illustrative embodiments of the invention. Various modifications and additions can be made without departing from the spirit and scope of this invention. Each of the various embodiments described above may be combined with other described embodiments in order to provide multiple features. Furthermore, while the foregoing describes a number of separate embodiments of the apparatus and method of the present invention, what has been described herein is merely illustrative of the application of the principles of the present invention. For example, the terms used herein, such as LapDash, LapStation, FingerTapper, ToeTapper, LapTouch, and similarly phrased terms, are meant to describe elements by way of example only and are not intended to limit the scope of the particular devices which they describe. For example, the LapDash can comprise any appropriate underwater display that can be operatively connected to a base station for displaying pertinent data. Furthermore, the sizing and exemplary numbers used herein are for illustrative and exemplary purposes only. The teachings are clearly applicable to all types of swim plans, swim lap sets and various modifications of the various components in terms of size and shape are contemplated herein without altering the concepts disclosed herein. In addition, the various functions and operations described herein can be implemented in hardware, software comprising a computer-readable medium consisting of program instructions or a combination of hardware and software. Accordingly, this description is meant to be taken only by way of example, and not to otherwise limit the scope of this invention.

What is claimed is:

1. A system for aquatic training of a swimmer in a swimming pool, the system comprising:

a touch pad for detecting movement, in at least one axis of movement, of the swimmer that is performing laps in the swimming pool;

the touch pad including a flexible touch sheet that is constructed and arranged for suspension from a side of the swimming pool, and at least one accelerometer that determines whether the movement from the swimmer has occurred based upon the at least one axis of movement of the accelerometer;

the accelerometer mounted with the flexible touch sheet so as to respond to the detected movement of the flexible touch sheet;

touch pad control electronics associated with the touch pad coupled to, and for logging movement of, the accelerometer;

a base control device including a display device for displaying at least lap time and constructed and arranged for viewing by the swimmer during a lap, a waterproof case assembly for housing the display, and a system processor operatively connected to the touch pad control electronics and for storing data corresponding to touch pad movement for display on the display device.

2. The system of claim 1 wherein the base control device includes a touch-screen display having an adhesive overlay integrated therein that seals to a surface of a bottom case of the case assembly, so as to, in combination with at least one waterproof connector, render the base control device waterproof.

3. The system of claim 2 wherein the adhesive overlay includes a plurality of micro-beads on a portion of the overlay facing the touch-screen display to prevent a non-adhesive portion of the overlay from sticking to a portion of the touch-screen display within the perimeter of the touch-screen display.

4. The system of claim 1 wherein the accelerometer is mounted so as to respond to both contact and near contact of the swimmer with the flexible touch sheet.

5. The system of claim 1 further comprising a continuous heart rate monitoring device and a procedure for obtaining a heart rate of the swimmer.

6. The system of claim 1 further comprising wireless communication for exchanging data with a plurality of other devices connected within a network.

7. The system of claim 1 including a sensing device for monitoring a swimmer in an aquatic environment, wherein the sensing device is operatively connected to the base control device and detects at least one contact of the swimmer, and an application running on the base control device, for receiving and storing data corresponding to a plurality of contacts, the plurality of contacts including the at least one contact, and wherein the sensing device is an optical communication device, and the data corresponding to the plurality of contacts is transmitted optically from the swimmer to the optical communication device and then to the base control device.

8. The system of claim 7 further comprising a tapper device for detecting the plurality of contacts by the swimmer, and the tapper device optically transmits data corresponding to the plurality of contacts to the optical communication device.

9. The system of claim 8 wherein the swimmer is provided with a unique identifier represented respectively on the tapper device, and another swimmer is provided with another unique identifier represented on another tapper device.

10. The system of claim 8 wherein the tapper device is a finger tapper device for detecting the plurality of contacts by the swimmer, and the finger tapper optically transmits data corresponding to the at least one contact to the optical communication device.

11. The system of claim 8 wherein the tapper device is a toe tapper device for detecting the plurality of contacts by the swimmer, and the toe tapper optically transmits data corresponding to the at least one contact to the optical communication device.

12. The system of claim 10 further comprising a continuous underwater heart-rate monitoring device and procedure for optically transmitting heart-rate to the optical communication device.

13. The system of claim 10 wherein the device is recharged inductively by the base control device and stored data is transmitted to the base control device when the tapper device is properly positioned adjacent the base control device and initiates recharge.

* * * * *